US007644590B2

(12) United States Patent
Holmes et al.

(10) Patent No.: US 7,644,590 B2
(45) Date of Patent: Jan. 12, 2010

(54) ELECTRONICS ARCHITECTURE FOR A REFRIGERATOR QUICK CHILL AND QUICK THAW SYSTEM

(75) Inventors: John S. Holmes, Sellersburg, IN (US); Jerry J. Queen, II, New Albany, IN (US); Rollie R. Herzog, Louisville, KY (US); Mark Robert Mathews, Lombard, IL (US); Robert M. Bultman, Smithfield, KY (US); Tim Holder, Lagrange, KY (US); Wolfgang Daum, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/919,081

(22) Filed: Aug. 16, 2004

(65) Prior Publication Data

US 2005/0011205 A1 Jan. 20, 2005

Related U.S. Application Data

(62) Division of application No. 09/742,545, filed on Dec. 22, 2000, now Pat. No. 6,782,706.

(51) Int. Cl.
*F25D 17/06* (2006.01)
*F25B 29/00* (2006.01)

(52) U.S. Cl. ..... 62/90; 165/63

(58) Field of Classification Search ..... 62/157, 62/187, 126, 127, 150, 186, 231, 340, 344, 62/90, 173, 71, 73, 351, 353; 165/61, 62, 165/63, 64

See application file for complete search history.

(56) References Cited

U.S. PATENT DOCUMENTS

| | | | | |
|---|---|---|---|---|
| 3,759,053 | A * | 9/1973 | Swaneck, Jr. | 62/157 |
| 4,002,199 | A * | 1/1977 | Jacobs | 62/80 |
| 4,358,932 | A * | 11/1982 | Helfrich, Jr. | 62/186 |
| 4,368,622 | A * | 1/1983 | Brooks | 62/157 |
| 4,387,578 | A | 6/1983 | Paddock | |
| 4,490,986 | A | 1/1985 | Paddock | |
| 4,535,598 | A | 8/1985 | Mount | |
| 4,555,057 | A | 11/1985 | Foster | |
| 4,566,285 | A | 1/1986 | Tershak et al. | |
| 4,573,325 | A | 3/1986 | Chiu et al. | |
| 4,604,871 | A | 8/1986 | Chiu et al. | |

(Continued)

FOREIGN PATENT DOCUMENTS

| | | |
|---|---|---|
| JP | 04161775 | 6/1992 |

(Continued)

*Primary Examiner*—Chen-Wen Jiang
(74) *Attorney, Agent, or Firm*—George L. Rideout, Esq.; Armstrong Teasdale LLP

(57) ABSTRACT

A control system for a refrigeration system having a refrigeration compartment and a quick chill/thaw pan. A main controller board, electrically connected to a temperature adjustment board and a dispenser board through the serial communications bus, controls the temperature of the refrigeration compartment and the quick chill/thaw pan. The control system accepts a plurality of inputs to determine a refrigeration mode and to execute a plurality of software algorithms to control the refrigeration compartment as both a chill pan to rapidly chill food and beverage items without freezing and a thaw pan to timely thaw frozen items at controlled temperature levels.

14 Claims, 61 Drawing Sheets

U.S. PATENT DOCUMENTS

| | | | | | |
|---|---|---|---|---|---|
| 4,646,528 | A | | 3/1987 | Marcade et al. | |
| 4,707,684 | A | | 11/1987 | Janke et al. | |
| 4,834,169 | A | | 5/1989 | Tershak et al. | |
| 4,841,735 | A | | 6/1989 | Oike | |
| 4,949,550 | A | | 8/1990 | Hanson | |
| 4,966,004 | A | | 10/1990 | Midlang et al. | |
| 4,969,576 | A | | 11/1990 | Merrill et al. | |
| 4,970,870 | A | * | 11/1990 | Midlang et al. | 62/126 |
| 5,033,273 | A | * | 7/1991 | Buchser et al. | 62/344 |
| 5,123,253 | A | | 6/1992 | Hanson et al. | |
| 5,136,865 | A | | 8/1992 | Aoki et al. | |
| 5,187,941 | A | | 2/1993 | Tershak et al. | |
| 5,337,575 | A | | 8/1994 | Ishihara | |
| 5,398,251 | A | | 3/1995 | Shim | |
| 5,437,163 | A | * | 8/1995 | Jurewicz et al. | 62/126 |
| 5,454,230 | A | | 10/1995 | Janke et al. | |
| 5,476,672 | A | * | 12/1995 | Kim | 426/231 |
| 5,787,718 | A | * | 8/1998 | Jeong | 62/157 |
| 5,872,721 | A | * | 2/1999 | Huston et al. | 62/150 |
| 5,886,430 | A | | 3/1999 | Ralson et al. | |
| 6,401,481 | B2 | | 6/2002 | Hiraoka et al. | |
| 6,405,544 | B2 | | 6/2002 | Hiraoka et al. | |
| 6,405,547 | B2 | | 6/2002 | Hiraoka et al. | |
| 6,405,548 | B1 | | 6/2002 | Hollenbeck | |
| 6,526,766 | B1 | | 3/2003 | Hiraoka et al. | |
| 6,655,158 | B1 | * | 12/2003 | Wiseman et al. | 62/73 |
| 6,662,574 | B2 | | 12/2003 | Loibl et al. | |
| 6,802,369 | B2 | | 10/2004 | Zentner et al. | |
| 6,865,900 | B2 | | 3/2005 | Ozawa et al. | |
| 7,036,334 | B2 | | 5/2006 | Ko et al. | |
| 7,051,549 | B2 | | 5/2006 | Kim et al. | |
| 2002/0011072 | A1 | * | 1/2002 | Hiraoka et al. | 62/126 |

FOREIGN PATENT DOCUMENTS

| | | |
|---|---|---|
| JP | 04187970 | 7/1992 |
| JP | 04244569 | 9/1992 |
| JP | 06213547 | 8/1994 |
| JP | 07174453 | 7/1995 |
| JP | 11223444 | 8/1999 |

* cited by examiner

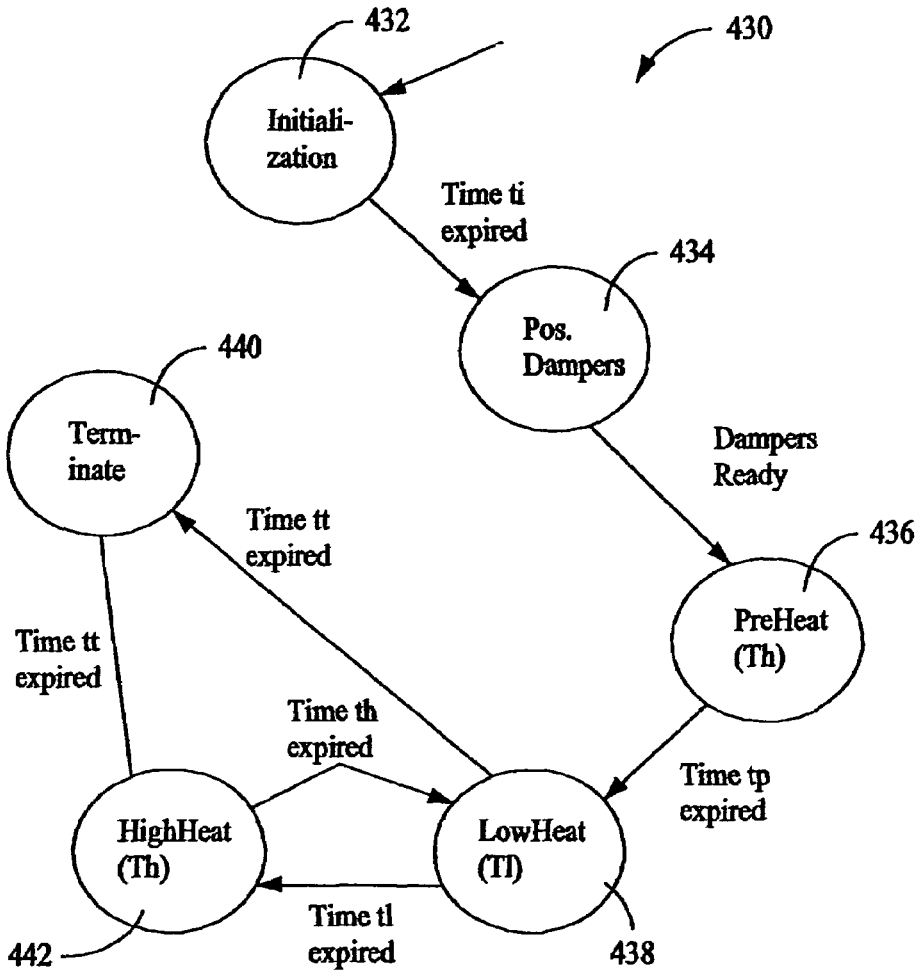

Initialization: Shuts off heater and turns on fan. This mode is implemented so that the customer interface LED that is wired in parallel with the fan will turn on as soon as the button is hit. Time ti is the initialization time and will typically be approximately one minute.

Pos. Dampers: This state shuts off the fan, sets the single damper open then closes the dual damper. It then turns the fan back on. This is done for power management PreHeat: This state regulates the pan temperature LowHeat HighHeat:

Terminate: This mode closes both dampers and shuts off the fan then returns to idle.

FIG. 13

Fresh Food Fan Behavior Diagram

Dispenser Behavior

NOTE: Setpoint Selected implies that the final selection has been made and that the selection has timed out.

Temperature Setting Interaction Diagrams

Quick Chill Interaction Diagram

Freshness Filter Reminder Interaction

Water Filter Reminder Interaction

Door Open Interaction Diagram

Sealed System Operational Algorithm

Dispenser Control Algorithm

Defrost Control State Diagram

Fan Speed Control

Notes: 1. The FF & Evaporator fans will shut off for the first five minutes that the door is open
2. Only one fan at a time can be on at a time during diagnostics.
3. Once the fan has been switched to high speed, it remains in that state until the operational cycle is complete.

Turbo Cycle Algorithm

Freshness Filter Reminder Algorithm

Water Filter Reminder Algorithm

522

SENSOR READ AND ROLLING AVERAGE ALGO:

Sensor Reading Algorithm

NOTE:

Fresh food average uses this algorithm twice to create a 2nd pole filter.

524

Note: Any Routine is allowed to read a data store
The command processor can read or write
any data store.
Dashed line indicates a path for initialization only State Diagram For Main Control Notes: Keyboard scan should return the last key hit and whether a key is presently being pressed.
Calls Stack Depth: Main->Diag->Keyboardscan->KeyPressed->Cccom Interrupt->Physical get character

ELECTRONICS ARCHITECTURE FOR A REFRIGERATOR QUICK CHILL AND QUICK THAW SYSTEM

CROSS REFERENCE TO RELATED APPLICATIONS

This application is a Divisional of U.S. patent application Ser. No. 09/742,545, filed Dec. 22, 2000, now U.S. Pat. No. 6,782,706 which is hereby incorporated by reference in its entirety.

BACKGROUND OF THE INVENTION

This invention relates generally to refrigeration devices, and more particularly, to control systems for refrigerators.

Current appliance revitalization efforts require electronic subsystems to operate different appliance platforms. For example, known household refrigerators include side-by-side single and double fresh food and freezer compartments, top mount, and bottom mount type refrigerators. A different control system is used in each refrigerator type. For example, a control system for a side-by-side refrigerator-controls the freezer temperature by controlling operation of a mullion damper. Such refrigerators may also include a fresh food fan and a variable or multi-speed fan-speed evaporator fan. Top mount refrigerators and bottom mount refrigerators are available with and without a mullion damper, the absence or presence of which affects the refrigerator controls. Therefore, control of the freezer temperature in top and bottom mount type refrigerators is not via control of a mullion damper. In addition, each type of refrigerator, i.e., side-by-side, top mount, and bottom mount, have different optimal control algorithms for most efficiently controlling refrigerator operation. Conventionally, different control systems have been employed to control different refrigerator platforms, which is undesirable from a manufacturing and service perspective. Accordingly, it would be desirable to provide a configurable control system to control various appliance platforms, such as side-by-side, top mount, and bottom mount refrigerators.

In addition, typical refrigerators require extended periods of time to cool food and beverages placed therein. For example, it typically takes about 4 hours to cool a six pack of soda to a refreshing temperature of about 45° F. or less. Beverages, such as soda, are often desired to be chilled in much less time than several hours. Thus, occasionally these items are placed in a freezer compartment for rapid cooling. If not closely monitored, the items will freeze and possibly break the packaging enclosing the item and creating a mess in the freezer compartment.

Numerous quick chill and super cool compartments located in refrigerator fresh food storage compartments and freezer compartments have been proposed to more rapidly chill and/or maintain food and beverage items at desired controlled temperatures for long term storage. See, for example, U.S. Pat. Nos. 3,747,361, 4,358,932, 4,368,622, and 4,732,009. These compartments, however, undesirably reduce refrigerator compartment space, are difficult to clean and service, and have not proven capable of efficiently chilling foods and beverages in a desirable time frame, such, as for example, one half hour or less to chill a six pack of soda to a refreshing temperature. Furthermore, food or beverage items placed in chill compartments located in the freezer compartment are susceptible to undesirable freezing if not promptly removed by the user.

Attempts have also been made to provide thawing compartments located in a refrigerator fresh food storage compartment to thaw frozen foods. See, for example, U.S. Pat. No. 4,385,075. However, known thawing compartments also undesirably reduce refrigerator compartment space and are vulnerable to spoilage of food due to excessive temperatures in the compartments.

Accordingly, it would further be desirable to provide a quick chill and thawing system for use in a fresh food storage compartment that rapidly chills food and beverage items without freezing them, that timely thaws frozen items within the refrigeration compartment at controlled temperature levels to avoid spoilage of food, and that occupies a reduced amount of space in the refrigerator compartment.

In order to provide a quick chill and thawing system it would be desirable to have an electronic controller that controls the operation of the refrigerator and controls the operations of the quick chill thaw compartments.

BRIEF SUMMARY OF THE INVENTION

In an exemplary embodiment, an electronic control system is provided for a refrigeration system including at least one refrigeration compartment and a quick chill/thaw pan located in the refrigeration compartment. The control system includes a main controller board, a temperature adjustment board, a dispenser board, and a serial communications bus. The main controller board is electrically connected to the temperature adjustment board and the dispenser board through the serial communications bus for controlling the temperature of the refrigeration compartment and the quick chill/thaw pan. The control system transmits commands over the serial communications bus to the dispenser board and the temperature adjustment board. The control system accepts a plurality of inputs including a refrigeration compartment temperature and a quick chill/thaw mode, determines a state of the refrigeration system, transmits commands over the serial communications bus, and executes a plurality of algorithms to control the refrigeration compartment and the quick chill/thaw pan over the serial communications bus.

The control system further includes a human machine interface board operatively coupled to the main controller board for user manipulation to select features of the refrigeration system, such as operation mode of the quick chill/thaw pan, to input user-selected operating setpoints such, as for example, a desired refrigeration compartment temperature, and to display actual temperature conditions and selected features of the refrigerator system.

The control system is configured to acquire status information from a variety of refrigeration components to make control decisions, included but not limited to status of a fresh food fan, a condenser fan, an evaporator fan, a quick chill/thaw pan fan, a compressor, a heater, an alarm, a cradle, various timers, and refrigeration compartment opened or closed door conditions. Based upon the status of the refrigeration system, the control system operates the refrigeration components according to a plurality of modes, e.g., an initialize mode, a prechill mode, a normal cooling mode, an abnormal cooling mode, a defrost mode, a diagnostic mode, and a dispense mode. A plurality of software algorithms are executed by the control system for the applicable modes, including but are not limited to a sealed system algorithm, a sensor-read-and-rolling-average algorithm, and a defrost algorithm.

The sealed system algorithm controls operation of a defrost heater, an evaporator fan, a compressor, and a condenser fan; a fresh food fan algorithm to control operation of a fresh food fan based on door opened and closed conditions. The sensor-read-and-rolling-average algorithm is used calibrate various thermistors and sensors and store associated data to accurately determine operating conditions of the refrigeration system. Additional control algorithms are executed to control the operation of resetting a water filter, dispensing water from the refrigeration system, dispensing crushed ice, dispensing cubed ice, activating and deactivating a light, and locking a dispenser keypad interface.

BRIEF DESCRIPTION OF THE DRAWINGS

FIG. 13 is a state diagram for a thaw algorithm;

DETAILED DESCRIPTION OF THE INVENTION

Figure 1:
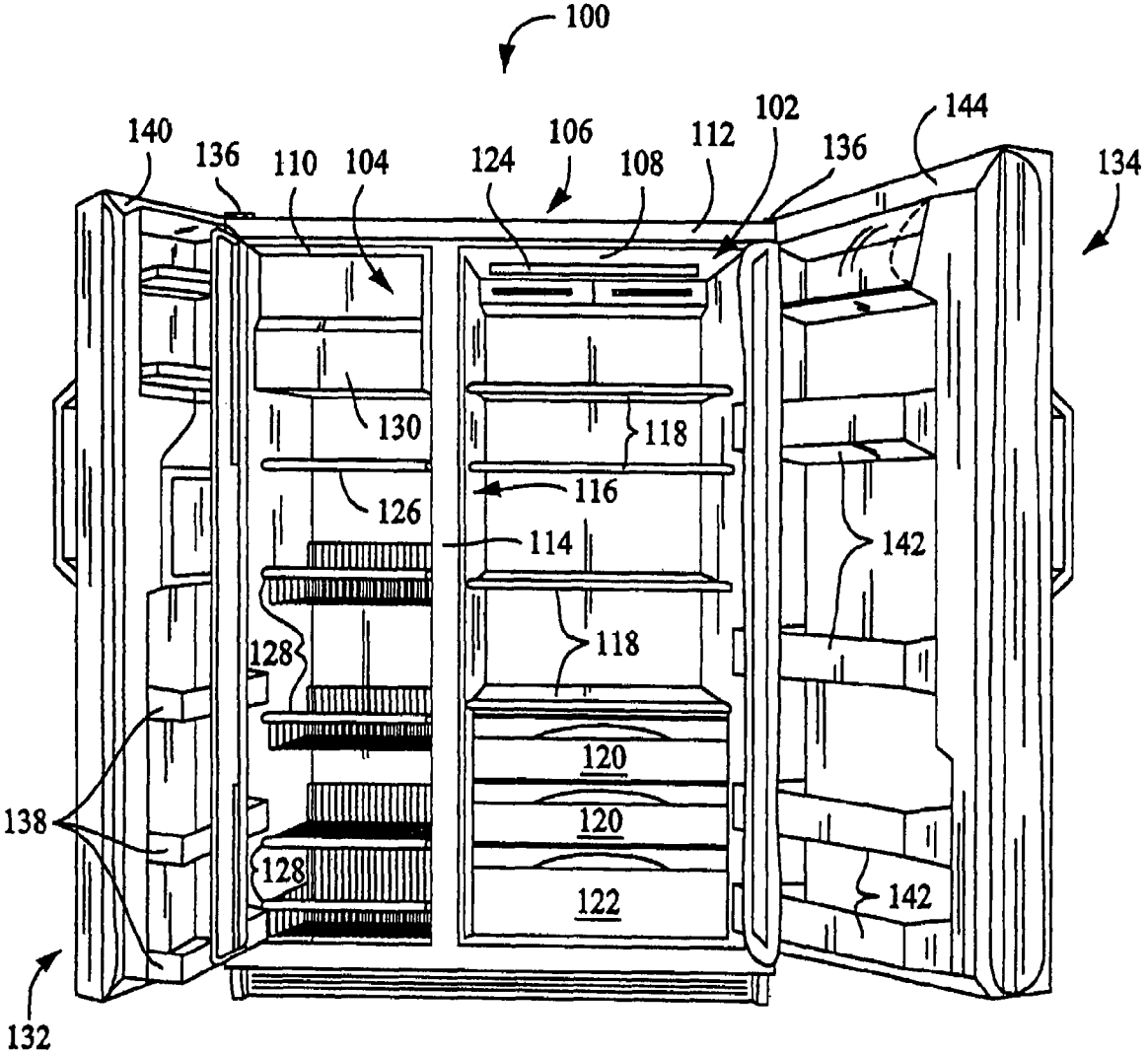
FIG. 1 is a perspective view of a refrigerator including a quick chill system.

FIG. 1 illustrates a side-by-side refrigerator 100 in which the present invention may be practiced. It is recognized, however, that the benefits of the present invention apply to other types of refrigerators. Consequently, the description set forth herein is for illustrative purposes only and is not intended to limit the invention in any aspect.

Refrigerator 100 includes a fresh food storage compartment 102 and freezer storage compartment 104. Freezer compartment 104 and fresh food compartment 102 are arranged side-by-side. A side-by-side refrigerator such as refrigerator 100 is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It is will be understood that in a refrigerator with separate mullion dividing a unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown in FIG. 1) described in detail below and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
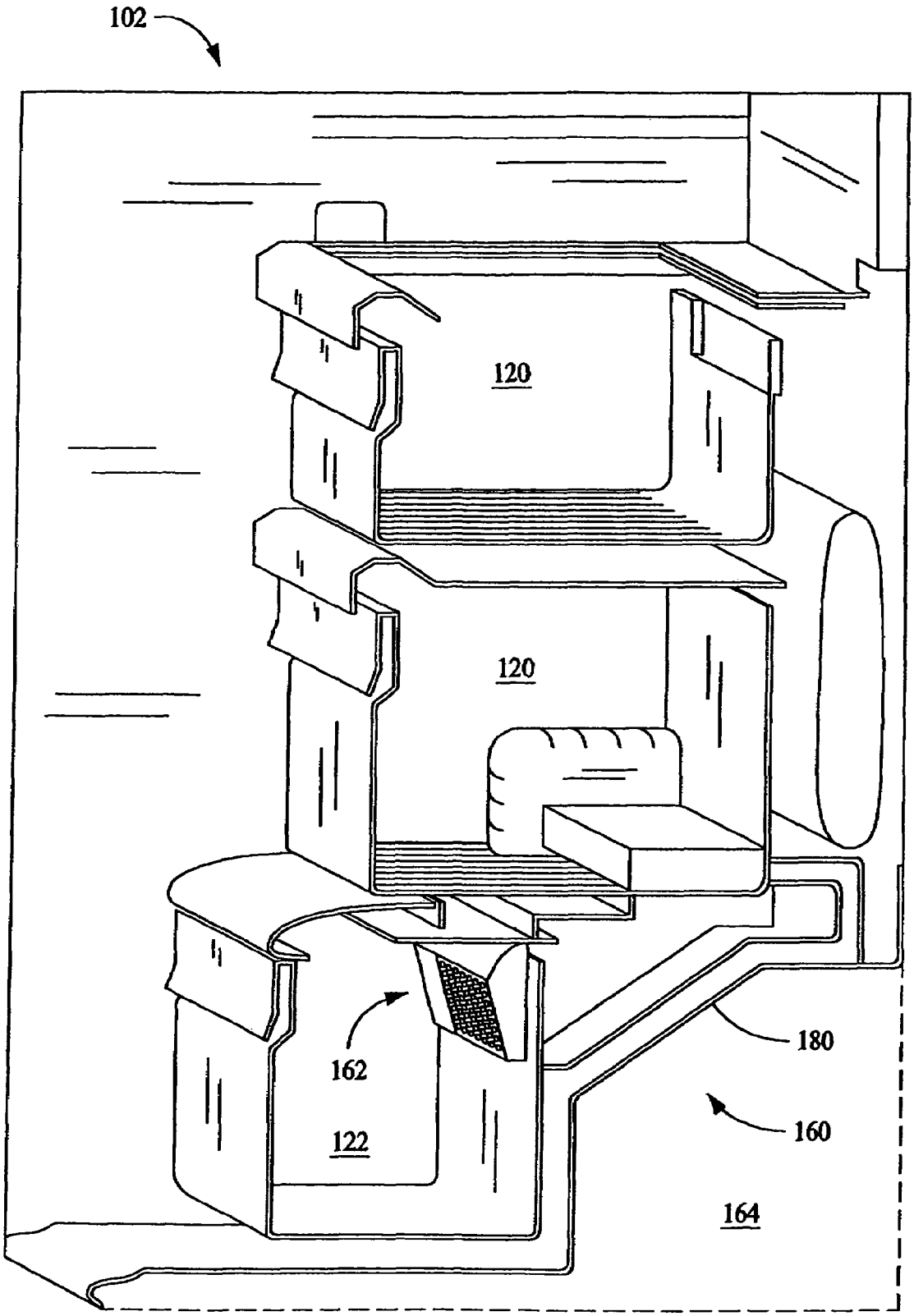
FIG. 2 is a partial perspective cut away view of a portion of FIG. 1.

FIG. 2 is a partial cutaway view of fresh food compartment 102 illustrating storage drawers 120 stacked upon one another and positioned above a quick chill and thaw system 160. Quick chill and thaw system 160 includes an air handler 162 and pan 122 located adjacent a pentagonal-shaped machinery compartment 164 (shown in phantom in FIG. 2) to minimize fresh food compartment space utilized by quick chill and thaw system 160. Storage drawers 120 are conventional slide-out drawers without internal temperature control. A temperature of storage drawers 120 is therefore substantially equal to an operating temperature of fresh food compartment 102. Quick chill and thaw pan 122 is positioned slightly forward of storage drawers 120 to accommodate machinery compartment 164, and air handler 162 selectively controls a temperature of air in pan 122 and circulates air within pan 122 to increase heat transfer to and from pan contents for timely thawing and rapid chilling, respectively, as described in detail below. When quick thaw and chill system 160 is inactivated, pan 122 reaches a steady state at a temperature substantially equal to the temperature of fresh food compartment 102, and pan 122 functions as a third storage drawer. In alternative embodiments, greater or fewer numbers of storage drawers 120 and quick chill and thaw systems 160, and other relative sizes of quick chill pans 122 and storage drawers 120 are employed.

In accordance with known refrigerators, machinery compartment 164 at least partially contains components for executing a vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments.

Figure 3:
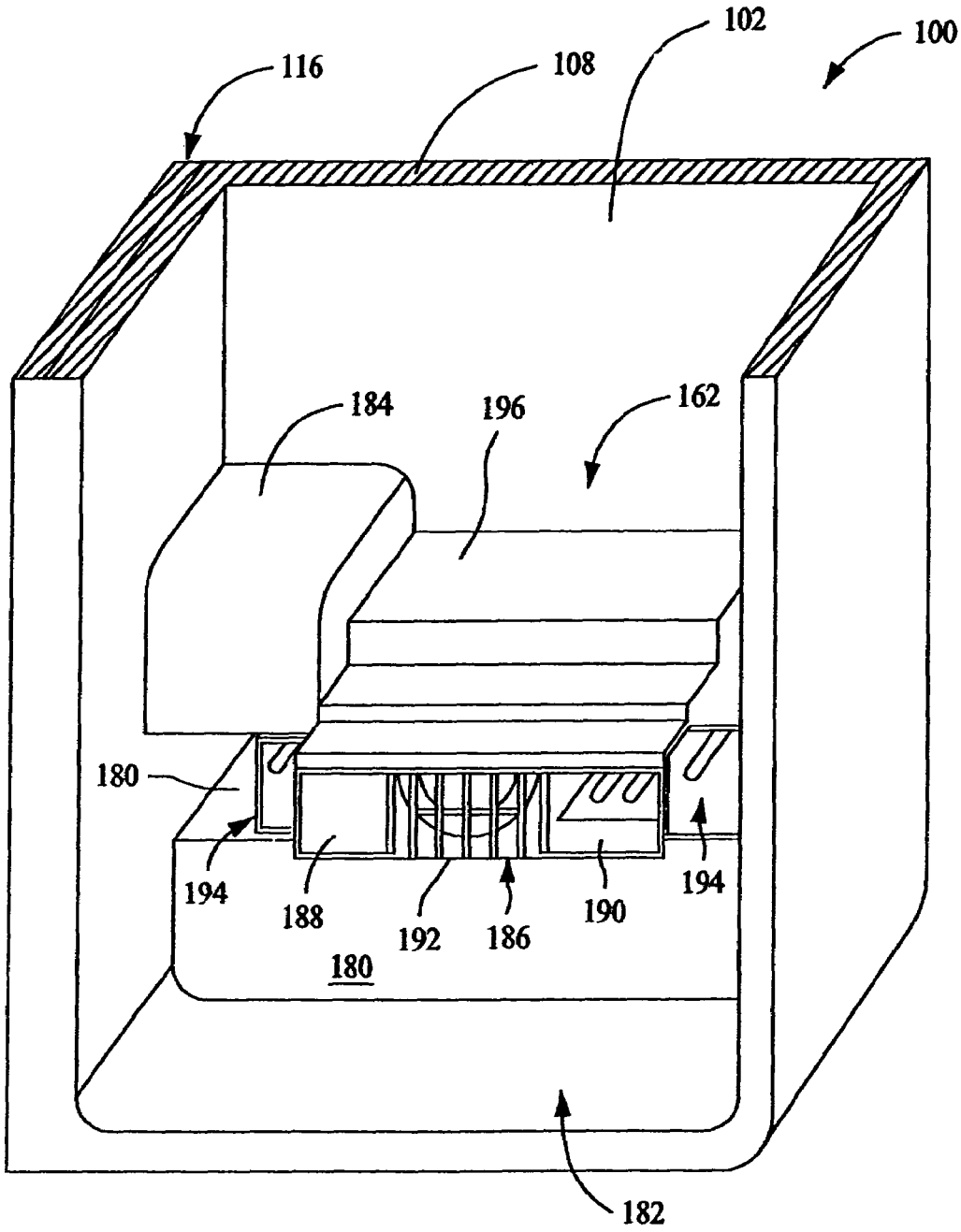
FIG. 3 is a partial perspective view of a portion of the refrigerator shown in FIG. 1 with an air handler mounted therein.

FIG. 3 is a partial perspective view of a portion of refrigerator 100 including air handler 162 mounted to fresh food compartment liner 108 above outside walls 180 of machinery compartment 164 (shown in FIG. 2) in a bottom portion 182 of fresh food compartment 102. Cold air is received from and returned to a freezer compartment bottom portion (not shown in FIG. 3) through an opening (not shown) in mullion center wall 116 and through supply and return ducts (not shown in FIG. 3) within supply duct cover 184. The supply and return ducts within supply duct cover 184 are in flow communication with an air handler supply duct 186, re-circulation duct 188 and a return duct 190 on either side of air handler supply duct 186 for producing forced air convection flow throughout fresh food compartment bottom portion 182 where quick chill and thaw pan 122 (shown in FIGS. 1 and 2) is located. Supply duct 186 is positioned for air discharge into pan 122 at a downward angle from above and behind pan 122 (see FIG. 2), and a vane 192 is positioned in air handler supply duct 186 for directing and distributing air evenly within quick chill and thaw pan 122. Light fixtures 194 are located on either side of air handler 162 for illuminating quick chill and thaw pan 122, and an air handler cover 196 protects internal components of air handler 162 and completes air flow paths through ducts 186, 188, and 190. In alternative embodiment, one or more integral light sources are formed into one or more of air handler ducts 186, 188, 190 in lieu of externally mounted light fixtures 194.

In an alternative embodiment, air handler 162 is adapted to discharge air at other locations in pan 122, so as, for example, to discharge air at an upward angle from below and behind quick chill and thaw pan 122, or from the center or sides of pan 122. In another embodiment, air handler 162 is directed toward a quick chill pan 122 located elsewhere than a bottom portion 182 of fresh food compartment 102, and thus converts, for example, a middle storage drawer into a quick chill and thaw compartment. Air handler 162 is substantially horizontally mounted in fresh food compartment 102, although in alternative embodiments, air handler 162 is substantially vertically mounted. In yet another alternative embodiment, more than one air handler 162 is utilized to chill the same or different quick chill and thaw pans 122 inside fresh food compartment 102. In still another alternative embodiment, air handler 162 is used in freezer compartment 104 (shown in FIG. 1) and circulates fresh food compartment air into a quick chill and thaw pan to keep contents in the pan from freezing.

Figure 4:
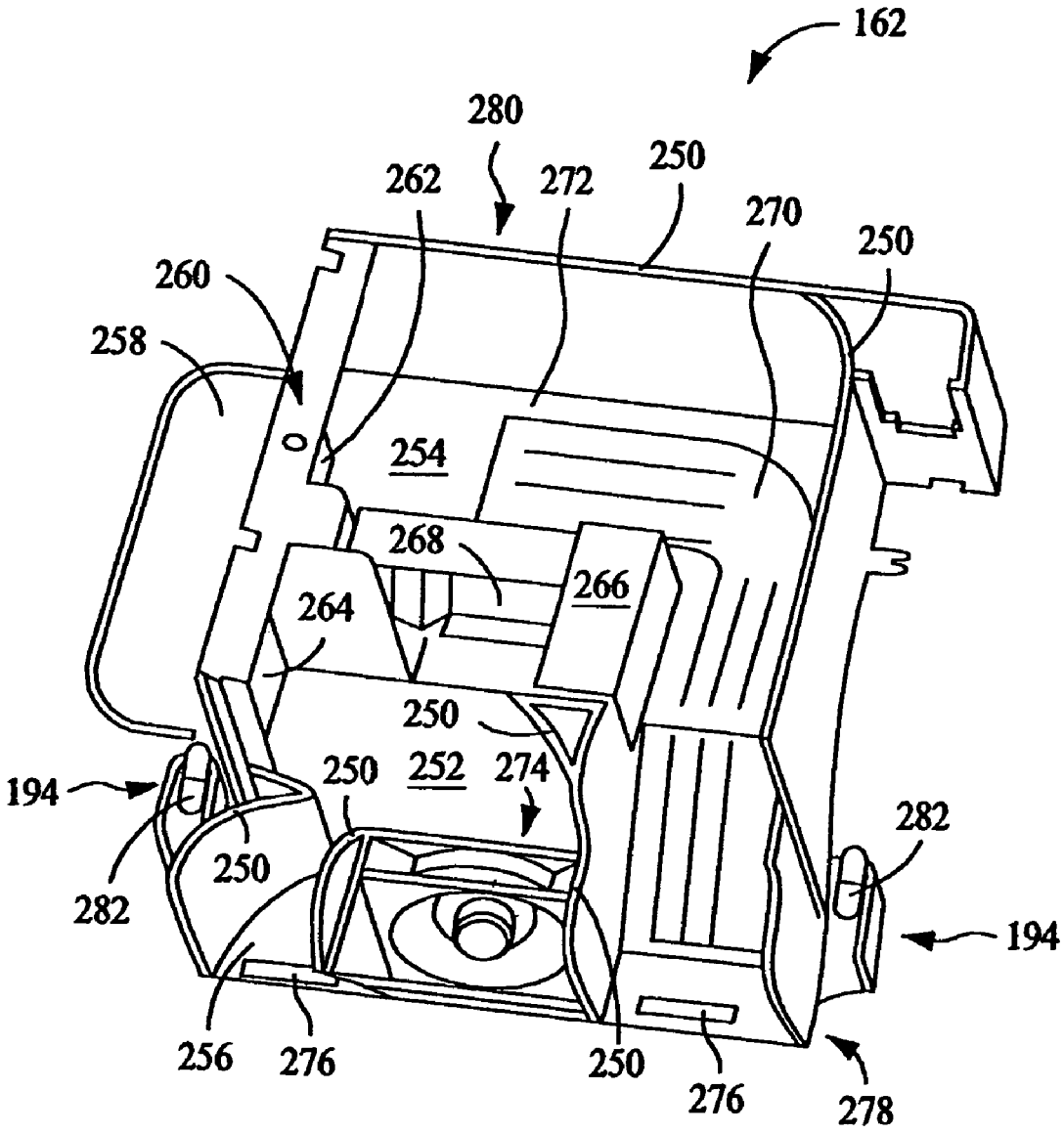
FIG. 4 is a partial perspective view of an air handler shown in FIG. 3.

FIG. 4 is a top perspective view of air handler 162 with air handler cover 196 (shown in FIG. 3) removed. A plurality of straight and curved partitions 250 define an air supply flow path 252, a return flow path 254, and a re-circulation flow path 256. A duct cavity member base 258 is situated adjacent a conventional dual damper element 260 for opening and closing access to return path 254 and supply path 252 through respective return and supply airflow ports 262, 264 respectively. A conventional single damper element 266 opens and closes access between return path 254 and supply path 252 through an airflow port 268, thereby selectively converting return path 254 to an additional re-circulation path as desired for air handler thaw and/or quick chill modes. A heater element 270 is attached to a bottom surface 272 of return path 254 for warming air in a quick thaw mode, and a fan 274 is provided in supply path 252 for drawing air from supply path 252 and forcing air into quick chill and thaw pan 122 (shown in FIG. 2) at a specified volumetric flow rate through vane 192 (shown in FIG. 3) located downstream from fan 274 for dispersing air entering quick chill and thaw pan 122. Temperature sensors 276 are located in flow communication with re-circulation path 256 and/or return path 254 and are operatively coupled to a microprocessor (not shown in FIG. 8) which is, in turn, operatively coupled to damper elements 260, 266, fan 274, and heater element 270 for temperature-responsive operation of air handler 162.

A forward portion 278 of air handler 162 is sloped downwardly from a substantially flat rear portion 280 to accommodate sloped outer wall 180 of machinery compartment 164 (shown in FIG. 2) and to discharge air into quick chill and thaw pan 122 at a slight downward angle. In one embodiment, light fixtures 194 and light sources 282, such as conventional light bulbs are located on opposite sides of air handler 162 for illuminating quick chill and thaw pan 122. In alternative embodiments, one or more light sources are located internal to air handler 162.

Air handler 162 is modular in construction, and once air handler cover 196 is removed, single damper element 266, dual damper element 260, fan 274, vane 192 (shown in FIG. 3), heater element 270 and light fixtures 194 are readily accessible for service and repair. Malfunctioning components may simply be pulled from air handler 162 and quickly replaced with functioning ones. In addition, the entire air handler unit may be removed from fresh food compartment 102 (shown in FIG. 2) and replaced with another unit with the same or different performance characteristics. In this aspect of the invention, an air handler 162 could be inserted into an existing refrigerator as a kit to convert an existing storage drawer or compartment to a quick chill and thaw system.

Figure 5:
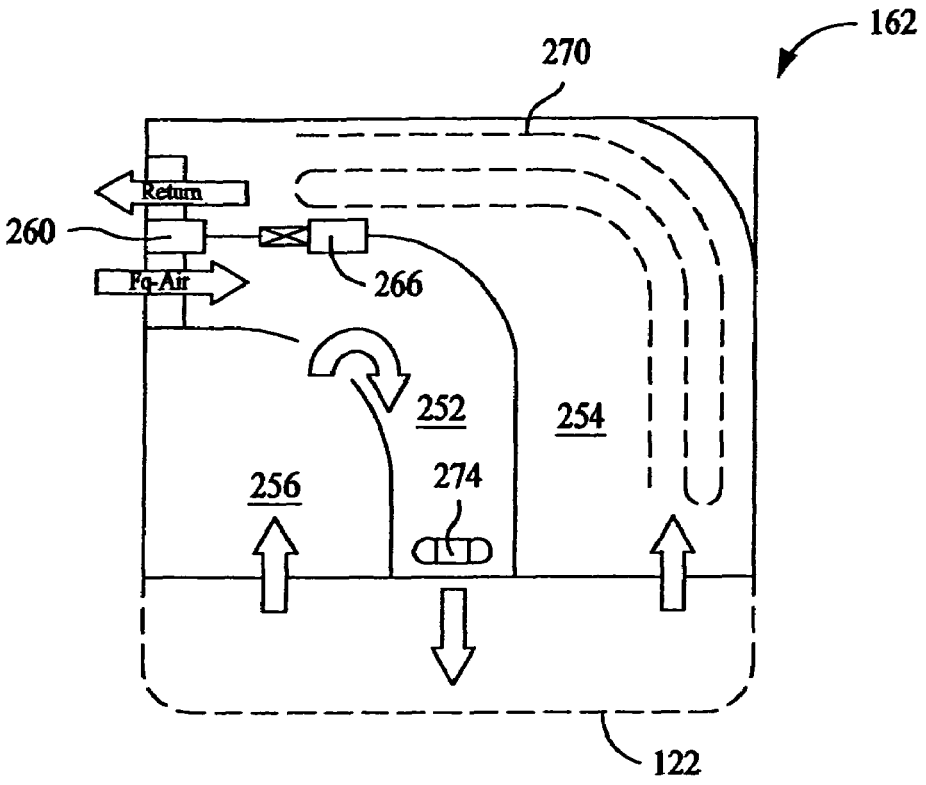
FIG. 5 is a functional schematic of the air handler shown in FIG. 4 in a quick chill mode.

FIG. 5 is a functional schematic of air handler 162 in a quick chill mode. Dual damper element 260 is open, allowing cold air from freezer compartment 104 (shown in FIG. 1) to be drawn through an opening (not shown) in mullion center wall 116 (shown in FIGS. 1 and 3) and to air handler air supply flow path 252 by fan 274. Fan 274 discharges air from air supply flow path 252 to pan 122 (shown in phantom in FIG. 5) through vane 192 (shown in FIG. 3) for circulation therein. A portion of circulating air in pan 122 returns to air handler 162 via recirculation flow path 256 and mixes with freezer air in air supply flow path 252 where it is again drawn through air supply flow path 252 into pan 122 via fan 274. Another portion of air circulating in pan 122 enters return flow path 254 and flows back into freezer compartment 104 through open dual damper element 260. Single damper element 266 is closed, thereby preventing airflow from return flow path 254 to supply flow path 252, and heater element 270 is de-energized.

In one embodiment, dampers 260 and 266 are selectively operated in a fully opened and fully closed position. In alternative embodiments, dampers 260 and 266 are controlled to partially open and close at intermediate positions between the respective fully open position and the fully closed position for finer adjustment of airflow conditions within pan 122 by increasing or decreasing amounts of freezer air and re-circulated air, respectively, in air handler supply flow path 252. Thus, air handler 162 may be operated in different modes, such as, for example, an energy saving mode, customized chill modes for specific food and beverage items, or a leftover cooling cycle to quickly chill meal leftovers or items at warm temperatures above room temperature. For example, in a leftover chill cycle, air handler may operate for a selected time period with damper 260 fully closed and damper 266 fully open, and then gradually closing damper 266 to reduce re-circulated air and opening damper 266 to introduce freezer compartment air as the leftovers cool, thereby avoiding undesirable temperature effects in freezer compartment 104 (shown in FIG. 1). In a further embodiment, heater element 270 is also energized to mitigate extreme temperature gradients and associated effects in refrigerator 100 (shown in FIG. 1) during leftover cooling cycles and to cool leftovers at a controlled rate with selected combinations of heated air, unheated air, and freezer air circulation in pan 122.

It is recognized, however, that because restricting the opening of damper 266 to an intermediate position limits the supply of freezer air to air handler 162, the resultant higher air temperature in pan 122 reduces chilling efficacy.

Dual damper element airflow ports 262, 264 (shown in FIG. 4), single damper element airflow port 268 (shown in FIG. 4), and flow paths 252, 254, and 256 are sized and selected to achieve an optimal air temperature and convection coefficient within pan 122 with an acceptable pressure drop between freezer compartment 104 (shown in FIG. 1) and pan 122. In an exemplary implementation of the invention, fresh food compartment 102 temperature is maintained at about 37° F., and freezer compartment 104 is maintained at about 0° F. While an initial temperature and surface area of an item to be warmed or cooled affects a resultant chill or defrost time of the item, these parameters are incapable of control by quick chill and thaw system 160 (shown in FIG. 2). Rather, air temperature and convention coefficient are predominantly controlled parameters of quick chill and thaw system 160 to chill or warm a given item to a target temperature in a properly sealed pan 122.

In a specific embodiment of the invention, it was empirically determined that an average air temperature of 22° F. coupled with a convection coefficient of 6 BTU/hr.ft.$^{2}$° F. is sufficient to cool a six pack of soda to a target temperature of 45° or lower in less than about 45 minutes with 99% confidence, and with a mean cooling time of about 25 minutes. Because convection coefficient is related to volumetric flow rate of fan 274, a volumetric flow rate can be determined and a fan motor selected to achieve the determined volumetric flow rate. In a specific embodiment, a convection coefficient of about 6 BTU/hr.ft.$^{2}$° F. corresponds to a volumetric flow rate of about 45 ft/min. Because a pressure drop between freezer compartment 104 (shown in FIG. 1) and quick chill and thaw pan 122 affects fan output and motor performance, an allowable pressure drop is determined from a fan motor performance pressure drop versus volumetric flow rate curve. In a specific embodiment, a 92 mm, 4.5 W DC electric motor is employed, and to deliver about 45 ft$^3$/min of air with this particular motor, a pressure drop of less than 0.11 inches $H_2O$ is required.

Investigation of the required mullion center wall 116 opening size to establish adequate flow communication between freezer compartment 104 (shown in FIG. 1) and air handler 162 was plotted against a resultant pressure drop in pan 122. Study of the plot revealed that a pressure drop of 0.11 inches $H_2O$ or less is achieved with a mullion center wall opening having an area of about 12 in$^2$. To achieve an average air temperature of about 22° F. at this pressure drop, it was empirically determined that minimum chill times are achieved with a 50% mix of re-circulated air from pan 122 and freezer compartment 104 air. It was then determined that a required re-circulation path opening area of about 5 $in^2$ achieves a 50% freezer air/re-circulated air mixture in supply path at the determined pressure drop of 0.11 inches $H_2O$. A study of pressure drop versus a percentage of the previously determined mullion wall opening in flow communication with freezer compartment 104, or supply air, revealed that a mullion center wall opening area division of 40% supply and 60% return satisfies the stated performance parameters.

Thus, convective flow in pan 122 produced by air handler 162 is capable of rapidly chilling a six pack of soda more than four times faster than a typical refrigerator. Other items, such as 2 liter bottles of soda, wine bottles, and other beverage containers, as well as food packages, may similarly be rapidly cooled in quick chill and thaw pan 122 in significantly less time than required by known refrigerators.

Figure 6:
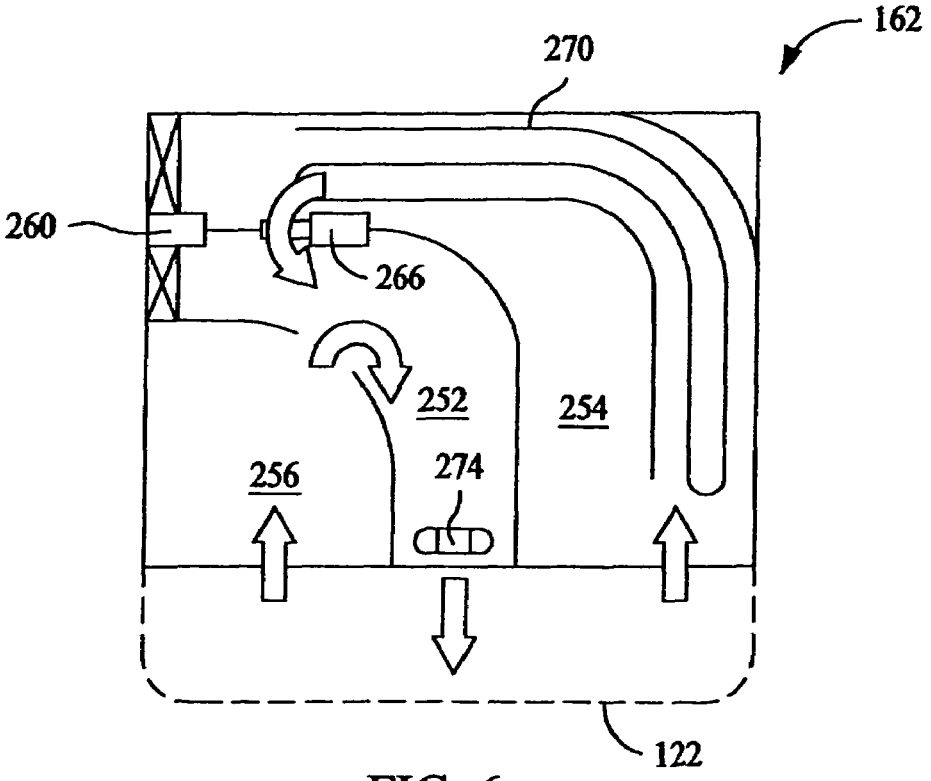
FIG. 6 is a functional schematic of the air handler shown in FIG. 4 in a quick thaw mode.

FIG. 6 is a functional schematic of air handler 162 shown in a thaw mode wherein dual damper element 260 is closed, heater element 270 is energized and single damper element 266 is open so that air flow in return path 254 is returned to supply path 252 and is drawn through supply path 252 into pan 122 by fan 274. Air also returns to supply path 252 from pan 122 via re-circulation path 256. Heater element 270, in one embodiment, is a foil-type heater element that is cycled on and off and controlled to achieve optimal temperatures for refrigerated thawing independent from a temperature of fresh food compartment 102. In other embodiments, other known heater elements are used in lieu of foil type heater element 270.

Heater element 270 is energized to heat air within air handler 162 to produce a controlled air temperature and velocity in pan 122 to defrost food and beverage items without exceeding a specified surface temperature of the item or items to be defrosted. That is, items are defrosted or thawed and held in a refrigerated state for storage until the item is retrieved for use. The user therefore need not monitor the thawing process at all.

In an exemplary embodiment, heater element 270 is energized to achieve an air temperature of about 40° to about 50°, and more specifically about 41° for a duration of a defrost cycle of selected length, such as, for example, a four hour cycle, an eight hour cycle, or a twelve hour cycle. In alternative embodiments, heater element 270 is used to cycle air temperature between two or more temperatures for the same or different time intervals for more rapid thawing while maintaining item surface temperature within acceptable limits. In further alternative embodiments, customized thaw modes are selectively executed for optimal thawing of specific food and beverage items placed in pan 122. In still further embodiments, heater element 270 is dynamically controlled in response to changing temperature conditions in pan 122 and air handler 162.

A combination rapid chilling and enhanced thawing air handler 162 is therefore provided that is capable of rapid chilling and defrosting in a single pan 122. Therefore, dual purpose air handler 162 and pan 122 provides a desirable combination of features while occupying a reduced amount of fresh food compartment space.

When air handler 162 is neither in quick chill mode nor thaw mode, it reverts to a steady state at a temperature equal to that of fresh food compartment 102. In a further embodiment, air handler 162 is utilized to maintain storage pan 122 at a selected temperature different from fresh food compartment 102. Dual damper element 260 and fan 274 are controlled to circulate freezer air to maintain pan 122 temperature below a temperature of fresh food compartment 102 as desired, and single damper element 266, heater element 270, and fan 274 are utilized to maintain pan 122 temperature above the temperature of fresh food compartment 102 as desired Thus, quick chill and thaw pan 122 may be used as a long term storage compartment maintained at an approximately steady state despite fluctuation of temperature in fresh food compartment 102.

Figure 7:
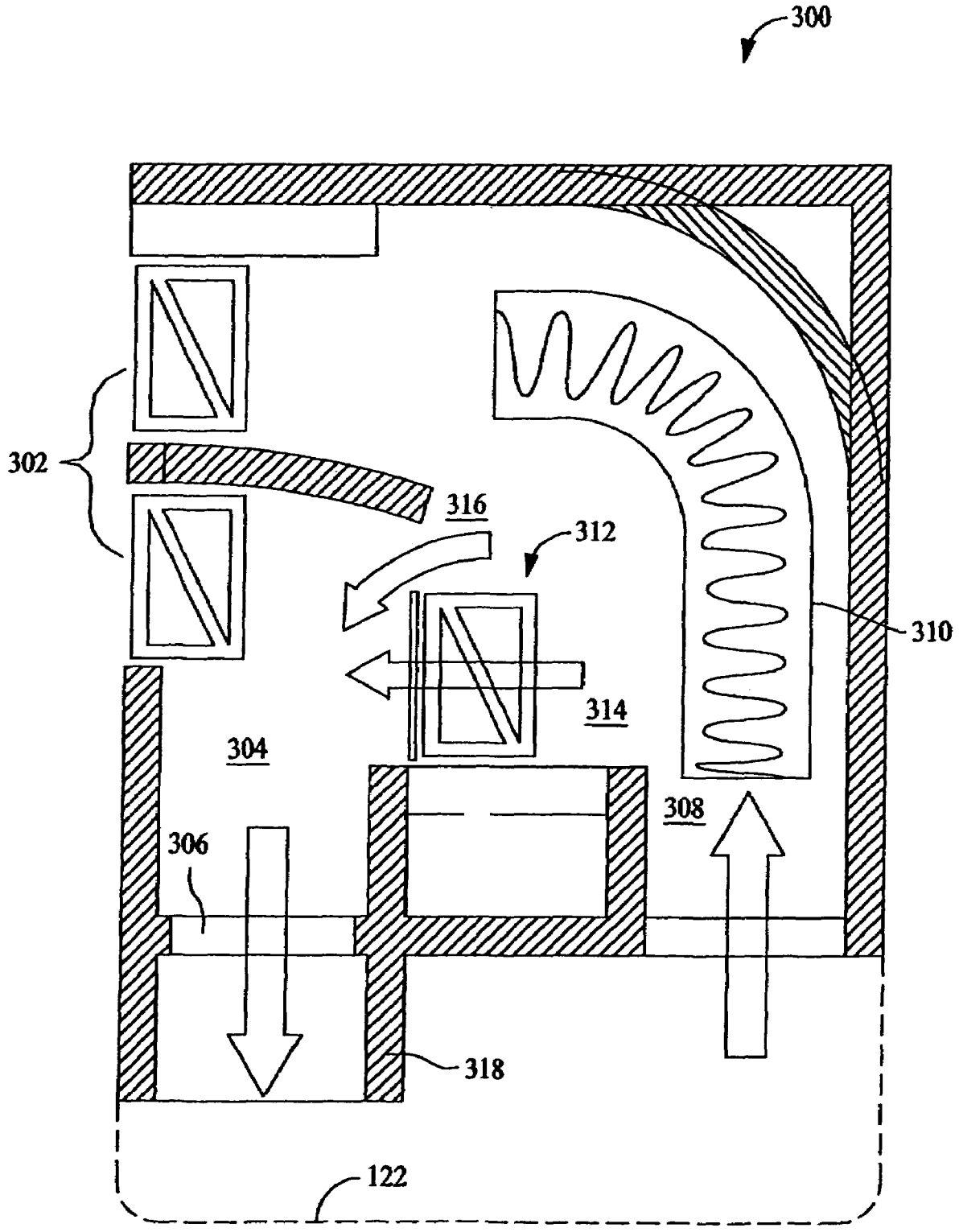
FIG. 7 is a functional schematic of another embodiment of an air handler in a quick thaw mode.

FIG. 7 is a functional schematic of another embodiment of an air handler 300 including a dual damper element 302 in flow communication with freezer compartment 104, an air supply path 304 including a fan 306, a return path 308 including a heater element 310, a single damper element 312 opening and closing access to a primary recirculation path 314, and a secondary re-circulation path 316 adjacent single damper element 312. Air is discharged from a side of air handler 300 as opposed to air handler 162 described above including a centered supply path 27 (see FIGS. 4-6), thereby forming a different, and at least somewhat unbalanced, airflow pattern in pan 122 relative to air handler 162 described above. Air handler 300 also includes a plenum extension 318 for improved air distribution within pan 122. Air handler 300 is illustrated in a quick thaw mode, but is operable in a quick chill mode by opening dual damper element 302. Notably, in comparison to air handler 162 (see FIGS. 5 and 6), return path 308 is the source of recirculation air, as opposed to air handler 162 wherein air is re-circulated from the pan via a re-circulation path 256 separate from return path 254.

handler 162 (see FIGS. 5 and 6), return path 308 is the source of re-circulation air, as opposed to air handler 162 wherein air is recirculated from the pan via a re-circulation path 256 separate from return path 254.

Figure 8:
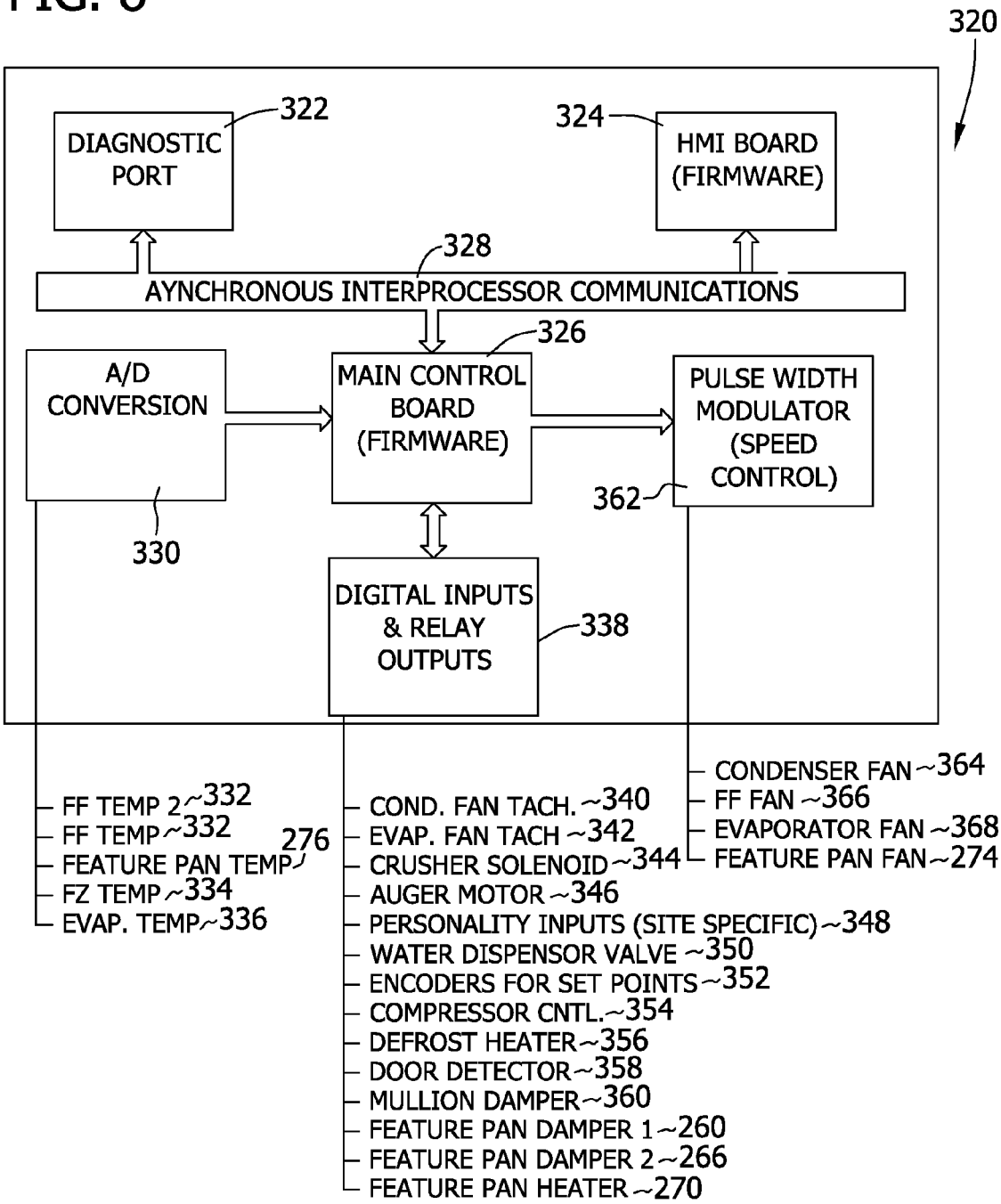
FIG. 8 is a block diagram of a refrigerator controller in accordance with one embodiment of the present invention.

FIG. 8 illustrates an exemplary controller 320 in accordance with one embodiment of the present invention. Controller 320 can be used, for example, in refrigerators, freezers and combinations thereof, such as, for example side-by-side refrigerator 100 (shown in FIG. 1). A controller human machine interface (HMI) (not shown in FIG. 8) may vary depending upon refrigerator specifics. Exemplary variations of the HMI are described below in detail.

Controller 320 includes a diagnostic port 322 and a human machine interface (HMI) board 324 coupled to a main control board 326 by an asynchronous interprocessor communications bus 328. An analog to digital converter ("A/D converter") 330 is coupled to main control board 326. A/D converter 330 converts analog signals from a plurality of sensors including one or more fresh food compartment temperature sensors 332, feature pan (i.e., pan 122 described above in relation to FIGS. 1,2,6) temperature sensors 276 (shown in FIG. 4), freezer temperature sensors 334, external temperature sensors (not shown in FIG. 8), and evaporator temperature sensors 336 into digital signals for processing by main control board 326.

In an alternative embodiment (not shown), A/D converter 320 digitizes other input functions (not shown), such as a power supply current and voltage, brownout detection, compressor cycle adjustment, analog time and delay inputs (both use based and sensor based) where the analog input is coupled to an auxiliary device (e.g., clock or finger pressure activated switch), analog pressure sensing of the compressor sealed system for diagnostics and power/energy optimization. Further input functions include external communication via IR detectors or sound detectors, HMI display dimming based on ambient light, adjustment of the refrigerator to react to food loading and changing the air flow/pressure accordingly to ensure food load cooling or heating as desired, and altitude adjustment to ensure even food load cooling and enhance pull-down rate of various altitudes by changing fan speed and varying air flow.

Digital input and relay outputs 338 correspond to, but are not limited to, a condenser fan speed 340, an evaporator fan speed 342, a crusher solenoid 344, an auger motor 346, personality inputs 348, a water dispenser valve 350, encoders coupled to a pulse width modulator 362 for controlling the operating speed of a condenser fan 364, a fresh food compartment fan 366, an evaporator fan 368, and a quick chill system feature pan fan 274 (shown in FIGS. 4-6).

Figure 9A:
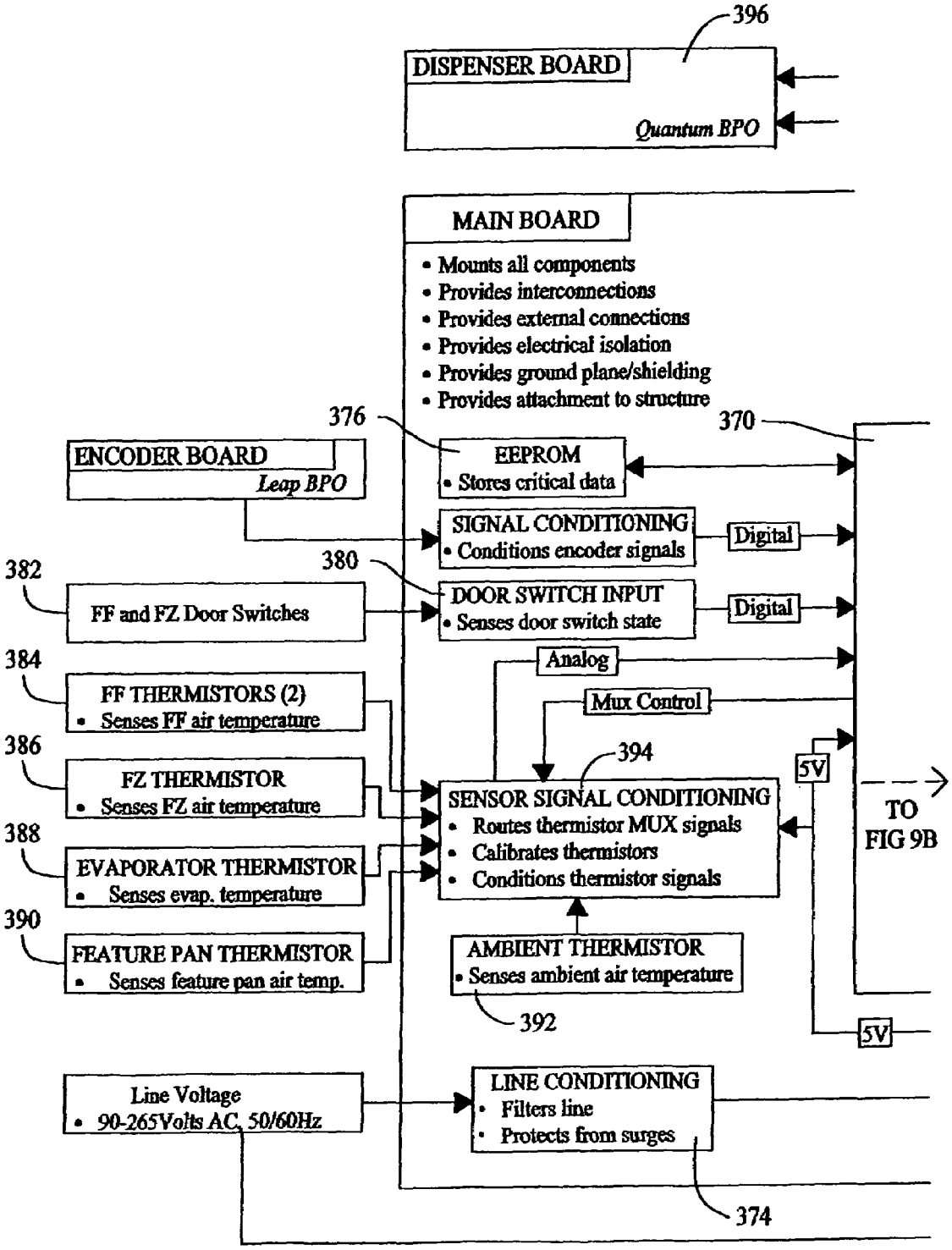
FIG. 9A is a first portion of a block diagram of the main control board shown in FIG. 8.
Figure 9B:
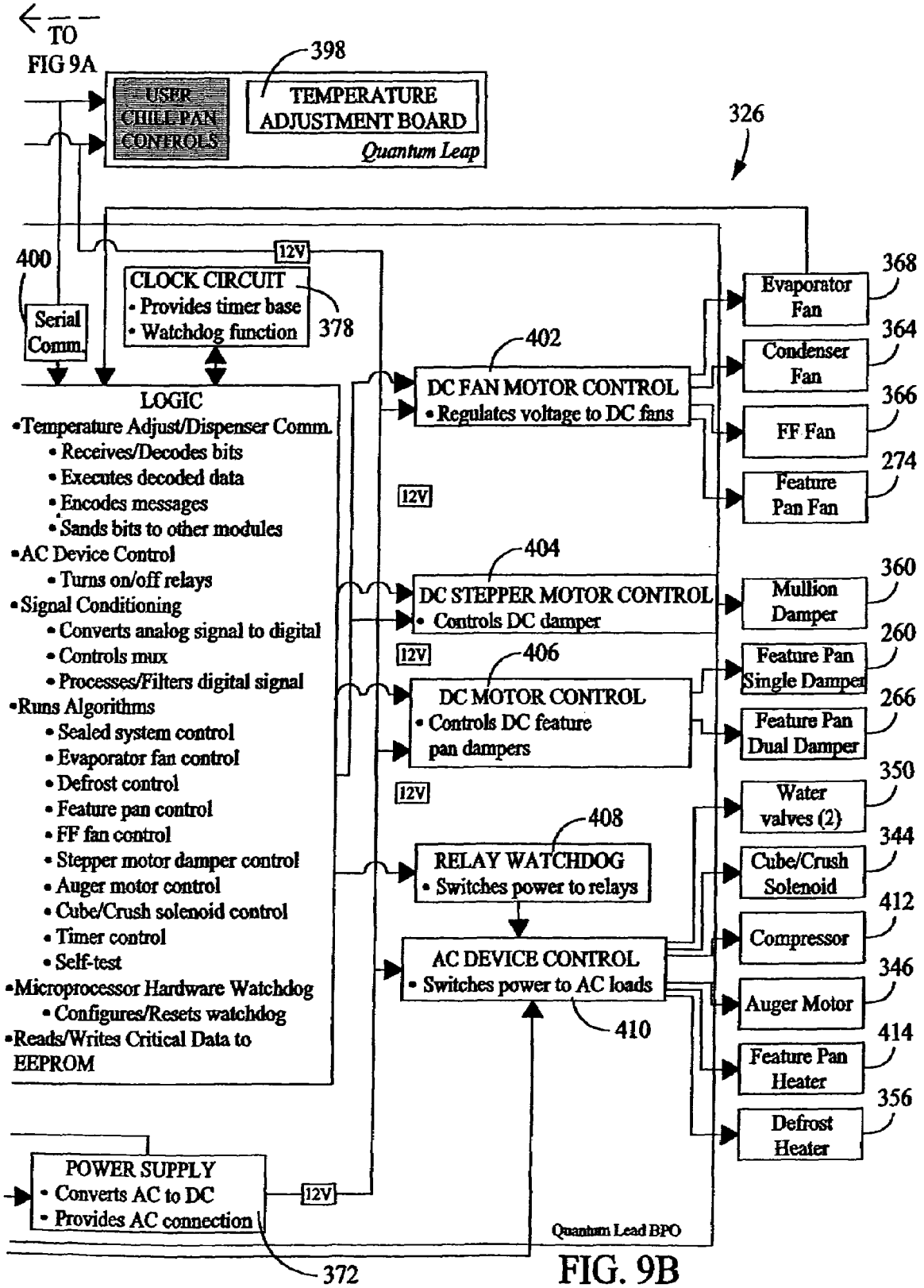
FIG. 9B is a second portion of a block diagram of the main control board shown in FIG. 8.
Figure 10:
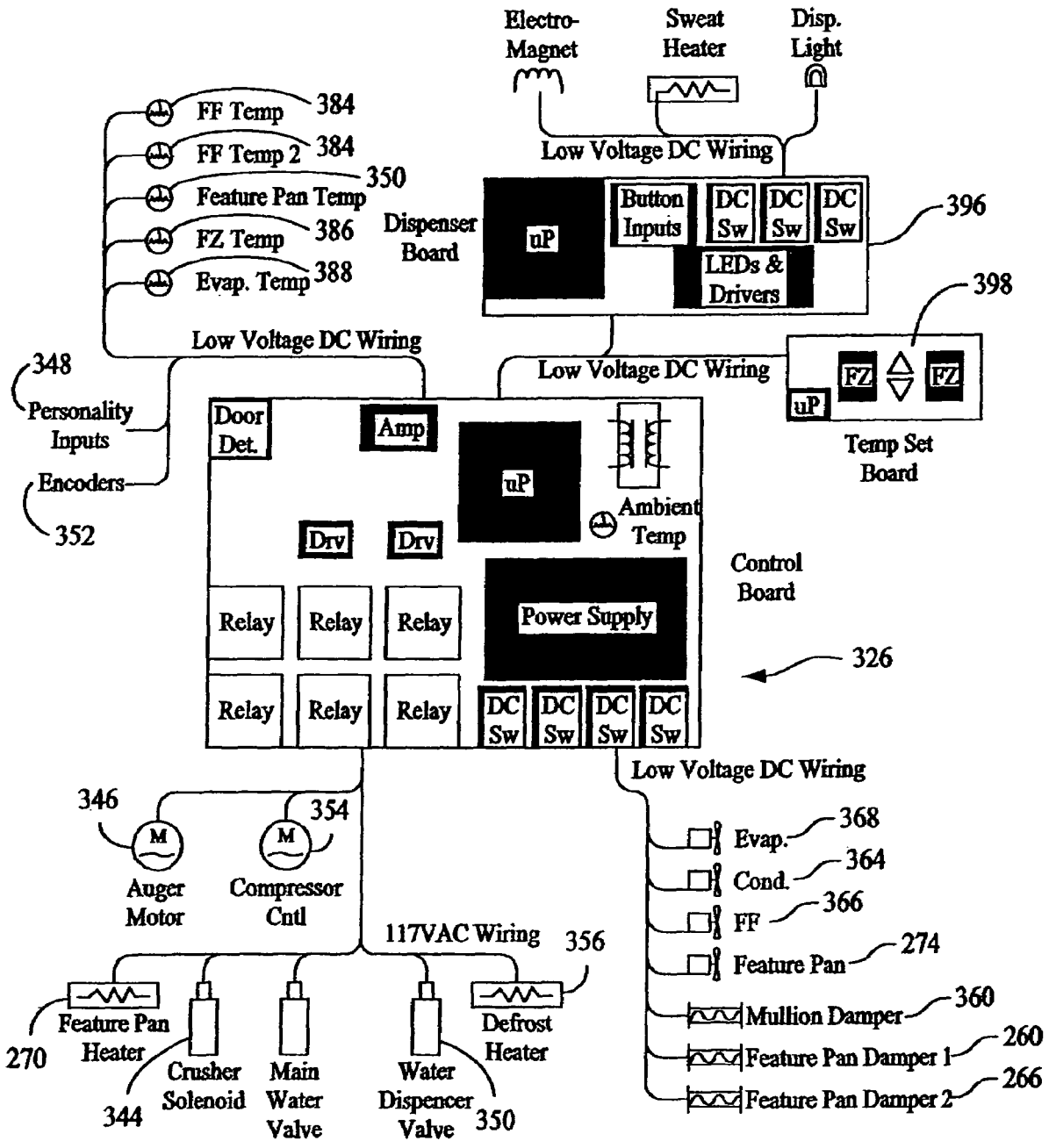
FIG. 10 is an interface diagram for the main control board shown in FIG. 8.

FIGS. 9A, 9B, and 10 are more detailed block diagrams of main control board 326. As shown in FIGS. 9A, 9B, and 10, main control board 326 includes a processor 370. Processor 370 performs temperature adjustments/dispenser communication, AC device control, signal conditioning, microprocessor hardware watchdog, and EEPROM read/write functions. In addition, processor 370 executes many control algorithms including sealed system control, evaporator fan control, defrost control, feature pan control, fresh food fan control, stepper motor damper control, water valve control, auger motor control, cube/crush solenoid control, timer control, and self-test operations.

Processor 370 is coupled to a power supply 372 which receives an AC power signal from a line conditioning unit 374. Line conditioning unit 374 filters a line voltage which is, for example, a 90-265 Volts AC, 50/60 Hz signal. Processor 370 also is coupled to an Electrically Erasable Programmable Read Only Memory (EEPROM) 376 and a clock circuit 378.

A door switch input sensor 380 is coupled to fresh food and freezer door switches 382, and senses a door switch state. A signal is supplied from door switch input sensor 380 to processor 370, in digital form, indicative of the door switch state. Fresh food thermistors 384, a freezer thermistor 386, at least one evaporator thermistor 388, a feature pan thermistor 390, and an ambient thermistor 392 are coupled to processor 370 via a sensor signal conditioner 394. Conditioner 394 receives a multiplex control signal from processor 370 and provides analog signals to processor 370 representative of the respective sensed temperatures. Processor 370 also is coupled to a dispenser board 396 and a temperature adjustment board 398 via a serial communications link 400. Conditioner 394 also calibrates the above-described thermistors 384, 386, 388, 390, and 392.

Processor 370 provides control outputs to a DC fan motor control 402, a DC stepper motor control 404, a DC motor control 406, and a relay watchdog 408. Watchdog 408 is coupled to an AC device controller 410 that provides power to AC loads, such as to water valve 350, cube/crush solenoid 344, a compressor 412, auger motor 346, a feature pan heater 414, and defrost heater 356. DC fan motor control 402 is coupled to evaporator fan 368, condenser fan 364, fresh food fan 366, and feature pan fan 274. DC stepper motor control 404 is coupled to mullion damper 360, and DC motor control 406 is coupled to feature pan dampers 260, 266.

Processor logic uses the following inputs to make control decisions:

- Freezer Door State—Light Switch Detection Using Optoisolators,
- Fresh Food Door State—Light Switch Detection Using Optoisolators,
- Freezer Compartment Temperature—Thermistor,
- Evaporator Temperature—Thermistor,
- Upper Compartment Temperature in FF—Thermistor,
- Lower Compartment Temperature in FF—Thermistor,
- Zone (Feature Pan) Compartment Temperature—Thermistor,
- Compressor On Time,
- Time to Complete a Defrost,
- User Desired Set Points via Electronic Keyboard and Display or Encoders,
- User Dispenser Keys,
- Cup Switch on Dispenser, and
- Data Communications Inputs.

The electronic controls activate the following loads to control the refrigerator:

- Multi-speed or variable speed (via PWM) fresh food fan,
- Multi-speed (via PWM) evaporator fan,
- Multi-speed (via PWM) condenser fan,
- Single-speed zone (Special Pan) fan,
- Compressor Relay,
- Defrost Relay,
- Auger motor Relay,
- Water valve Relay,
- Crusher solenoid Relay,
- Drip pan heater Relay,
- Zonal (Special Pan) heater Relay,
- Mullion Damper Stepper Motor IC,
- Two DC Zonal (Special Pan) Damper H-Bridges, and
- Data Communications Outputs.

Appendix Tables 1 through 11 define the input and output characteristics of one specific implementation of control board 326. Specifically, Table 1 defines the thermistors and personality pin input/output for connector J1, Table 2 defines the fan control input/output for connector J2, Table 3 defines the encoders and mullion damper input/output for connector J3, Table 4 defines communications input/output for connector J4, Table 5 defines the pan damper control input/output for connector J5, Table 6 defines the flash programming input/output for connector J6, Table 7 defines the AC load input/output for connector J7, Table 8 defines the compressor run input/output for connector J8, Table 9 defines the defrost input/output for connector J9, Table 10 defines the line input input/output for connector J11, and Table 11 defines the pan heater input/output for connector J12.

Quick Chill/Thaw

Figure 11:
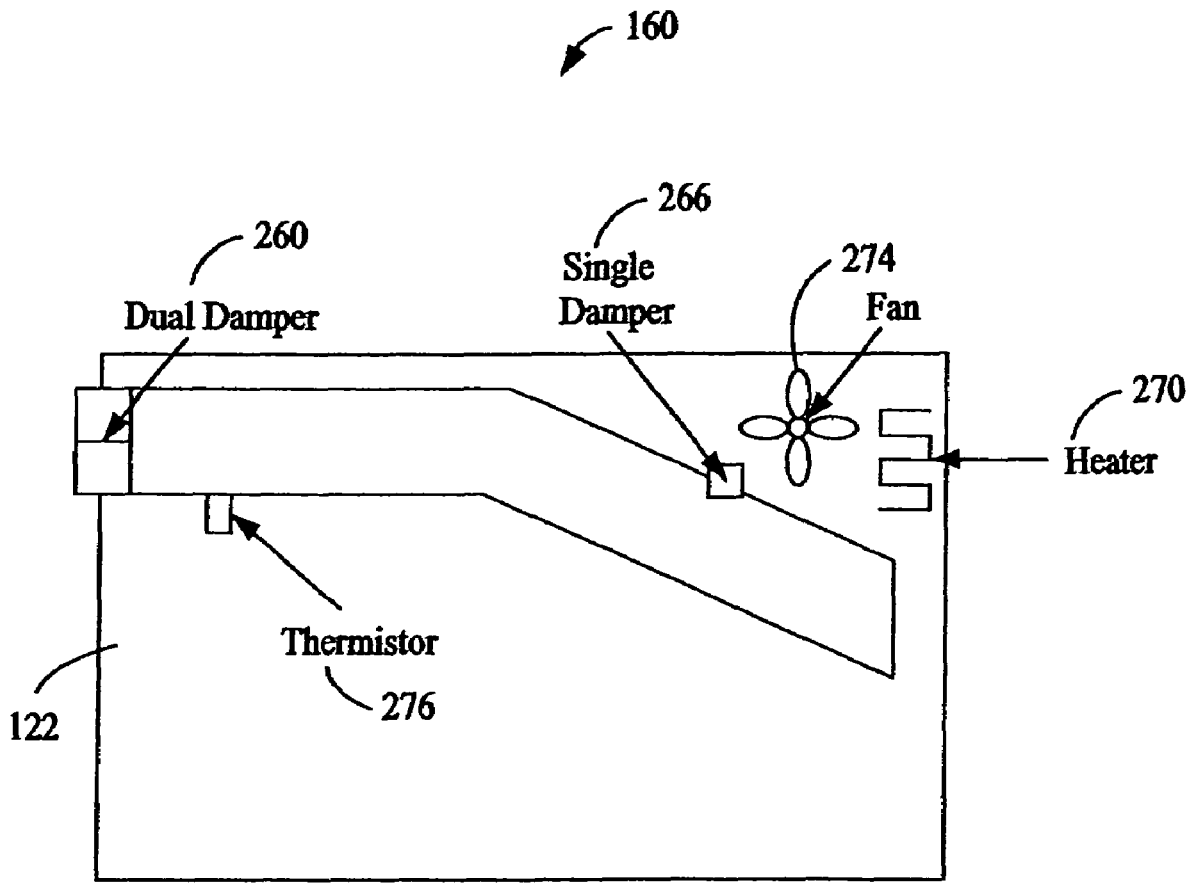
FIG. 11 is a schematic illustration of a chill/thaw section of the refrigerator.

Referring now to FIG. 11, in an exemplary embodiment quick chill and thaw pan 160 (also shown and described above) includes four primary devices to be controlled, namely air handler dual damper 260, single damper 266, fan 274 and heater 270. Action of these devices is determined by time, a thermistor (temperature) input 276, and user input. From a user perspective, one thaw mode or one chill mode may be selected for pan 122 at any given time. In an exemplary embodiment, three thaw modes are available and three chill modes are selectively available and executable by controller 320 (shown in FIG. 8). In addition, quick chill and thaw pan 122 may be maintained at a selected temperature, or temperature zone, for long term storage of food and beverage item. In other words, quick chill and thaw pan 122, at any given time, may be running in one of several different manners or modes (e.g., Chill 1, Chill 2, Chill 3, Thaw 1, Thaw 2, Thaw 3, Zone 1, Zone 2, Zone 3 or off). Other modes or fewer modes may be available to the user in alternative embodiments with differently configured human machine interface boards 324 (shown in FIG. 8) that determine user options in selecting quick chill and thaw features.

As noted above with respect to FIG. 5, in the chill mode, air handler dual damper 260 is open, single damper 266 is closed, heater 270 is turned off, and fan 274 (shown in FIGS. 4-6) is on. When a quick chill function is activated, this configuration is sustained for a predetermined period of time determined by user selection of a chill setting, e.g., Chill 1, Chill 2, or Chill 3. Each chill setting operates air handler for a different time period for varied chilling performance. In a further embodiment, a fail safe condition is placed on chilling operation by imposing a lower temperature limit that causes dual damper 260 to be automatically closed when the lower limit is reached. In a further alternative embodiment, fan 274 speed is slowed and/or stopped as the lower temperature limit is approached.

In temperature zone mode, dampers 260, 266, heater 270 and fan 274 are dynamically adjusted to hold pan 122 at a fixed temperature that is different the fresh food compartment 102 or freezer compartment 104 setpoints. For example, when pan temperature is too warm, dual damper 260 is opened, single damper 266 is opened, and fan 274 is turned on. In further embodiments, a speed of fan 274 is varied and the fan is switched on and off to vary a chill rate in pan 122. As a further example, when pan temperature is too cold, dual damper 260 is closed, single damper 266 is opened, heater 270 is turned on, and fan 274 is also turned on. In a further embodiment, fan 270 is turned off and energy dissipated by fan 274 is used to heat pan 122.

In thaw mode, as explained above with respect to FIG. 6, dual damper 260 is closed, single damper 266 is opened, fan 274 is turned on, and heater 270 is controlled to a specific temperature using thermistor 276 (shown in FIG. 4) as a feedback component. This topology allows different heating profiles to be applied to different package sizes to be thawed. The Thaw 1, Thaw 2, or Thaw 3 user setting determines the package size selection.

Heater 270 is controlled by a solid state relay located off of main control board 326 (shown in FIGS. 8-9). Dampers 260, 266 are reversible DC motors controlled directly by main board 326. Thermistor 276 is a temperature measurement device read by main control board 326. Fan 274 is a low wattage DC fan controlled directly by main control board 326.

Figure 12:
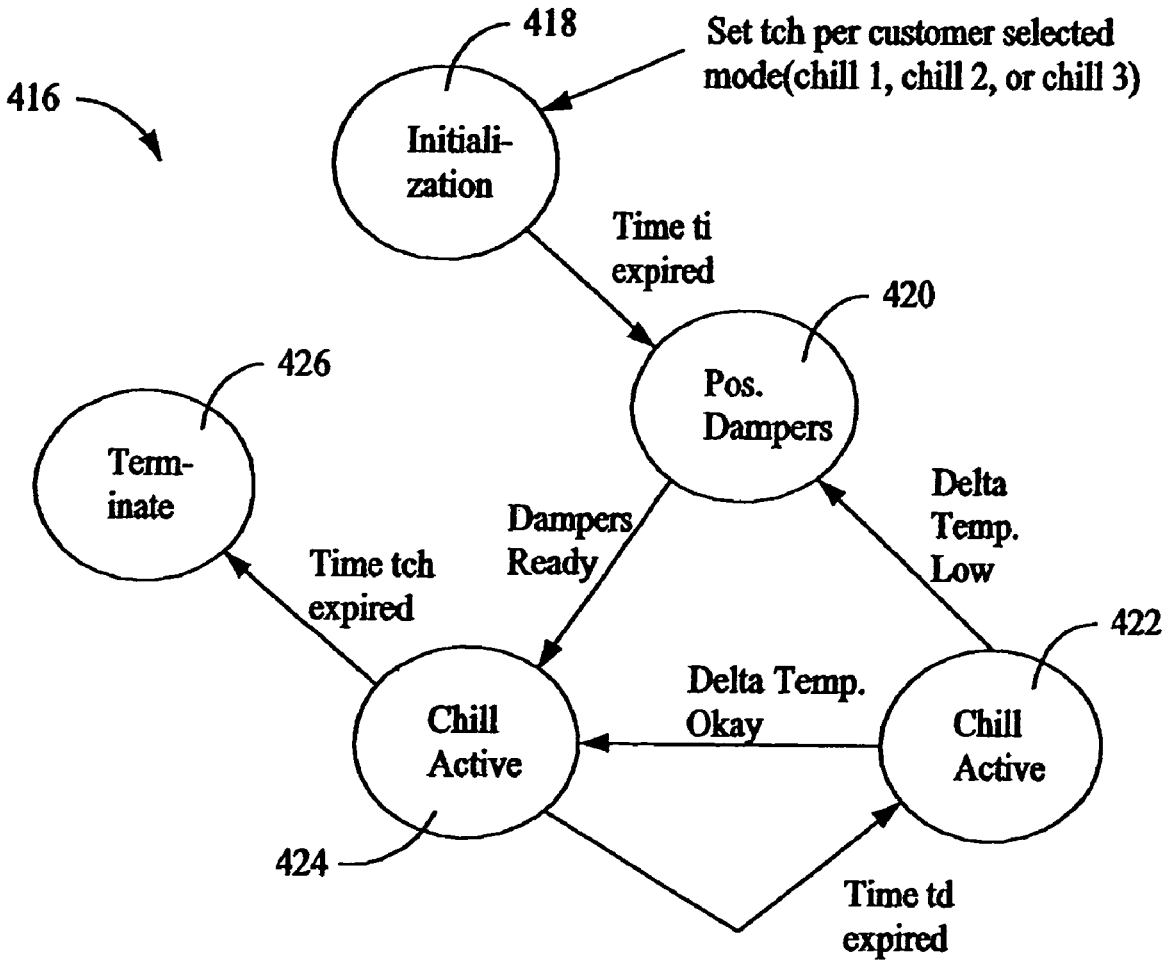
FIG. 12 is a state diagram for a chill algorithm.

Referring to FIG. 12, a chill state diagram 416 is illustrated for quick chill and thaw system 160 (shown in FIGS. 2-6). After a user selects an available chill mode, e.g., Chill 1, Chill 2, or Chill 3, a quick chill mode is implemented so that air handler fan 274 shown in FIGS. 4-6) is turned on. Fan 274 is wired in parallel with an interface LED (not shown) that is activated when a quick chill mode is selected to visually display activation of quick chill mode. Once a chill mode is selected, an Initialization state 418 is entered, where heater 270 (shown in FIGS. 4-6) is turned off (assuming heater 270 was activated) and fan 274 is turned on for an initialization time ti that in an exemplary embodiment is approximately one minute.

Once initialization time ti has expired, a Position Damper state 420 is entered. Specifically, in the Position Damper state 420, fan 274 is turned off, dual damper 260 is opened, and single damper 266 is closed. Fan 274 is turned off while positioning dampers 260 and 266 for power management, and fan 274 is turned on when dampers 260, 266 are in position.

Once dampers 260 and 266 are positioned, a Chill Active state 422 is entered and quick chill mode is maintained until a chill time ("tch") expires. The particular time value of tch is dependent on the chill mode selected by the user.

When Chill Active state 422 is entered, another timer is set for a delta time ("td") that is less than the chill time tch. When time td expires, air handler thermistors 276 (shown in FIG. 4) are read to determine a temperature difference between air handler re-circulation path 256 and return path 254. If the temperature difference is unacceptably high or low, the Position Dampers state 420 is re-entered to change or adjust air handler dampers 260, 266 and consequently airflow in pan 122 to bring the temperature difference to an acceptable value. If the temperature difference is acceptable, Chill Active state 424 is maintained.

After time tch expires, operation advances to a Terminate state 426. In the Terminate state, both dampers 260 and 266 are closed, fan 274 is turned off, and further operation is suspended.

Referring to FIG. 13, a thaw state diagram 430 for quick chill and thaw system 160 is illustrated. Specifically, in an initialization state 432, heater 270 shuts off, and fan 274 turns on for an initialization time ti that in an exemplary embodiment is approximately one minute. Thaw mode is activated so that fan 274 is turned on when a thaw mode is selected. Fan 274 is wired in parallel with an interface LED (not shown) that is activated when a thaw mode is selected by a user to visually display activation of quick chill mode.

Once initialization time ti has expired, a Position Dampers state 434 is entered. In the Position Dampers state 434, fan 274 is shut off, single damper 266 is set to open, and dual damper 260 is closed. Fan 274 is turned off while positioning dampers 260 and 266 for power management, and fan 274 is turned on once dampers are positioned.

When dampers 260 and 266 are positioned, operation proceeds to a Pre-Heat state 436. The Pre-Heat state 436 regulates the thaw pan temperature at temperature Th for a predetermined time tp. When preheat is not required, tp may be set to zero. After time tp expires, operation enters a LowHeat state 438 and pan temperature is regulated at temperature T1. From LowHeat state 438, operation is directed to a Terminate state 440 when a total time tt has expired, or a HighHeat state 442 when a low temperature time t1 has expired (as determined by an appropriate heating profile). When in the HighHeat state 442, operation will return to the LowHeat state 438 when a high temperature time th expires, (as determined by an appropriate heating profile). From the HighHeat state 442, the Terminate state 440 is entered when time tt expires. In the Terminate state 440, both dampers 260, 266 are closed, fan 274 is shut off, and further operation is suspended. It is understood that respective set temperatures Th and T1 for the HighHeat state and the LowHeat state are programmable parameters that may be set equal to one another, or different from one another, as desired.

Figure 14:
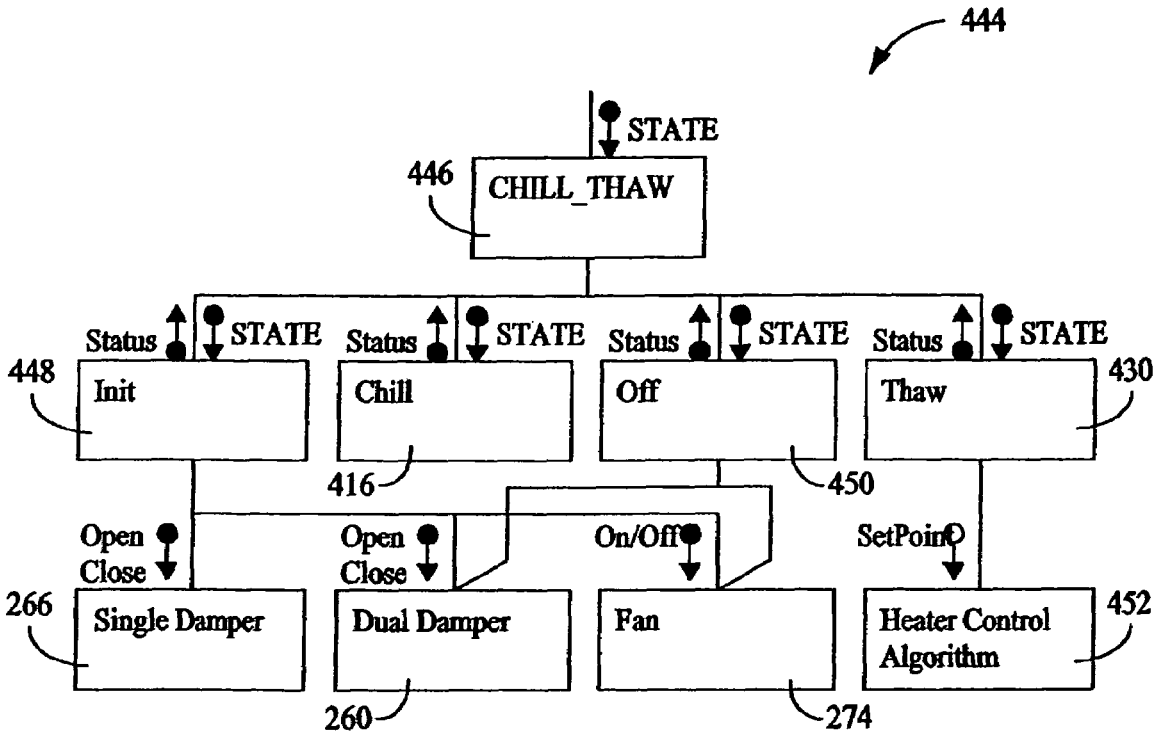
FIG. 14 is a structure diagram for the chill/thaw section of the refrigerator.

FIG. 14 is a state diagram 444 illustrating inter-relationships between each of the above described modes. Specifically, once in a CHILL_THAW state 446, i.e., when either a chill or thaw mode is entered for quick chill and thaw system 160, then one of an Initialization state 448, Chill state 416 (also shown in FIG. 12), Off state 450, and Thaw state 430 (also shown in FIG. 13) may be entered. In each state, single damper 260 (shown in FIGS. 4-6), dual damper 266 (shown in FIGS. 4-6), and fan 274 (shown in FIGS. 4-6) are controlled. Heater control algorithm 452 can be executed from thaw state 430. In a further embodiment, it is contemplated that a chill mode and thaw mode can be concurrently executed to maintain a desired temperature zone, as described above, in quick chill and thaw system 160.

As explained below, sensing a thawed state of a frozen package in pan 122, such as meat or other food item that is composed primarily of water, is possible without regard to temperature information about the package or the physical properties of the package. Specifically, by sensing the air outlet temperature using sensor 276 (shown in FIGS. 4-6) located in air handler re-circulation air path 256 (shown in FIGS. 4-6), and by monitoring heater 270 on time to maintain a constant air temperature, a state of the thawed item may be determined. An optional additional sensor located in fresh food compartment 102 (shown in FIG. 1), such as sensor 384 (shown in FIGS. 8, 9A, and 9B) enhances thawed state detection.

An amount of heat required by quick chill and thaw system 160 (shown in FIGS. 2-6) in a thaw mode is determined primarily by two components, namely, an amount of heat required to thaw the frozen package and an amount of heat that is lost to refrigerator compartment 102 (shown in FIG. 1) through the walls of pan 122. Specifically, the amount of heat that is required in a thaw mode may be substantially determined by the following relationship:

$$Q=h_a(t_{air}-t_{surface})+A/R(t_{air}-t_{ff}) \quad (1)$$

where $h_a$ is a heater constant, $t_{surface}$ is a surface temperature of the thawing package, $t_{air}$ is the temperature of circulated air in pan 122, $t_{ff}$ is a fresh food compartment temperature, and A/R is an empirically determined empty pan heat loss constant. Package surface temperature $t_{surface}$ will rise rapidly until the package reaches the melting point, and then remains at a relatively constant temperature until all the ice is melted. After all the ice is melted. $t_{surface}$ rapidly rises again.

Assuming that $t_{ff}$ is constant, and because air handler 162 is configured to produce a constant temperature airstream in pan 122, $t_{surface}$ is the only temperature that is changing in Equation (1). By monitoring the amount of heat input Q into pan 122 to keep $t_{air}$ constant, changes in $t_{surface}$ may therefore be determined.

If heater 270 duty cycle is long compared to a reference duty cycle to maintain a constant temperature of pan 122 with an empty pan, $t_{surface}$ is being raised to the package melting point. Because the conductivity of water is much greater than the heat transfer coefficient to the air, the package surface will remain relatively constant as heat is transferred to the core to complete the melting process. Thus, when the heater duty cycle is relatively constant, $t_{surface}$ is relatively constant and the package is thawing. When the package is thawed, the heater duty cycle will shorten over time and approach the steady state load required by the empty pan, thereby triggering an end of the thaw cycle, at which time heater 270 is de-energized, and pan 122 returns to a temperature of fresh food compartment 102 (shown in FIG. 1).

In a further embodiment, $t_{ff}$ is also monitored for more accurate sensing of a thawed state. If $t_{ff}$ is known, it can be used to determine a steady state heater duty cycle required if pan 122 were empty, provided that an empty pan constant A/R is also known. When an actual heater duty cycle approaches the reference steady state duty cycle if the pan were empty, the package is thawed and thaw mode may be ended.

Firmware

In an exemplary embodiment the electronic control system performs the following functions: compressor control, freezer temperature control, fresh food temperature control, multi speed control capable for the condenser fan, multi speed control capable for the evaporator fan (closed loop), multi speed control capable for the fresh food fan, defrost control, dispenser control, feature pan control (defrost, chill), and user interface functions. These functions are performed under the control of firmware implemented as small independent state machines.

User Interface/Display

Figure 15:
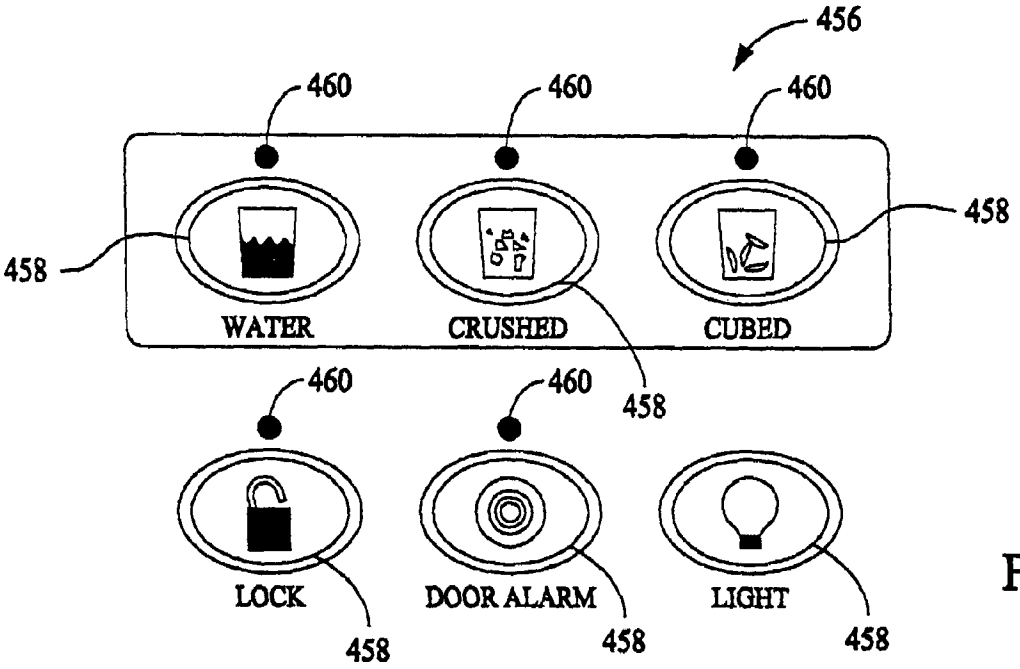
FIG. 15 illustrates an interface for a refrigerator that includes dispensers.

In an exemplary embodiment, the user interface is split into one or more human machine interface (HMI) boards including displays. For example, FIG. 15 illustrates an HMI board 456 for a refrigerator including dispensers. Board 456 includes a plurality of touch sensitive keys or buttons 458 for selection of various options, and accompanying LED's 460 to indicate selection of an option. The various options include selections for water, crushed ice, cubed ice, light, door alarm and lock.

Figure 16A:
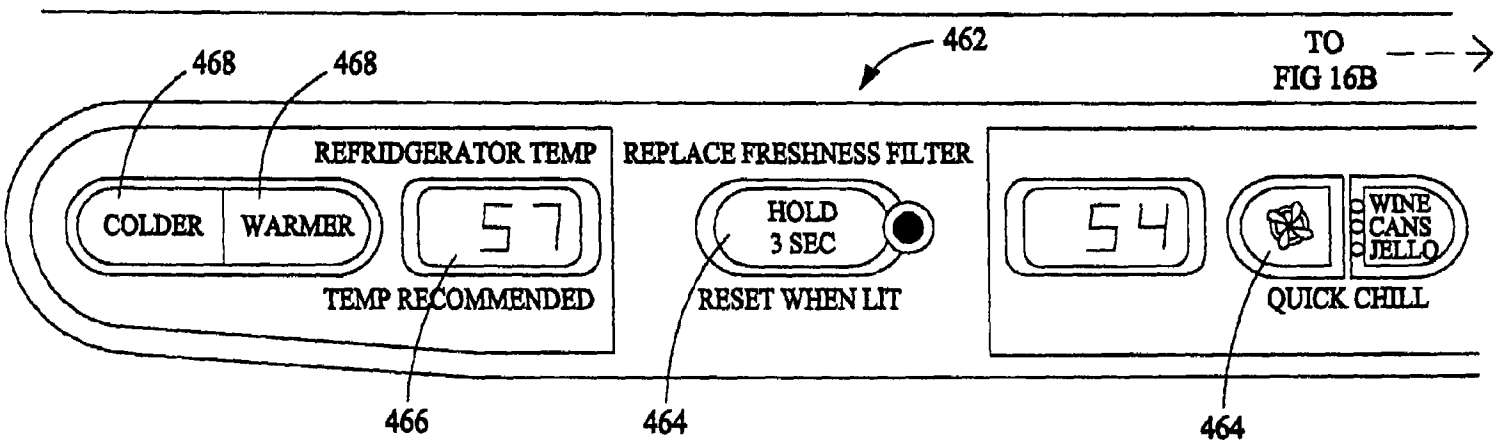
FIG. 16A illustrates a first portion of an interface for a refrigerator that includes electronic cold control.
Figure 16B:
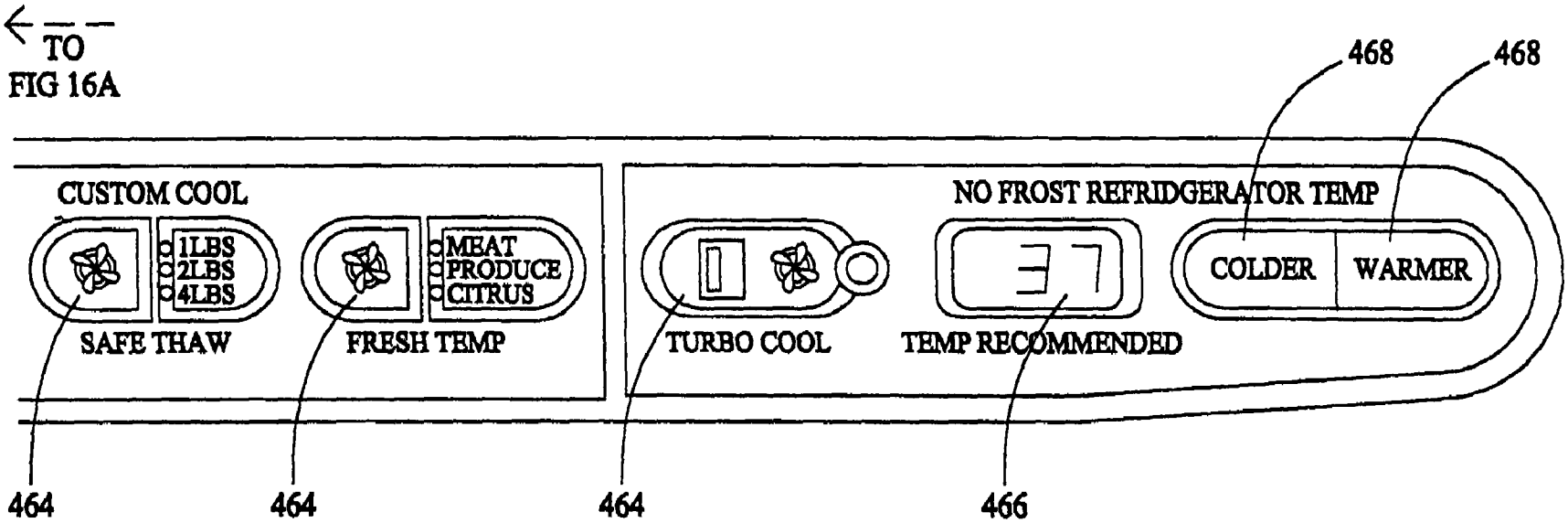
FIG. 16B illustrates a second portion of an interface for a refrigerator that includes electronic cold control.

FIGS. 16A and 16B illustrate an exemplary HMI board 462 for a refrigerator including electronic cold control. Board 462 also includes a plurality of touch sensitive keys or buttons 464 including LEDs to indicate activation of a selected control feature, actual temperature displays 466 for fresh food and freezer compartments, and slew keys 468 for adjusting temperature settings.

Figure 17:
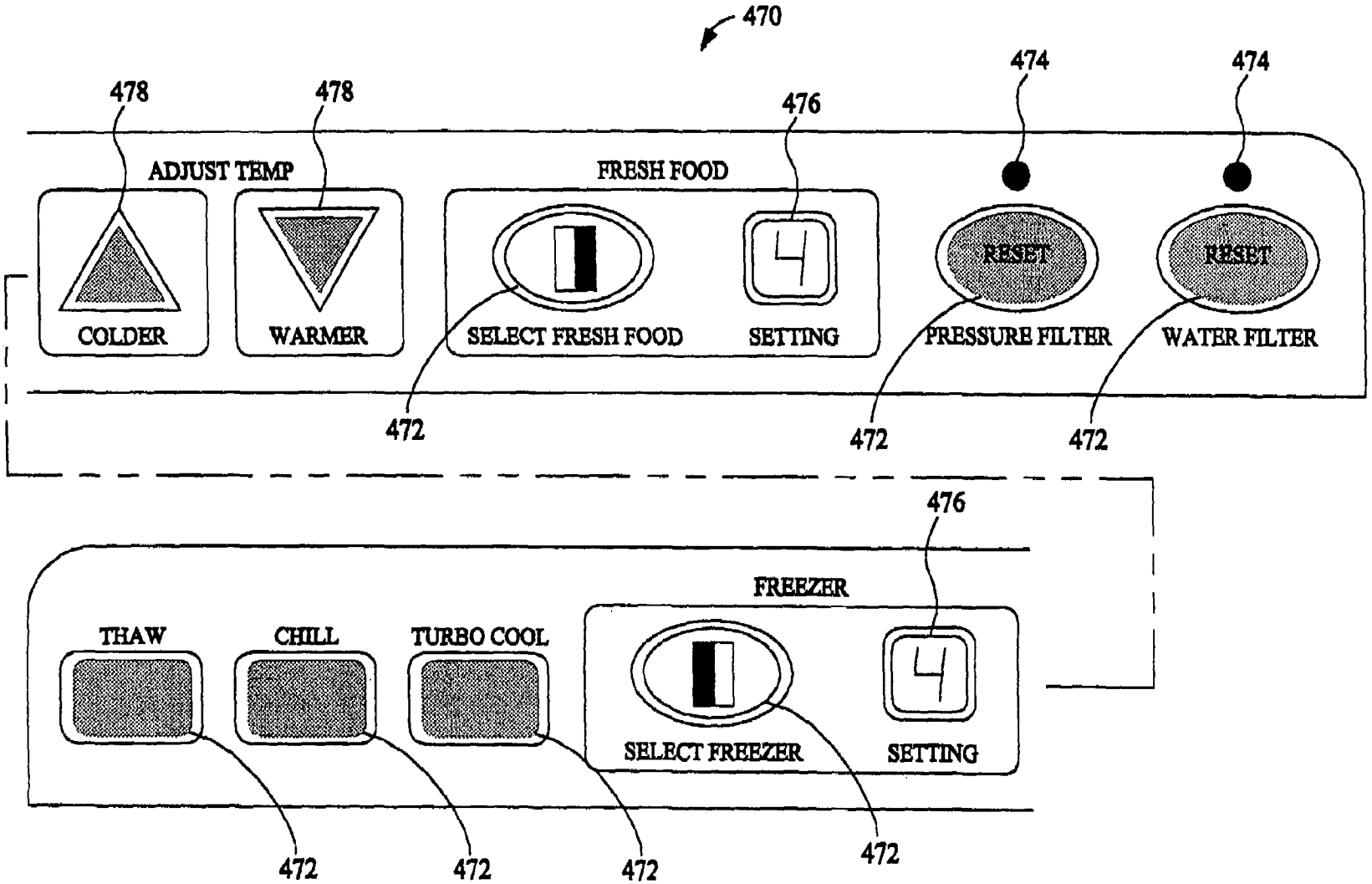
FIG. 17 illustrates a second embodiment of an interface for a refrigerator

FIG. 17 illustrates yet another embodiment of a cold control HMI board 470 including a plurality of touch sensitive keys or buttons 472 including LEDs 474 to indicate activation of a selected control feature, temperature zone displays 476 for fresh food and freezer compartments, and slew keys 478 for adjusting temperature settings. In one embodiment, slew keys include a thaw key, a cool key, a turbo key, a freshness filter reset key, and a water filter reset key.

In an exemplary embodiment, the temperature setting system is substantially the same for each HMI user interface. When fresh food door 134 (shown in FIG. 1) is closed, the HMI displays are off. When fresh food door 134 is opened, the displays turn on and operate according to the following rules. The embodiment for FIGS. 16A and 16B display actual temperature, and set points for the various LEDs illustrated in FIG. 17 are set forth in Appendix Table 12.

Referring to FIGS. 16A and 16B, the freezer compartment temperature is set in an exemplary embodiment as follows. In normal operation the current freezer temperature is displayed. When one of the freezer slew keys 468 is depressed, the LED next to "SET" (located just below slew keys 468 in FIGS. 16A and 16B) is illuminated, and controller 160 (shown in FIGS. 2-4) waits for operator input. Thereafter, for each time the freezer colder/slew-down key 468 is depressed, the display value on freezer temperature display 466 will decrement by one, and for each time the user presses the warmer/slew-up key 468 the display value on freezer temperature display 466 will increment by one. Thus, the user may increase or decrease the freezer set temperature using the freezer slew keys 468 on board 462.

Once the SET LED is illuminated, if freezer slew keys 468 are not pressed within a few seconds, such as, for example, within ten seconds, the SET LED will turn off and the current freezer set temperature will be maintained. After this period the user will be unable to change the freezer setting unless one of freezer slew keys 468 is again pressed to re-illuminate the SET LED.

If the freezer temperature is set to a predetermined temperature outside of a standard operating range, such as 7° F., both fresh food and freezer displays 466 will display an "off" indicator, and controller 160 shuts down the sealed system. The sealed system may be reactivated by pressing the freezer colder/slew-down key 468 so that the freezer temperature display indicates a temperature within the operating range, such as 6° F. or lower.

In one embodiment, freezer temperature may be set only in a range between −6° F. and 6° F. In alternative embodiments, other setting increments and ranges are contemplated in lieu of the exemplary embodiment described above.

In a further alternative embodiment, such as that shown in FIG. 17, temperature indicators other than actual temperature are displayed, such as a system selectively operable at a plurality of levels, e.g., level "1" through level "9" where one of the extremes, e.g., level "1," is a warmest setting and the other extreme, e.g., level "9," is a coldest setting. The settings are incremented or decremented accordingly between the two extremes on temperature zone or level displays 476 by pressing applicable warmer/slew-up or colder/slew-down keys 478. The freezer temperature is set using board 470 substantially as described above.

Similarly, and referring back to FIGS. 16A and 16B, fresh food compartment temperature is set in one embodiment as follows. In normal operation, the current fresh food temperature is displayed. When one of the fresh food slew keys 468 is depressed, the LED next to "SET" (located just below refrigerator slew keys 468 in FIGS. 16A and 16B) is illuminated and controller 160 waits for operator input. The displayed value on refrigerator temperature display 466 will decrement by one for each time the user presses the colder/slew-down key 468, and the display value on refrigerator temperature display 466 will increment by one for each time the user presses the warmer/slew-up key 468.

Once the SET LED is illuminated, if the fresh food compartment slew keys 468 are not pressed within a predetermined time interval, such as, for example, one to ten seconds, the SET LED will turn off and the current fresh food set temperature will be maintained. After this period the user will be unable to change the fresh food compartment setting unless one of slew keys 468 are again pressed to re-illuminate the SET LED.

If the user attempts to set the fresh food temperature above the normal operating temperature range, such as 46° F., both fresh food and freezer displays 466 will display an "off" indicator, and controller 160 shuts down the sealed system. The sealed system may be reactivated by pressing the colder/slew-down key so that the set fresh food compartment set temperature is within the normal operating range, such as 45° F. or lower.

In one embodiment, freezer temperature may be set only in a range between 34° F. and 45° F. In alternative embodiments, other setting increments and ranges are contemplated in lieu of the exemplary embodiment described above.

In a further alternative embodiment, such as that shown in FIG. 17, temperature indicators other than actual temperature are displayed, such as a system selectively operable at a plurality of levels, e.g., level "1" through level "9" where one of the extremes, e.g., level "1," is a warmest setting and the other extreme, e.g., level "9," is a coldest setting. The settings are incremented or decremented accordingly between the two extremes on temperature zone or level displays 476 by pressing the applicable warmer/slew-up or colder/slew-down key 478, and the fresh food temperature may be set as described above.

Once fresh food compartment and freezer compartment temperatures are set, actual temperatures (for the embodiment shown in FIGS. 16A and 16B) or temperature levels (for the embodiment shown in FIG. 17) are monitored and displayed to the user. To avoid undue changes in temperature displays during various operational modes of the refrigerator system that may mislead a user to believe that a malfunction has occurred, the behavior of the temperature display is altered in different operational modes of refrigerator 100 to better match refrigerator system behavior with consumer expectations. In one embodiment, for ease of consumer use control boards 462, 470 and temperature displays 466, 476 are configured to emulate the operation of a thermostat.

Normal Operation Display

For temperature settings, and as further described below, a normal operation mode in an exemplary embodiment is defined as closed door operation after a first state change cycle, i.e., a change of state from "warm" to "cold" or vice versa, due to a door opening or defrost operation. Under normal operating conditions, HMI board 462 (shown in FIGS. 16A and 16B) displays an actual average temperature of fresh food and freezer compartments 102, 104, except that HMI board 462 displays the set temperature for fresh food and freezer compartments 102, 104 while actual temperature fresh food is and freezer compartments 102, 104 is within a dead band for the freezer or the fresh food compartments.

Outside the dead band, however, HMI board 462 displays an actual average temperature for fresh food and freezer compartments 102, 104. For example, for a 37° F. fresh food temperature setting and a dead band of +/−2° F., actual and displayed temperature is as follows.

| | | | | | | | | | | | | |
|---|---|---|---|---|---|---|---|---|---|---|---|---|
| Actual Temp. | 34 | 34.5 | 35 | 36 | 37 | 38 | 39 | 39.5 | 40 | 40.5 | 41 | 42 |
| Display Temp. | 35 | 36 | 37 | 37 | 37 | 37 | 37 | 38 | 39 | 40 | 41 | 42 |

Thus, in accordance with user expectations, actual temperature displays 466 are not changed when actual temperature is within the dead band, and the displayed temperature display quickly approaches the actual temperature when actual temperatures are outside the dead band. Freezer settings are also displayed similarly within and outside a predetermined dead band. The temperature display is also damped, for example, by a 30 second time constant if the actual temperature is above the set temperature and by a predetermined time constant, such as 20 seconds, if the actual temperature is below the set temperature.

Door Open Display

A door open operation mode is defined in an exemplary embodiment as time while a door is open and while the door is closed after a door open event until the sealed system has cycled once (changed state from warm-to-cold, or cold-to-warm once), excluding a door open operation during a defrost event. During door open events, food temperature is slowly and exponentially increasing. After door open events, temperature sensors in the refrigerator compartments determine the overall operation and this is to be matched by the display.

Fresh Food Display

During door open operation, in an exemplary embodiment temperature display for the fresh food compartment is modified as follows depending on actual compartment temperature, the set temperature, and whether actual temperature is rising or falling.

When actual fresh food compartment temperature is above the set temperature and is rising, the fresh food temperature display damping constant is activated and dependent on a difference between actual temperature and set temperature. For instance, in one embodiment, the fresh food temperature display damping constant is, for example, five minutes for a set temperature versus actual temperature difference of, for example 2° F. to 4° F., the fresh food temperature display damping constant is, for example, ten minutes for a set temperature versus actual temperature difference of, for example, 4° F. to 7° F., and the fresh food temperature display damping constant is, for example, twenty minutes for a set temperature versus actual temperature difference of, for example, greater than 7° F.

When actual fresh food compartment temperature is above the set temperature and falling, the fresh food temperature display damping delay constant is, for example, three minutes.

When actual fresh food compartment temperature is below the set temperature and rising, the fresh food temperature display damping delay constant is, for example, three minutes.

When actual fresh food compartment temperature is below the set temperature and falling, the damping delay constant is, for example, five minutes for a set temperature versus actual temperature difference of, for example, 2° F. to 4° F., the damping delay constant is, for example, ten minutes for a set temperature versus actual temperature difference of, for example, 4° F. to 7° F., and the damping delay constant is, for example, 20 minutes for a set temperature versus actual temperature difference of, for example, greater than 7° F.

In alternative embodiments, other settings and ranges are contemplated in lieu of the exemplary settings and ranges described above.

Freezer Display

During door open operation, in an exemplary embodiment the temperature display for the freezer compartment is modified as follows depending on actual freezer compartment temperature, the set freezer temperature, and whether actual temperature is rising or falling.

In one example, when actual freezer compartment temperature is above the set temperature and rising, the damping delay constant is, for example, five minutes for a set temperature versus actual temperature difference of, for example, 2° F. to 8° F., the damping delay constant is, for example, ten minutes for a set temperature versus actual temperature difference of, for example, 8° F. to 15° F., and the damping delay constant is, for example, twenty minutes for a set temperature versus actual temperature difference of, for example, greater than 15° F.

When actual freezer compartment temperature is above the set temperature and falling, the damping delay constant is, for example, three minutes.

When actual freezer compartment temperature is below the set temperature and increasing, the damping delay constant is, for example, three minutes.

When actual freezer compartment temperature is below the set temperature and falling, the damping delay constant is, for example, five minutes for a set temperature versus actual temperature difference of, for example, 2° F. to 8° F., the damping delay constant is, for example, ten minutes for a set temperature versus actual temperature difference of, for example, 8° F. to 15° F., and the damping delay constant is, for example, twenty minutes for a set temperature versus actual temperature difference of, for example, greater than 15° F.

In alternative embodiments, other settings and ranges are contemplated in lieu of the exemplary settings and ranges described above.

Defrost Mode Display

A defrost operation mode is defined in an exemplary embodiment as a pre-chill interval, a defrost heating interval and a first cycle interval. During a defrost operation, freezer temperature display 4666 shows the freezer set temperature plus, for example, 1° F. while the sealed system is on and shows the set temperature while the sealed system is off, and fresh food display 466 shows the set temperature. Thus, defrost operations will not be apparent to the user.

Defrost Mode, Door Open Display

A mode of defrost operation while a door 132, 134 (shown in FIG. 1) is open is defined in an exemplary embodiment as an elapsed time a door is open while in the defrost operation. Freezer display 466 shows the set temperature when the actual freezer temperature is below the set temperature, and otherwise it displays a damped actual temperature with a delay constant of twenty minutes. Fresh food display 466 shows the set temperature when the fresh food temperature is below the set temperature, and otherwise it displays a damped actual temperature with a delay constant of ten minutes.

User Temperature Change Display

A user change temperature mode is defined in an exemplary embodiment as a time from which the user changes a set temperature for either the fresh food or freezer compartment until a first sealed system cycle is completed. If the actual temperature is within a dead band and the new user set temperature also is within the dead band, one or more sealed system fans are turned on for a minimum amount of time when the user has lowered the set temperature so that the sealed system appears to respond to the new user setting as a user might expect.

If the actual temperature is within the dead band and the new user set temperature is within the dead band, no load is activated if the set temperature is increased. If the actual temperature is within the dead band and the new user set temperature is outside the dead band, then action is taken as in normal operation.

High Temperature Operation

If the average temperature of both the fresh food temperature and the freezer temperature is above a predetermined upper temperature that is outside of normal operation of refrigerator 100, such as 50° F., then the display of both fresh food actual temperature and freezer actual temperature is synchronized to the fresh food actual temperature. In an alternative embodiment, both displays are synchronized to the freezer actual temperature when the average temperature of both the fresh food temperature and the freezer temperature is above a predetermined upper temperature that is outside a normal range of operation.

Showroom Mode

A showroom mode is entered in an exemplary embodiment by selecting some odd combination of buttons 464, 472 (shown in FIGS. 16A-17). In this mode, the compressor stays off at all times, fresh food and freezer compartment lighting operate as normal (e.g., come on when door is open), and when a door is open, no fans run. To operate the turbo cool fans, a user pushes the Turbo cool button (shown in FIGS. 16A-17) and the fans turn on in high mode. When the user depresses the Turbo cool button a second time, the fans turn off. Furthermore, to control the fan speed, a user pushes the Turbo cool button one time for the fans to activate in low mode, push Turbo cool button twice to activate high mode, and push Turbo cool button a third time to deactivate the fans.

Temperature Controls

In an exemplary embodiment, temperature controls operate as normal (without turning on fans or compressor) i.e., when door is opened, temperature displays "actual" temperature, approximately 70°. Selecting the Quick Chill or Quick Thaw button (shown in FIGS. 16A-17) results in the respective LEDs being energized along with the bottom pan cover and fans (audible cue). The LEDs and fans are de-energized by selecting the button again.

Dispenser Controls

In addition, in an exemplary embodiment the dispenser operates as normal, and all functions "reset" when door is closed (i.e., fans and LED's turn off). The demo mode is exited by either unplugging the refrigerator or selecting a same combination of buttons used to enter the demo mode.

The water/crushed/cubed dispensing functions are exclusively linked by the firmware. Specifically, selecting one of these buttons selects that function and turns off the other two functions. When the function is selected, its LED is lit. When the target switch is depressed and the door is closed, the dispense occurs according to the selected function. The water selection is the default at power up.

For example when the user presses the "Water" button (see FIG. 15), the water LED will light and the "Crushed" and Cubed" LEDs will shut off. If the door is closed, when the user hits the target switch with a glass, water will be dispensed. Dispensing ice, either cubed or crushed, requires that a dispensing duct door be opened by an electromagnet coupled to dispenser board 396 (shown in FIGS. 9A-10). The duct door remains open for about five seconds after the user ceases dispensing ice. After a predetermined delay, such as 4.5 seconds in an exemplary embodiment, the polarity on the magnet is reversed for 3 seconds in order to close the duct door. The electromagnet is pulsed once every 5 minutes in order to ensure that the door stays closed. When dispensing cubed ice, the crushed ice bypass solenoid is energized to allow cubed ice to bypass the crusher.

When the user hits the dispenser target switch, a light coupled to dispenser board 396 (shown in FIGS. 9A-10) is energized. When the target switch is deactivated the light remains on for a predetermined time, such as about 20 seconds in an exemplary embodiment. At the end of the predetermined time, the light "fades out".

A "Door Alarm" switch (see FIG. 15) enables the door alarm feature. A "Door Alarm" LED flashes when the door is open. If the door is open for more than two minutes, the HMI will begin beeping. If the user touches the "Door Alarm" button while the door is open, HMI stops beeping (the LED continues to flash) until the door is closed. Closing the door stops the alarm and re-enables the audible alarm if the "Door Alarm" button had been pressed.

Selecting a "Light" button (see FIG. 15) results in turning the light on if it was off and turns it off it was on. The turn off is a "fade out". To lock the interface, a user presses the Lock button (see FIG. 15) and holds it, in one embodiment, for three seconds. To unlock the interface, the user presses the Lock button and holds it for a predetermined time, such three seconds in an exemplary embodiment. During the predetermined time, an LED flashes to indicate button activation. If the interface is locked, the LED associated with the Lock button may be illuminated.

When the interface is locked, no dispenser key presses will be accepted including the target switch, which prevents accidental dispensing that may be caused by children or pets. Key presses with the system locked are acknowledged with, for example, three pulses of the Lock LED accompanied by audible tone in one embodiment.

The "Water Filter" LED (see FIG. 17) is energized after a predetermined amount of accumulated main water valve activation time (e.g., about eight hours) or a pre-selected maximum elapsed time (e.g. 6 and 12 months), depending on dispenser model. The "Freshness Filter" LEDs (see FIGS. 16 and 17) are energized after six months of service have been accumulated. To reset the filter reminder timers and de-energize the LEDs, the user presses the appropriate reset button for three seconds. During the three second delay time, the LED flashes to indicate button activation. The appropriate time is reset and the appropriate LEDs are de-energized. If the user changes the filters early (i.e., before the LEDs have come on), the user can reset the timer by holding the reset button for three seconds in an exemplary embodiment, which results in illumination of the appropriate LED for three seconds in the exemplary embodiment.

Turbo Cool

Selecting the "Turbo Cool" button (see FIGS. 16A-17) initiates the turbo cool mode in the refrigerator. The "Turbo" LED on the HMI indicates the turbo mode. The turbo mode causes three functional changes in the system performance. Specifically, all fans will be set to high speed while the turbo mode is activated, up to a preset maximum elapsed time (e.g. eight hours); the fresh food set point will change to the lowest setting in the fresh food compartment, which results in changing the temperature, but will not change the user display; and the compressor and supporting fans will turn on for a predetermined period (e.g., about 10 minutes in one embodiment) to allow the user to "hear the system come on."

When the turbo cool mode is complete, the fresh food set point reverts to the user-selected set point and the fans revert to an appropriate lower speed. The turbo mode is terminated if the user presses the turbo button a second time or at the end of the eight-hour period. The turbo cool function is retained through a power cycle.

Quick Chill/Thaw

For thaw pan 122 operation the user presses the "Thaw" button (see FIGS. 16A-17) and the thaw algorithm is initialized. Once the thaw button is depressed, the chill pan fan will run for a predetermined time, such as 12 hours in an exemplary embodiment, or until the user depresses the thaw button a second time. For chill pan 122 operation the user presses the "Chill" button (see FIGS. 16A-17) and the chill algorithm is initialized. Once the chill button is depressed the chill pan fan will run for the predetermined time or until the user depresses the chill button a second time. The thaw and chill are separate functions and can have different run times, e.g., thaw runs for 12 hours and chill runs for 8 hours.

Service Diagnostics

Service diagnostics are accessed via the cold control panel (see FIGS. 16A and 16B) of the HMI. In the event a refrigerator is to be serviced that does not have an HMI, the service technician plugs in an HMI board during the service call. In one embodiment, there are fourteen diagnostic sequences or modes, such as those described in Appendix Table 13. In alternative embodiments, greater or fewer than fourteen diagnostic modes are employed.

To access the diagnostic modes, in one embodiment, all four slew keys (see FIGS. 16A and 16B) are simultaneously depressed for a predetermined time, e.g., two seconds. If the displays are adjusted within a next number of seconds, e.g., 30 seconds, to correspond to a desired test mode, any other button is pressed to enter that mode. When the Chill button is pressed the numeric displays flash, confirming the particular test mode. If the Chill button (shown in FIGS. 16A and 16B) is not pressed within 30 seconds of entering the diagnostic mode, the refrigerator returns to normal operation. In alternative embodiments, greater or lesser time periods for entering diagnostic modes and adjusting diagnostic modes are employed in lieu of the above described illustrative embodiment.

At the end of a test session, the technician enters, for example, "14" in on the display and then presses Chill to execute a system restart in one embodiment. A second option is to unplug the unit and plug it back into the outlet. As a cautionary measure, the system will automatically time out of the diagnostic mode after 15 minutes of inactivity.

Self-test

An HMI self-test applies only to the temperature control board inside the fresh food compartment. There is no self-test defined for the dispenser board as the operation of the dispenser board can be tested by pressing each button.

Once the HMI self-test is invoked, all of the LEDs and numerical segments illuminate. When the technician presses the Thaw button (shown in FIGS. 16A-17), the Thaw light is de-energized. When the chill button is pressed, the Chill light is de-energized. This process continues for each LED/Button pair on the display. The colder and warmer slew keys each require seven presses to test the seven-segment LEDs.

In one embodiment, the HMI test checks six thermistors (see FIGS. 9A and 9B) located throughout the unit in an exemplary embodiment. During the test, the test mode LED stops flashing and a corresponding thermistor number is displayed on the freezer display of the HMI. For each thermistor, the HMI responds by lighting either the Turbo Cool LED (green) for OK or the Freshness Filter LED (red) if there is a problem.

The warmer/colder arrows can be pressed to move onto the next thermistor. In an exemplary embodiment, the order of the thermistors is as follows:

Fresh Food 1
Fresh Food 2
Freezer
Evaporator
Feature Pan
Other (if any).

In various embodiments, "Other" includes one or more of, but is not limited to, a second freezer thermistor, a condenser thermistor, an ice maker thermistor and an ambient temperature thermistor Factory Diagnostics Factory diagnostics are supported using access to the system bus. There is a 1-second delay at the beginning of the diagnostics operation to allow interruption. Appendix Table 14 illustrates the failure management modes that allow the unit to function in the event of soft failures. Table 14 identifies the device, the detection used, and the strategy employed. In the event of a communication break, the dispenser and main boards have a time-out that prevents water from dumping on the floor.

Each fan 274, 364, 366, 368 (see FIG. 10) can be tested by switching in a diagnostic circuit and turning on that particular fan for a short period of time. Then by reading the voltage drop across a resistor, the amount of current the fan is drawing can be determined. If the fan is operating correctly, the diagnostic circuit will be switched out.

Communications

Main control board 326 (shown in FIGS. 8-10) responds to the address 1×10. Since main control board 326 controls most of the mission critical loads, each function within the board will include a time out. This way a failure in the communication system will not result in a catastrophic failure (e.g., when water valve 350 is engaged, a time out will prevent dumping large amounts of water on the floor if the communication system has been interrupted). Appendix Table 15 sets forth main control board 326 (shown in FIGS. 8-10) commands.

The sensor state command returns a byte. The bits in the byte correspond to the values set forth in Appendix Table 21. The state of the refrigerator state returns the bytes as set forth in Appendix Table 17.

HMI board 324 (shown in FIG. 8) responds to the address 0×11. The command byte, command received, communication response, and physical response are set forth in Appendix Table 18. The set buttons command sends the bytes as specified in Appendix Table 19. The bits in the first two bytes correspond as shown in Table 19. Bytes 2-7 correspond to the respective Light-Emitting diodes (LEDs) as shown in Table 19. The read buttons command returns the bytes specified in Appendix Table 20. The bits in the first two bytes correspond to the values set forth in Appendix Table 20.

Dispenser board 396 (shown in FIGS. 9A-10) responds to the address 0x12. The command byte, command received, communication response, and physical response are set forth in Appendix Table 21. The set buttons commands send the bytes specified in Appendix Table 22. The bits in the first two bytes correspond as shown in Table 22. Bytes 2-7 correspond to the respective LEDs as shown in Table 22. The read buttons command returns the bytes shown in Appendix Table 23. The bits in the first two bytes correspond to the values set forth in Table 23.

Regarding HMI board 324 (shown in FIG. 8), parameter data is set forth in Appendix Table 24 and data stores is set forth in Appendix Table 25. For main control board 326 (shown in FIGS. 8-10), parameter data is set forth in Appendix Table 26 and data stores is set forth in Appendix Table 27. Exemplary Read-Only memory (ROM) constants are set forth in Appendix Table 28.

Main control board 326 (shown in FIGS. 8-10) main pseudo code is set forth below.

```
MAIN( ){
    Update Rolling Average (Initialize)
    Sealed System (Initialize)
    Fresh Food (FF0 Fan Speed & Control (Initialize)
    Defrost (Initialize)
    Command Processor (Initialize)
    Dispenser (Initialize)
    Update Fan Speeds (Initialize)
    Update Timers (Initialize)
    Enable interrupts
    Do Forever{
        Update Rolling Average (Run)
        Sealed System (Run)
        FF Fan Speed & Control (Run)
        Defrost (Run)
        }
    }
```

Operating Algorithms

Power Management

Power management is handled through design rules implemented in each algorithm that affects inputs/outputs I/O. The rules are implemented in each I/O routine. A sweat heater (see FIG. 10) and electromagnet (see FIG. 10) may not be on at the same time. If compressor 412 is on (see FIGS. 9A and 9B), fans 274, 364, 366, 368 (shown in FIG. 8-10) may only be disabled for 5 minutes maximum as set by Electrically Erasable Programmable Read Only Memory (EEPROM) 376 (shown in FIGS. 9A and 9B).

Watchdog Timer

Both HMI board 324 (shown in FIG. 8) and main control board 326 (shown in FIGS. 8-10) include a watchdog timer (either on the microcontroller chip or as an additional component on the board). The watchdog timer invokes a reset unless it is reset by the system software on a periodic basis. Any routine that has a maximum time complexity estimate, e.g., more than 50% of the watchdog timeout, has a watchdog access included in its loop. If no routines in the firmware have this large of a time complexity estimate, then the watchdog will only be reset in the main routine.

Timer Interrupt

Software is used to check if the timer interrupt is still functioning correctly. The main portion of the code periodically monitors a flag, which is normally set by the timer interrupt routine. If the flag is set, the main loop clears the flag. However if the flag is clear, there has been a failure and the main loop reinitializes the microprocessor.

Magnetic H Bridge Operation

An H bridge on dispenser board 324 (shown in FIGS. 9A, and 10) imposes timing and switching requirements on the software. In an exemplary embodiment, the switching requirements are as follows:

To disable the magnet, the enable signal is driven high and a delay of 2.5 mS occurs before the direction signal is driven low.

To enable the magnet in one direction, the enable signal is driven high and a delay of 2.5 mS occurs before the direction signal is driven low. A second 2.5 mS delay occurs before the enable signal is driven low.

To enable the magnet in the other direction, the enable signal is driven high and a delay for 2.5 mS occurs before the direction signal is driven high. A second 2.5 mS delay occurs before the enable signal is driven low.

At initialization (reset) the disable magnet process should be executed.

Keyboard Debounce

A keyboard read routine is implemented as follows in an exemplary embodiment. Each key is in one of three states: not pressed, debouncing, and pressed. The state and current debounce count for each key are stored in an array of structures. When a keypress is detected during a scan, the state of the key is changed from not pressed to debouncing. The key remains in the debouncing state for 50 milliseconds. If, after the 50 millisecond delay, the key is still pressed during a scan of that keys row, the state of the key is changed to pressed. The state of the key remains pressed until a subsequent scan of the keypad reveals that the key is no longer pressed. Sequential key presses are debounced for 60 milliseconds.

The following FIGS. 18A-44 illustrate, in exemplary embodiments, different behavior characteristics of refrigerator components in response to user input. It is understood that the specific behavior characteristics set forth below are for illustrative purposes only, and that modifications are contemplated in alternative embodiments without departing from the scope of the present invention.

Sealed System

Figure 18A:
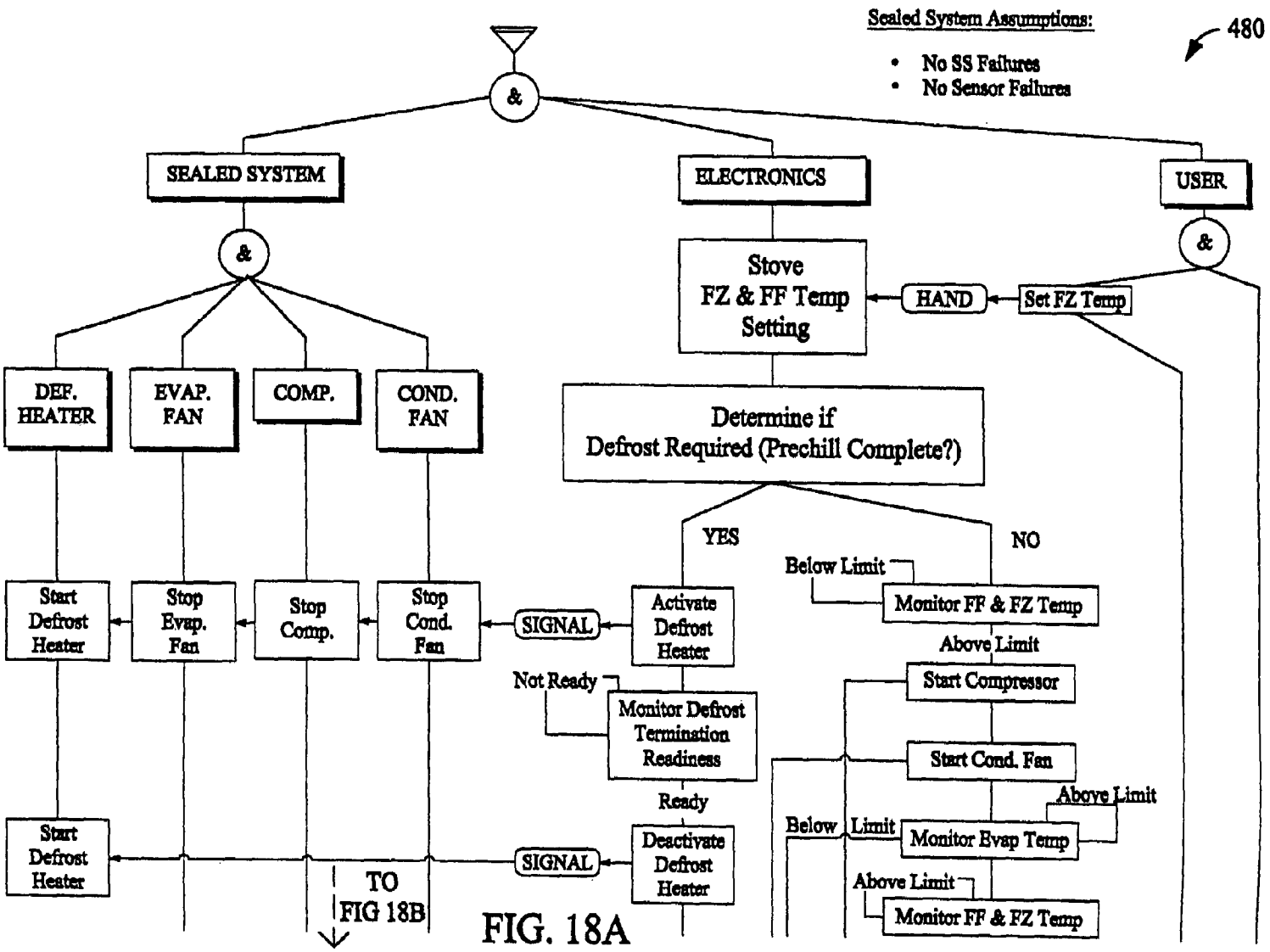
FIG. 18A is a first portion of a sealed system behavior diagram.
Figure 18B:
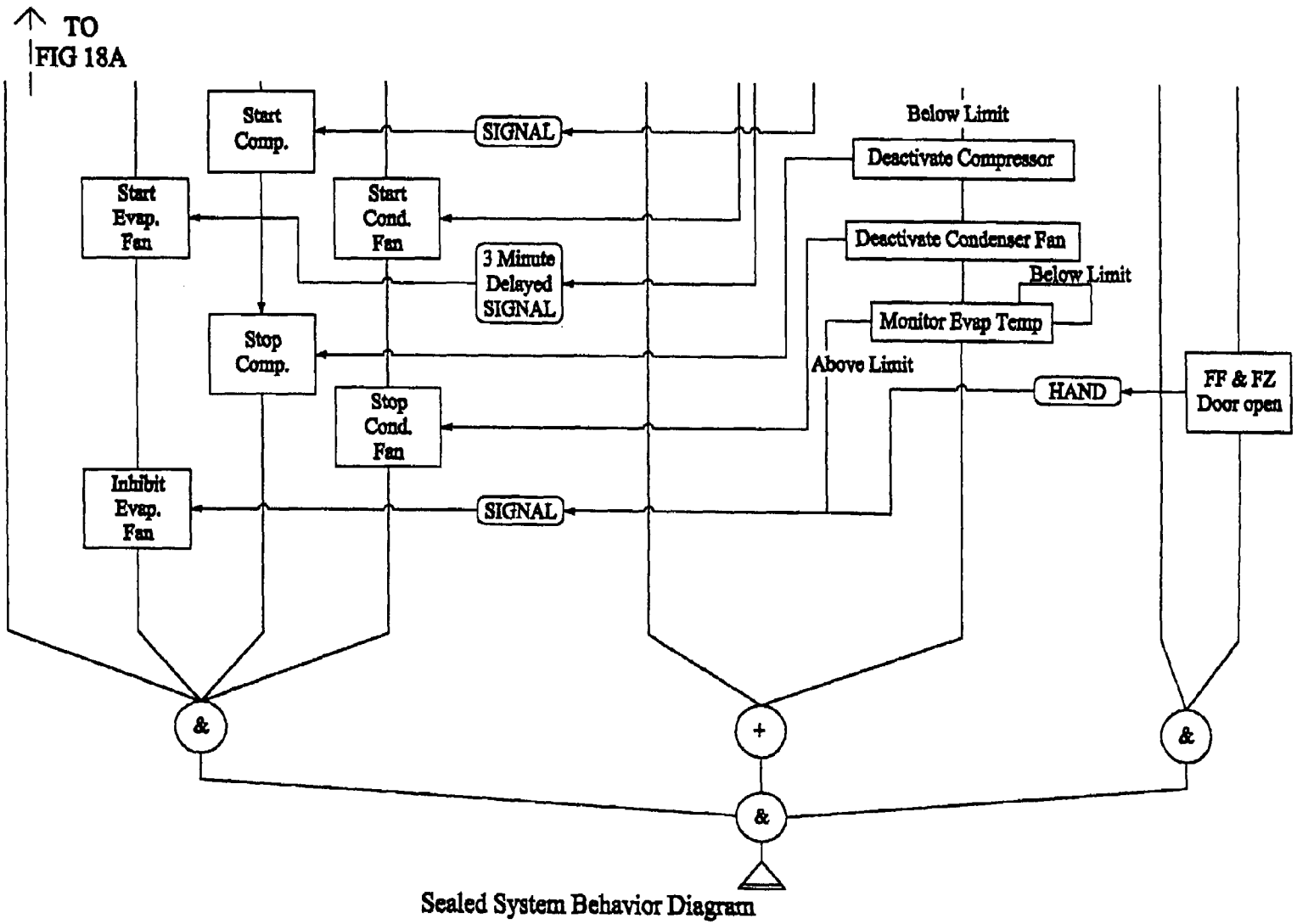
FIG. 18B is a second portion of a sealed system behavior diagram.

FIGS. 18A and 18B are an exemplary behavior diagram 480 for sealed system control that illustrates the relationship between the user, the refrigerator's electronics and the sealed system. The sealed system starts and stops the compressor and the evaporator and condenser fans in response to freezer and fresh food temperature conditions. A user selects a freezer temperature that is stored in memory. In normal operation, e.g., not a defrost operation, the electronics monitor the fresh food and freezer compartment temperatures. If the temperature increases above the set temperature, the compressor and condenser fan are started and the evaporator fan is turned on. If the temperature drops below the set temperature, the evaporator fan is turned off after and the compressor and condenser are also deactivated. In a further embodiment, when the fresh food compartment needs cooling as determined by the set temperature, and further when the refrigeration compartment does not need cooling as determined by the set temperature, then the evaporator fan is turned on while the sealed system and condenser are turned off until temperature conditions in the fresh food chamber are satisfied, as determined by the set temperature.

If the freezer needs to be defrosted, the electronics stop the condenser fan, compressor, evaporator fan and turn on the defrost heater. As further described below, the sealed system also starts and stops the defrost heater when signaled to do so by defrost control. The sealed system also inhibits evaporator fan operation when a fresh food door or freezer door is opened.

Fresh Food Fan

Figure 19:
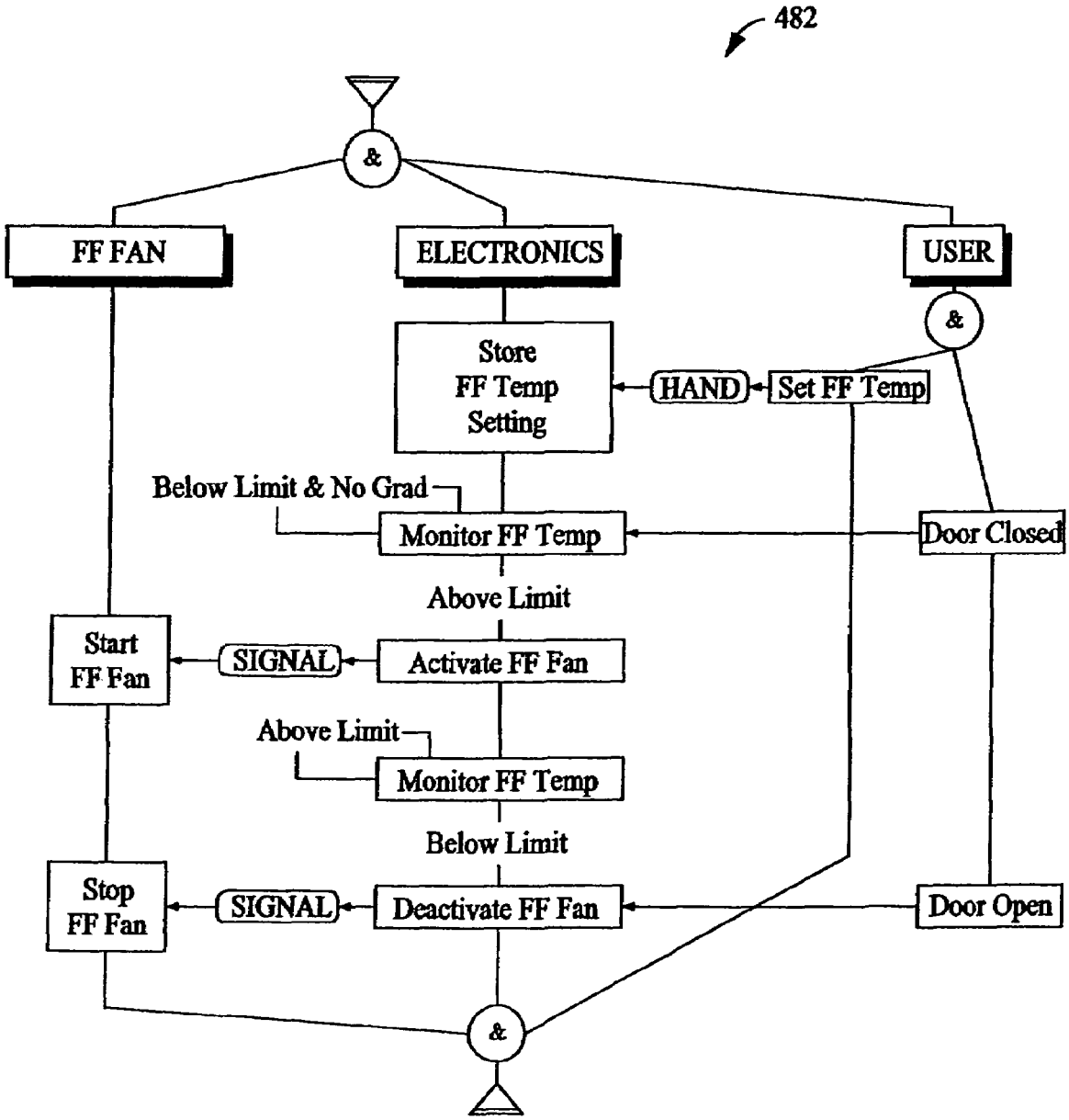
FIG. 19 is a fresh food behavior diagram.

FIG. 19 is a an exemplary diagram of fresh food fan behavior 482 that illustrates the relationship between the user, the refrigerator's electronics and the fresh food fan. The fresh food fan is started and stopped in response to fresh food compartment temperature conditions, which may be altered when the user changes a fresh food temperature setting or opens and closes a door. If the door is closed, the electronics monitor the fresh food compartment temperature. If the temperature within the fresh food compartment increases above a set temperature setting, the fresh food fan is started and is stopped when the temperature drops below the set temperature. When a door is opened, the fresh food fan is stopped.

Dispenser

Figure 20A:
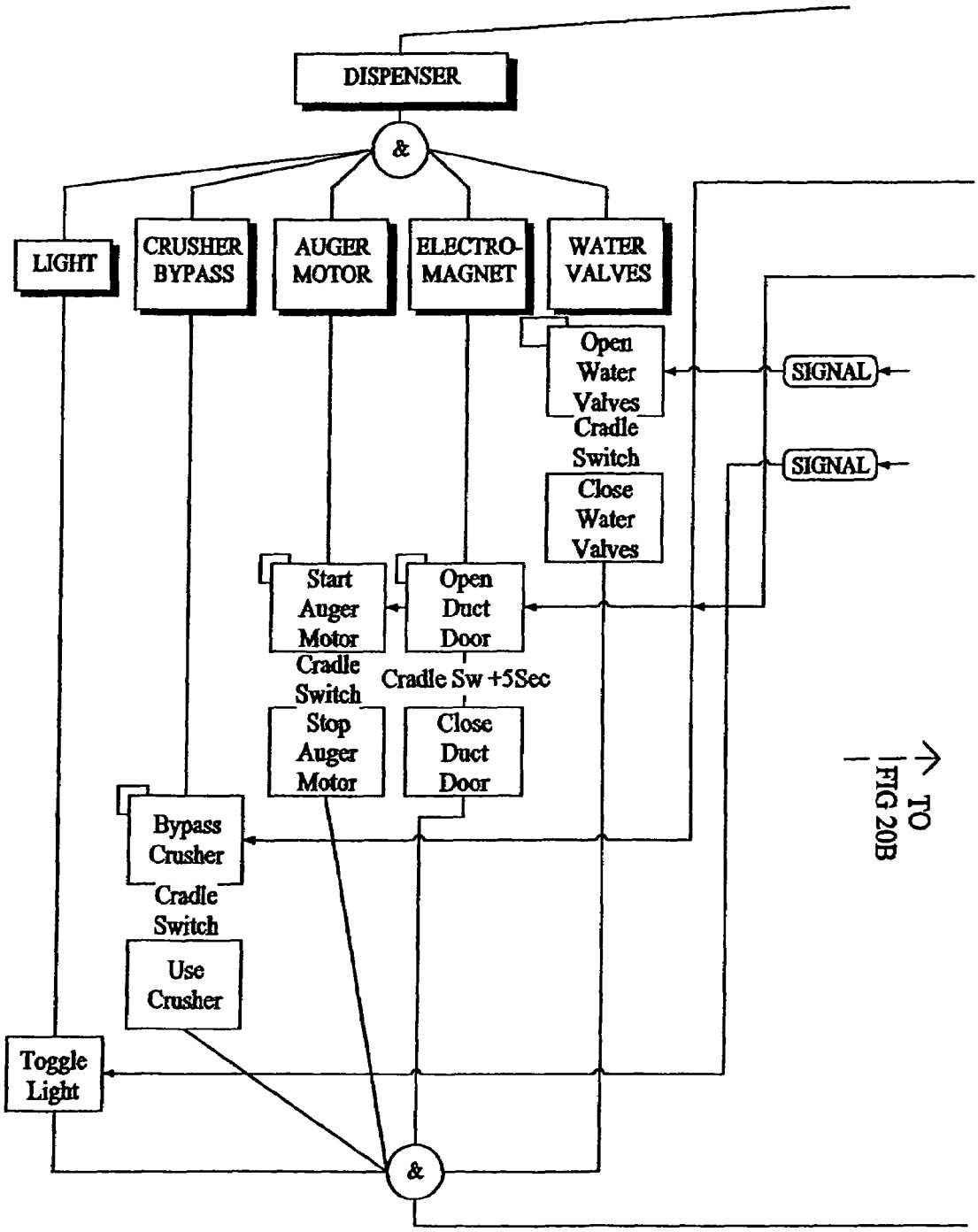
FIG. 20A is a first portion of a dispenser behavior diagram.
Figure 20B:
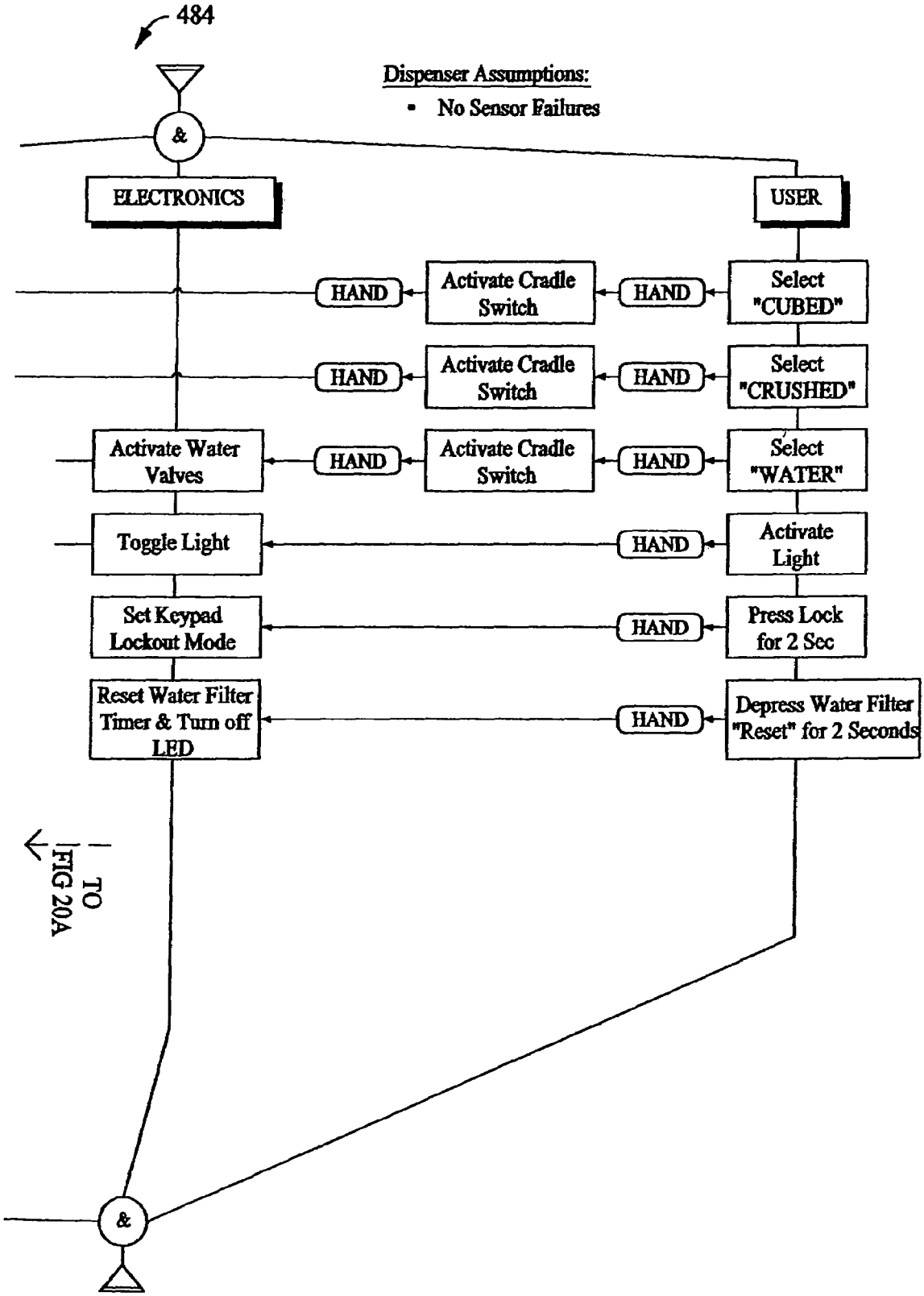
FIG. 20B is a second portion of a dispenser behavior diagram.
Figure 21:
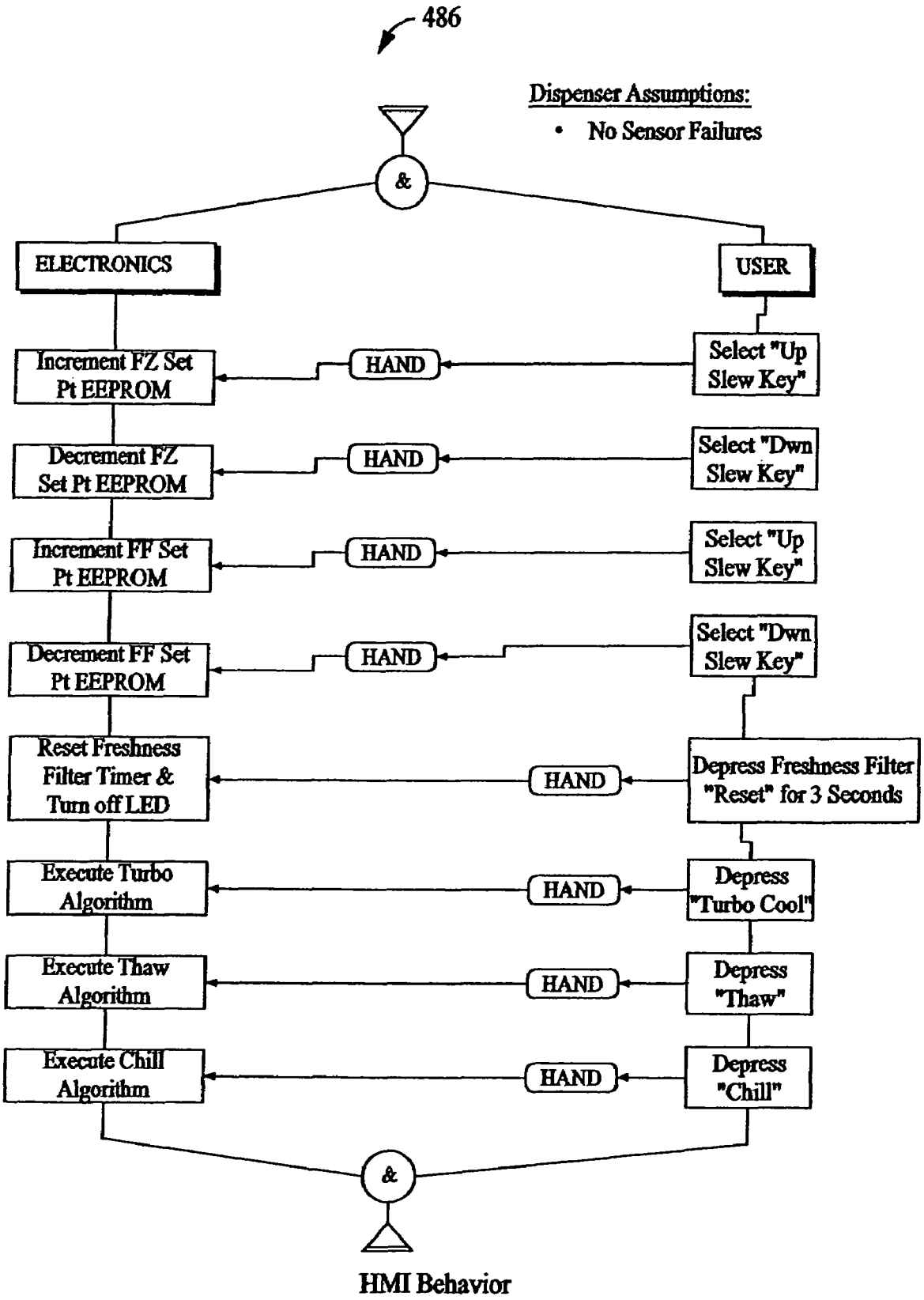
FIG. 21 is an HMI behavior diagram.

FIGS. 20A and 20B are an exemplary dispenser behavior diagram 484 that illustrates the relationship between the user, the refrigerator's electronics and the dispenser. The user selects one of six choices: cubed for cubed ice, crushed for crushed ice, water to dispense water, light to activate a light, lock to lock the keypad, and reset to reset a water filter (see FIG. 15). The electronics control activate water valves, toggles the light, sets the keypad in lockout mode and resets the water filter timer and turns on/off the water reset filter LED. The dispenser operates five routines to carry out a user selection.

When the user selects cubed ice, a cradle switch is activated and the dispenser calls the crusher bypass routine to dispense ice.

When the user selects crushed ice, the cradle switch is activated, and the dispenser calls the electromagnet and auger motor routines to control the operation of the duct door, auger motor, and crusher. Upon activating the cradle switch, the electromagnet routine opens the duct door and the auger motor routine starts the auger motor and the crusher is operated. When the cradle switch is released for a predetermined time, such as five seconds in an exemplary embodiment, the dispenser closes the duct door and the auger motor stops.

When the user selects water, the cradle switch is activated, the electronics sends activate the water valve signal to the dispenser, which calls the water valves routine to open the water valve until the cradle switch is deactivated.

When the user selects activate light, the electronics sends a toggle light signal to the dispenser, which calls the light routine to toggle the light. Also, the light is activated during any dispenser function.

The user must depress "lock" for at least two seconds to select to lock the keypad, then the electronics set the keypad to lockout mode.

The user must depress the water filter "reset" for at least two seconds to reset the water filter timer. The electronics then will reset the water filter timer and turn off the LED.

Interface

FIGS. 21A and 21B are an exemplary diagram of HMI behavior 486. A user selects "up" or "down" slew keys (shown in FIGS. 16A-17) on the cold control board to increment or decrement temperature set for the freezer and/or fresh food compartment. A newly set value is stored in EEPROM 376 (shown in FIGS. 9A and 9B). When the user depresses a "Turbo Cool", "Thaw", or "Chill" key (shown in FIGS. 16A-17) on the board, the corresponding algorithm is performed by the control system. When the user depresses the freshness filter "Reset" key (shown in FIG. 17) for 3 seconds, a water freshness filter timer is reset and the LED is turned off.

Dispenser Interaction

Figure 22:
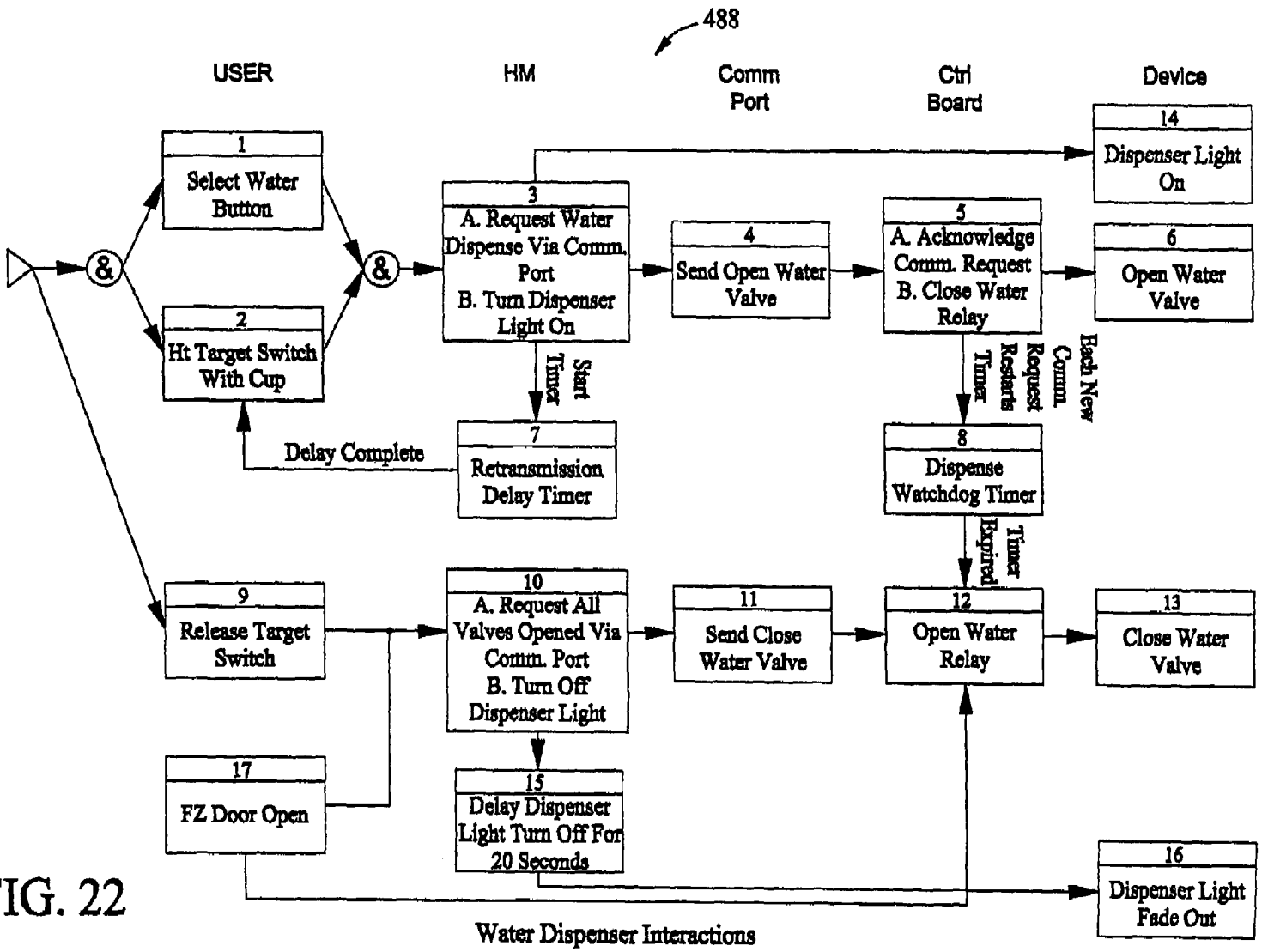
FIG. 22 is a water dispenser interactions diagram.

FIG. 22 is an exemplary water dispenser interactions diagram 488 that illustrates the interaction between a user, HMI board 324 (shown in FIG. 8), the communications port, main control board 326 (shown in FIGS. 8-10) and a dispenser device itself in controlling a light and a water valve.

The user selects water to be dispensed and depresses the cradle or target switch. Once water is selected and the target switch is depressed, a delay timer is initialized, and a request is made by HMI board 324 (shown in FIG. 8) to turn on the dispenser light. The delay timer will be reset if the target switch is released. The request to dispense water from HMI board 324 (shown in FIG. 8) is transmitted to the communications port to open water valve 350 (shown in FIGS. 9A and 9B). Main control board 326 (shown in FIGS. 8-9B) acknowledges the request, closes the water relay and commands water valve 350 open. When the water relay is closed, the timer is reset and watchdog timer in the dispenser is activated. When the timer expires, main control board 326 opens the water relay (not shown) and water valve 350 is closed.

If the user releases the target switch during dispensing or the freezer door is opened, the water relay will be opened. Initially, HMI board 326 (shown in FIG. 8) requests the communication port to open all relays and turn off the dispenser light. HMI board 324 then sends a message to the communication port to close the water relay. The controller board responds by closing the water relay and opening water valve 350. If freezer door 134 (shown in FIG. 1) is opened after the target switch is released, controller 320 (shown in FIG. 8) will open the water relay and close water valve 350.

Figure 23:
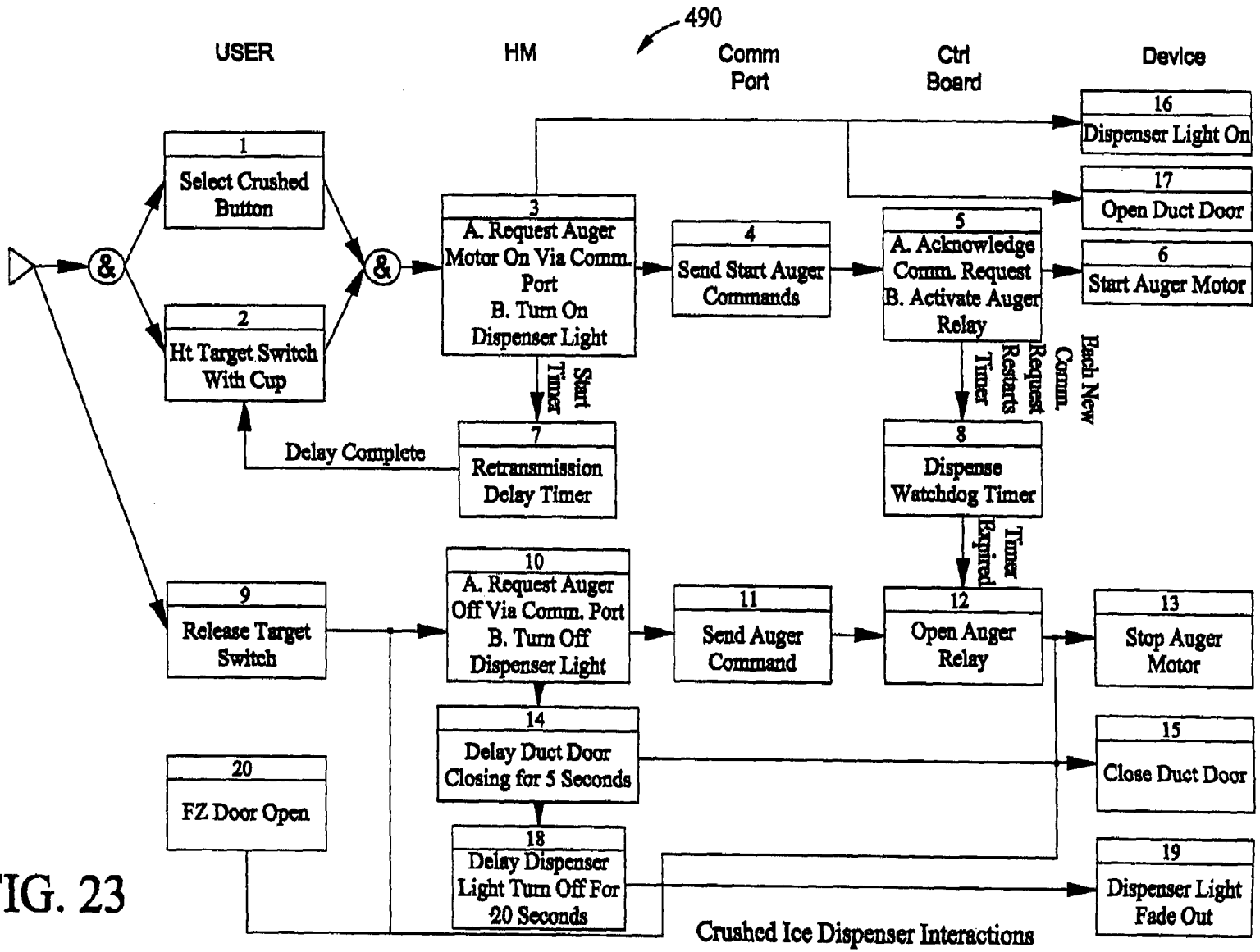
FIG. 23 is a crushed ice dispenser interactions diagram.

FIG. 23 is an exemplary crushed ice dispenser interactions diagram 490 that shows the interactions between a user, HMI board 324 (shown in FIG. 8), the communications port, and main control board 326 (shown in FIGS. 8-10) in controlling a light, a refrigerator duct door, and auger motor 346 (shown in FIGS. 9A and 9B) when a user selects crushed ice. To obtain crushed ice, the user first selects crushed ice by depressing the crushed ice button (see FIG. 11) on the control panel, and second, activates the target switch or cradle within the ice dispenser by depressing it with a cup or glass. HMI board 324 then sends a signal to open the dispenser duct door and turn on the dispenser light, and sends a request to the communications port to turn auger motor 346 (shown in FIG. 8) on and to start the delay timer. The delay timer functions to ensure the transmission from HMI board 324 to main control board 326 (shown in FIGS. 8-9B) is completed. The communications port then transfers the start auger command to main control board 326.

Main control board 326 acknowledges that it received the start auger command from HMI board 324 over the communications port and activates the auger relay to start auger motor 346. Control board 326 then restarts the delay timer and starts the watchdog timer of the dispenser. When the watchdog timer expires, the auger relay is opened, auger motor 346 is stopped.

If the target switch is released at any time during this process, HMI board 324 requests that the auger and the dispenser light be turned off and that the duct door be closed. Also, if the freezer door is opened auger motor 346 is stopped and the duct door is closed.

Figure 24:
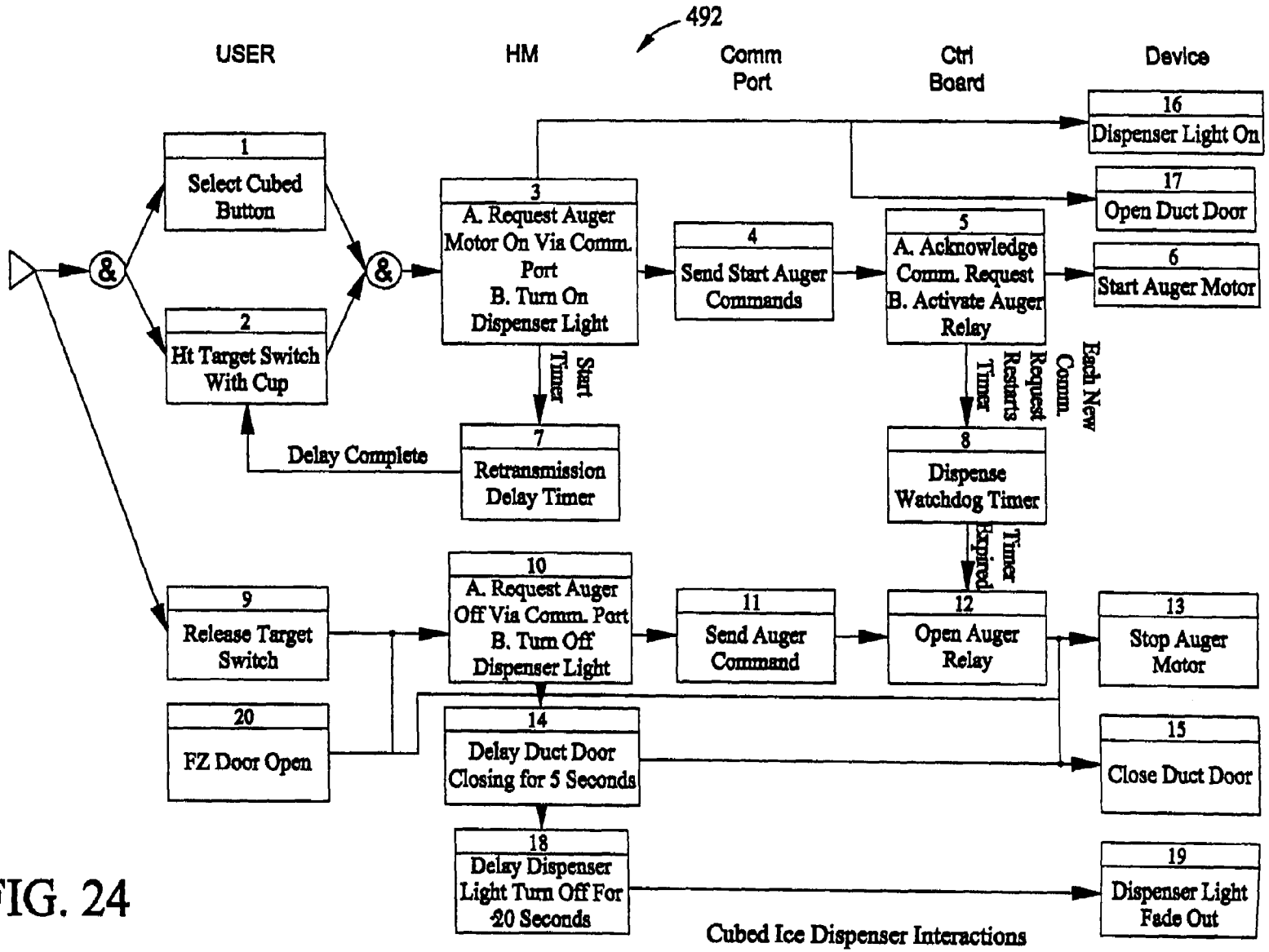
FIG. 24 is a cubed ice dispenser interactions diagram.

FIG. 24 is an exemplary cubed ice dispenser interactions diagram 492 that illustrates the interaction between a user, HMI board 324 (shown in FIG. 8), the communications port, and main control board 326 (shown in FIGS. 8-10) in controlling a light, a refrigerator duct door, and auger motor 346 (shown in FIG. 8) when a user selects cubed ice (see FIG. 15). To obtain cubed ice, the user first selects cubed ice by depressing the cubed ice button (shown in FIG. 15) on the control panel, and second, activates the target switch or cradle within the ice dispenser by depressing it with a cup or glass. HMI board 324 then sends a signal to open the door duct and turn on the dispenser light, and sends a request to the communications port to turn auger motor 346 on and to start the delay timer. The delay timer functions to ensure the transmission from HMI board 324 to main control board 326 is completed. The communications port then transfers the start auger command to main control board 326.

Main control board 326 acknowledges that it received the start auger command from HMI board 324 over the communications port and activates the auger relay to start auger motor 346. Main control board 326 then restarts the delay timer and starts the watchdog timer of the dispenser. When the watchdog timer expires, the auger relay is opened, auger motor 346 is stopped.

If the target switch is released at any time during this process, HMI board 324 will request auger motor 346 and the dispenser light be turned off and the duct door be closed. Also, if freezer door 132 (shown in FIG. 1) is opened, auger motor 346 is stopped and the duct door is closed.

Temperature Setting

Figure 25:
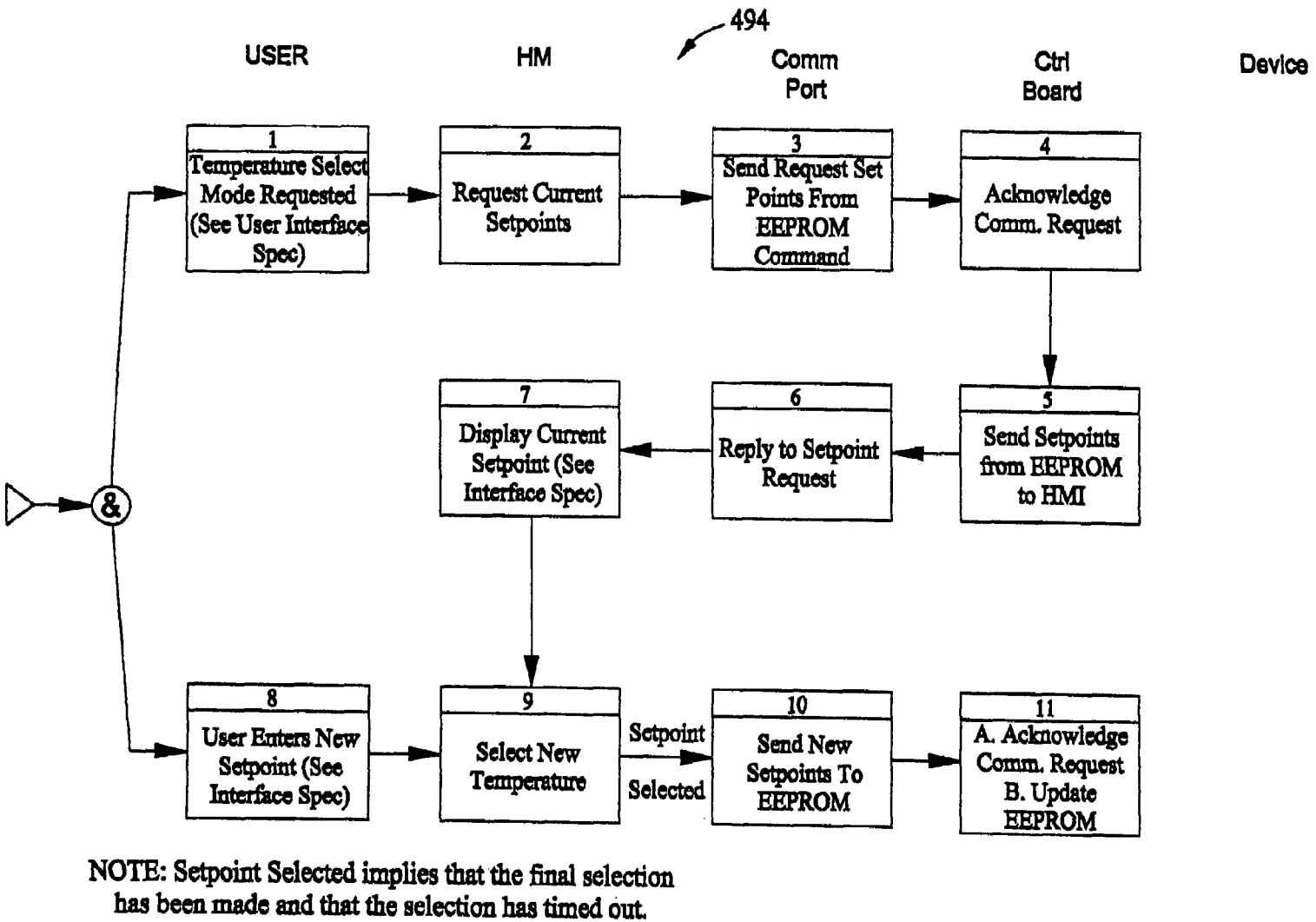
FIG. 25 is a temperature setting interaction diagram.

FIG. 25 is an exemplary temperature setting interaction diagram 494. When the user enters a temperature select mode as described above, HMI board 324 (shown in FIG. 8) sends a request via the communication port for current temperature setpoints, which are returned by main control board 326 (shown in FIGS. 8-10). HMI board 324 then displays the setpoints as described above. The user then enters new temperature setpoints by pressing slew keys (shown in FIGS. 16A-17 and described above). The new setpoints then are sent via the communication port to main control board 326, which updates EEPROM 376 (shown in FIGS. 9A and 9B) with the new temperature values.

Quick Chill Interaction

Figure 26:
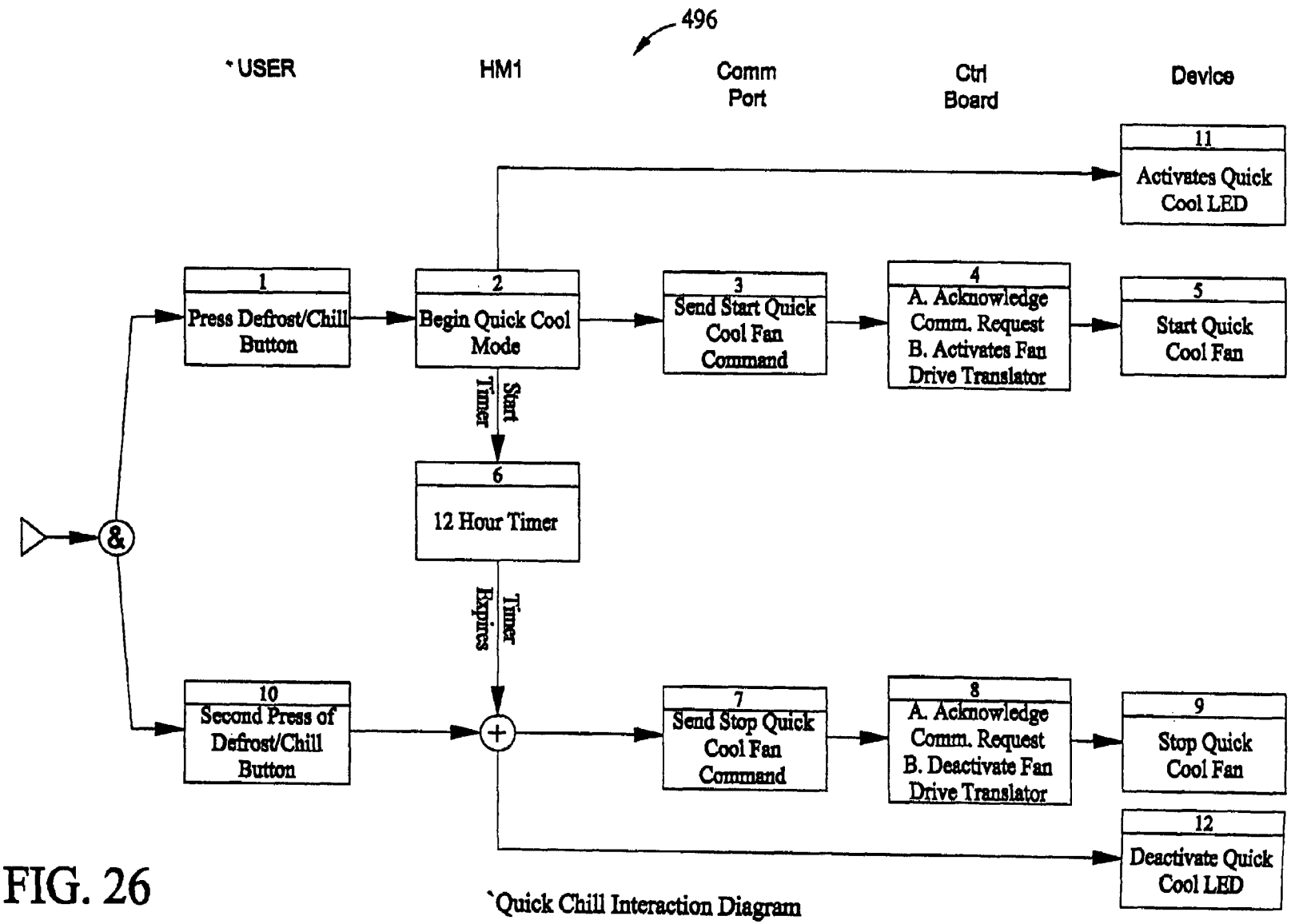
FIG. 26 is a quick chill interaction diagram.

FIG. 26 is an exemplary quick chill interaction diagram 496 illustrating the response of HMI board 324 (shown in FIG. 8), communication port, main control board 326 (shown in FIGS. 8-10), and a quick chill device in reaction to user input. In the exemplary embodiment, when the user desires activation of quick chill system 160 (shown in FIG. 2) a user presses a Chill button (shown in FIGS. 16A-17), which begins quick chill mode of system 160, sets a timer, and activates a Quick Chill LED indicator. A signal is sent to the communications port to request start quick chill system fan 274 (shown in FIGS. 4-6 and described above) and position dampers 260, 266 (shown in FIGS. 4-6 and described above), the request is acknowledged and the fan drive transistor and damper drive bridges are activated to start quick chill cooling (described above in relation to FIGS. 4-7) in a quick chill system pan 122 (shown in FIGS. 1-2 and described above). When the timer expires, or upon a second press of the Chill button by the user, a signal is sent to request a stop of quick chill system fan 274 and to position dampers 206, 266 appropriately, the request is acknowledged, fan 274 is deactivated to stop cooling in quick chill pan 122, and the quick chill cooling system LED is deactivated.

Turbo Mode Interaction

Figure 27:
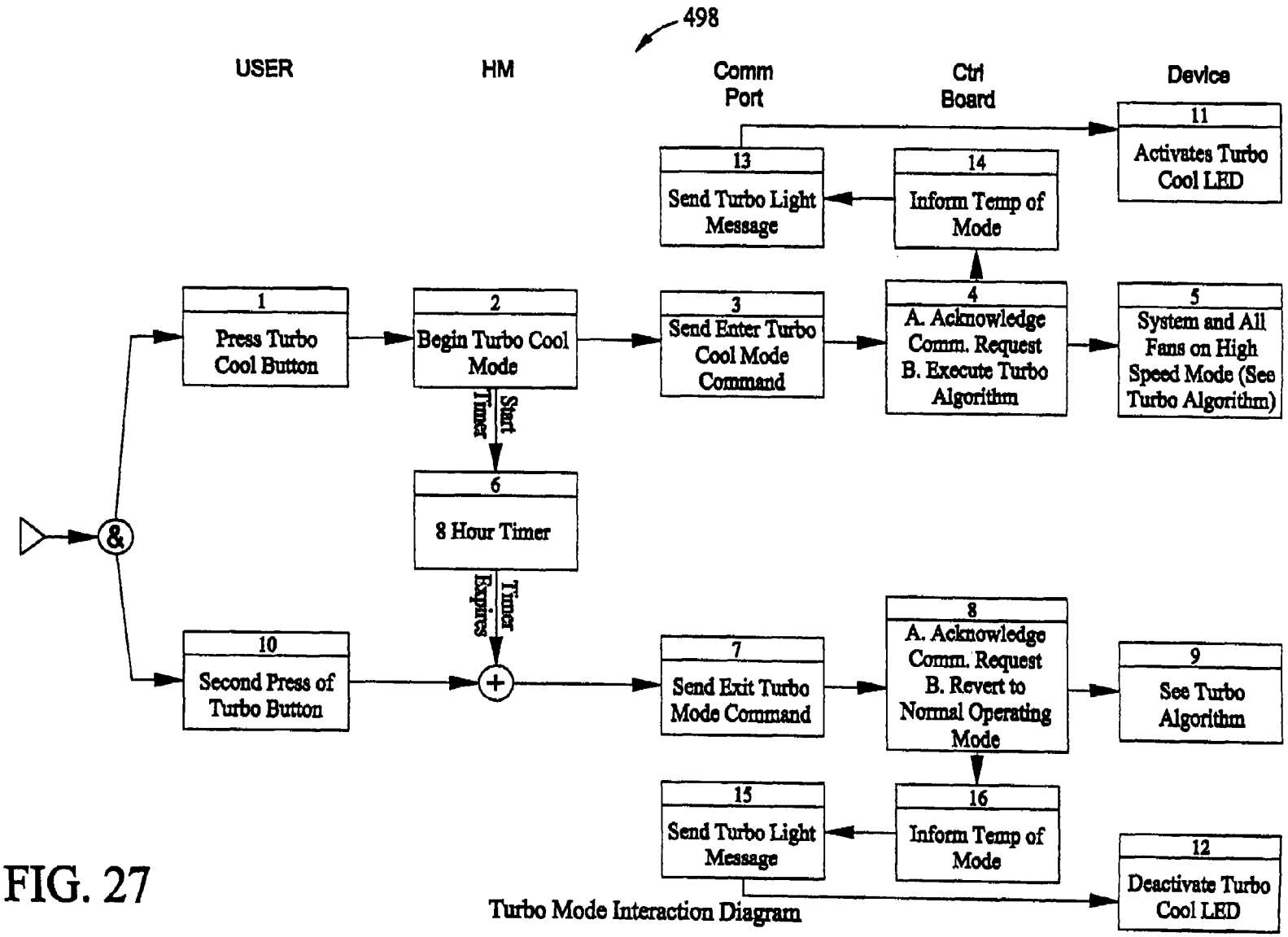
FIG. 27 is a turbo mode interaction diagram.

FIG. 27 is an exemplary turbo mode interaction diagram 498 that illustrates the interaction between a user, HMI board 324 (shown in FIG. 8), the communications port, and main control board 326 (shown in FIGS. 8-10) in controlling the turbo mode system. The user depresses the turbo cool button (shown in FIGS. 16A-17) and HMI board 324 places the refrigerator in the turbo cool mode and starts an eight hour timer. HMI board 324 sends a turbo cool command over the communications port to main control board 326 (shown in FIGS. 8-10). Main control board 326 acknowledges the request and executes the turbo cool algorithm. In addition main control board 326 activates the turbo cool LED. The refrigerator system and all fans are turned on high speed mode according to the turbo cool algorithm.

If the user depresses the turbo cool button a second time, or when the eight hour timer has expired, the communications port will send an exit turbo mode command to main control board 326. Main control board 326 will acknowledge the command request and place the refrigerator in normal operating mode and deactivate the turbo cool LED.

Freshness Filter

Figure 28:
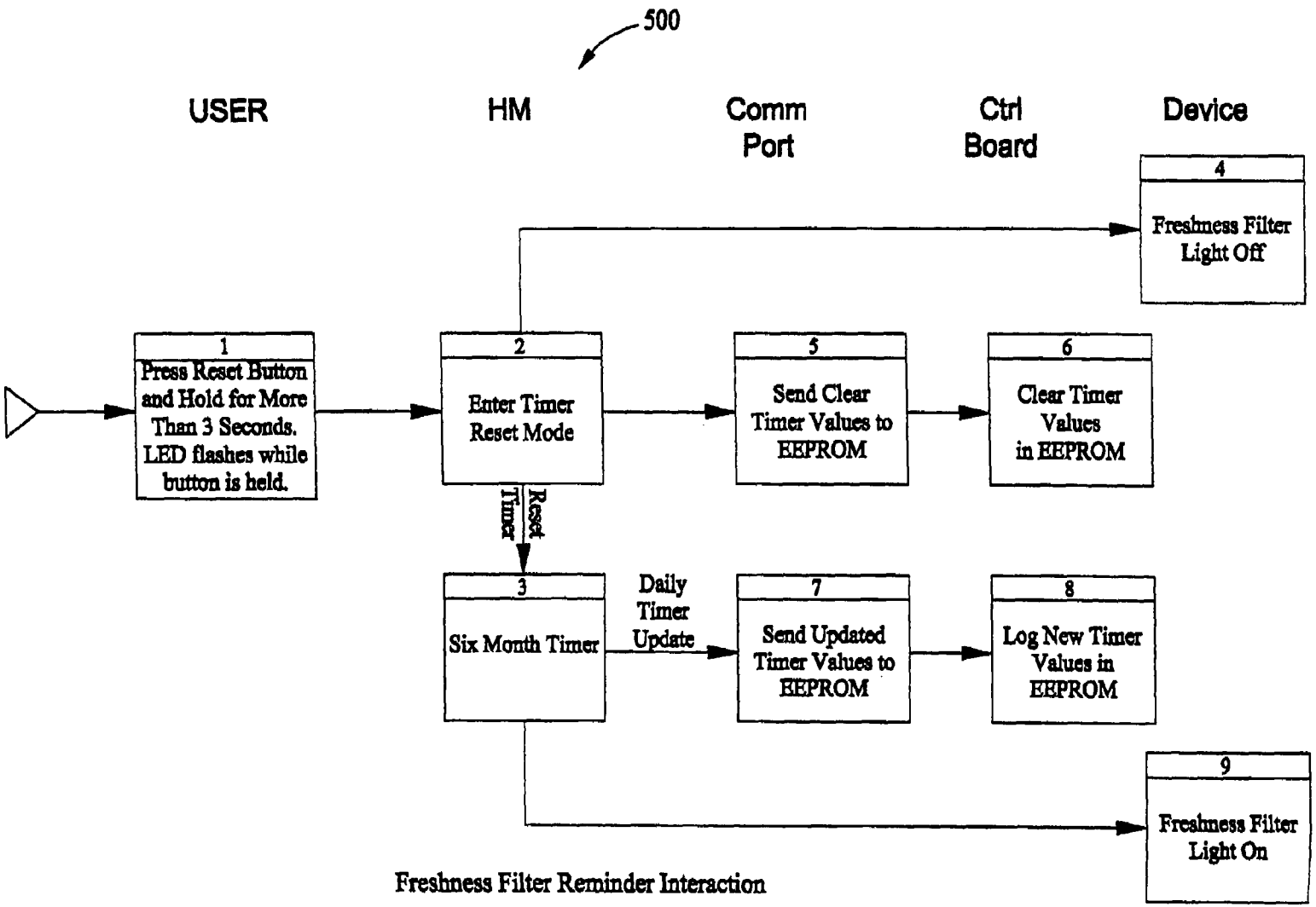
FIG. 28 is a freshness filter reminder interaction diagram.

FIG. 28 is an exemplary freshness filter reminder interaction diagram 500 that illustrates the interactions between a user, HMI board 324 (shown in FIG. 8), the communications port, and main control board 326 (shown in FIGS. 8-10) in controlling the freshness filter light (shown in FIGS. 16A-17). A user depresses and holds the freshness filter restart button (shown in FIGS. 16A-17) for at least three seconds until the LED flashes. HMI board 324 places the refrigerator filter reminder to timer reset mode, turns the freshness filter light off, and sends a command across the communication port to main control board 326 to clear timer values in the Electrically Erasable Programmable Read Only Memory (EEPROM) 376 (shown in FIGS. 9A and 9B).

HMI board 324 also resets the freshness filter timer for a period of at least six months. When the time period expires, the freshness filter light on the refrigerator is turned on. On a daily basis, HMI board 324 updates timer values based on the six month timer. The daily timer updates are transferred by HMI board 324 through the communications port to main control board 326, where the daily timer updates are logged as new timer values in the EEPROM 376 (shown in 9 FIGS. 9A and 9B).

Water Filter

Figure 29:
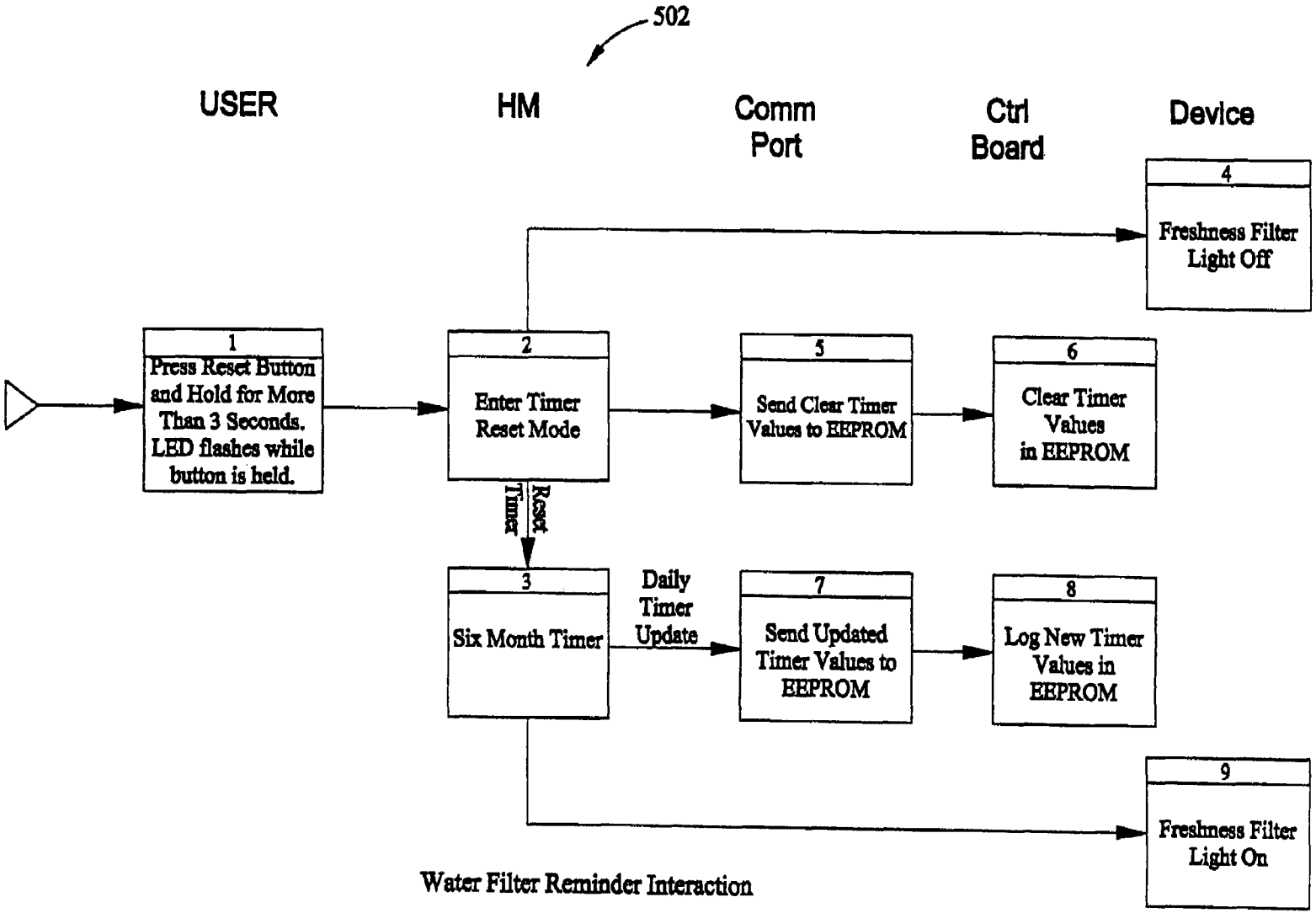
FIG. 29 is a water filter reminder interaction diagram.

FIG. 29 is an exemplary water filter reminder interaction diagram 502 that illustrates the interaction between a user, HMI board 324 (shown in FIG. 8), the communications port, and main control board 326 (shown in FIGS. 8-10) in reminding the user that the water filter needs to be replaced by controlling the water filter light (shown in FIGS. 16A-17). A user depresses and holds the water filter restart button 464 (shown in FIGS. 16A-17) for a predetermined time, such as for at least three seconds in an exemplary embodiment, until the LED flashes. HMI board 324 places the refrigerator filter reminder to timer reset mode, turns the water filter light off, and sends a command across the communication port to main control board 326 to clear timer values in the Electrically Erasable Programmable Read Only Memory (EEPROM) 3769 (shown in FIGS. 9A and 9B).

HMI board 324 also resets the water filter timer for a period of at least six months. When the time period expires, the water filter light on the refrigerator is turned on to remind the user to replace the water filter. On a daily basis, HMI board 324 updates timer values based on the timer. The daily timer updates are transferred by HMI board 324 through the communications port to main control board 326 (shown in FIGS. 8-10), where the daily timer updates are logged as new timer values in the EEPROM 376 (shown in FIGS. 9A and 9B).

Door Interaction

Figure 30:
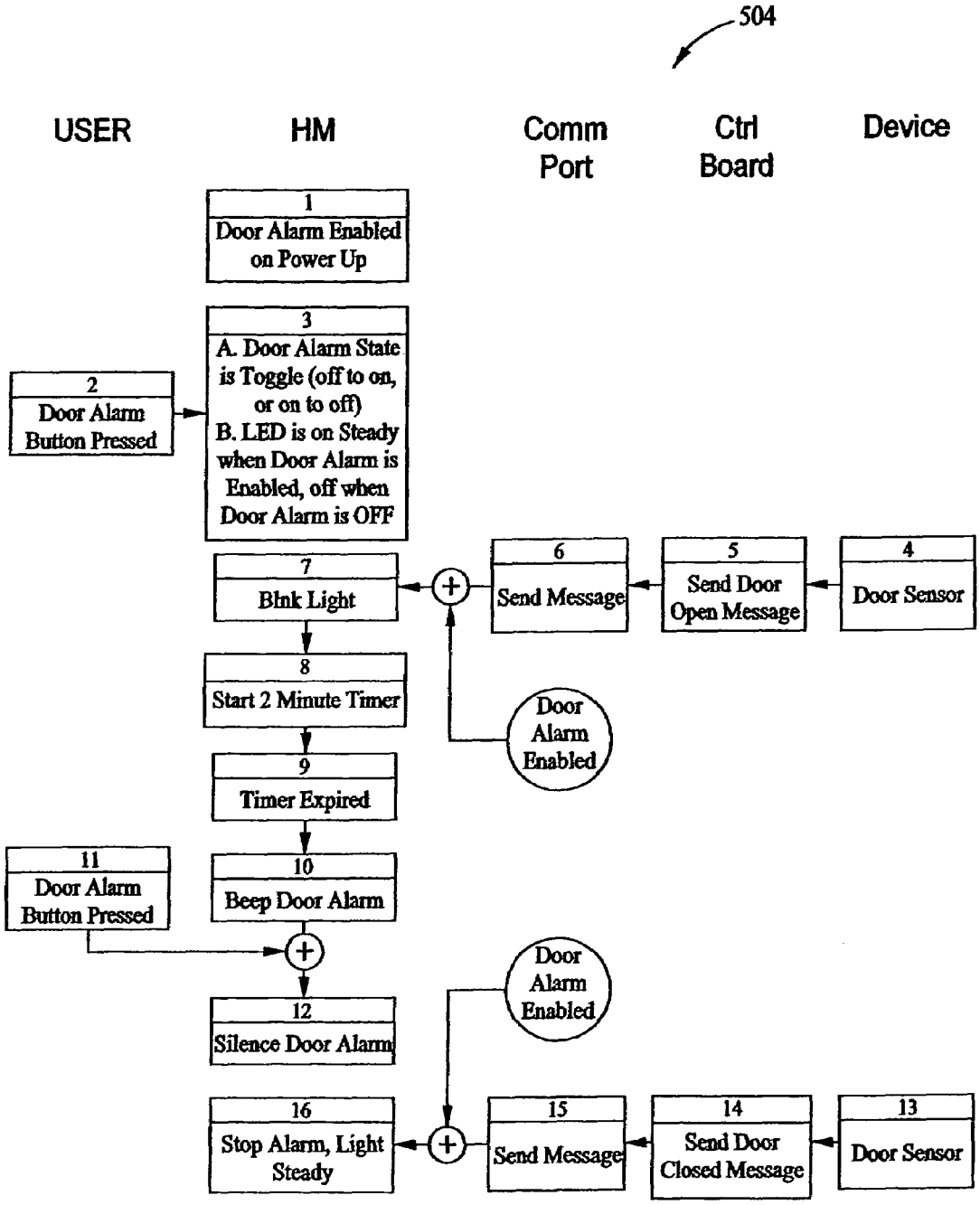
FIG. 30 is a door open interaction diagram.

FIG. 30 is an exemplary door open interaction diagram 504 that illustrates the interaction between a user, HMI board 324 (shown in FIG. 8), the communications port, and main control board 326 when a refrigerator door is opened or the door alarm button (shown in FIG. 15) is depressed. The door alarm is enabled on power up on HMI board 324. If the user depresses the door alarm button, the door alarm state is toggled on/off. The LED is on-steady when the door alarm is enabled and off when the door alarm is off.

A door sensor input 358 (shown in FIG. 8) sends a signal to main control board 326 (shown in FIGS. 8-10) when a door is opened or closed. If the door is opened, main control board 326 sends a door open message along with the door alarm state enabled across the communications port to HMI board 324 to blink the door alarm light (see FIG. 15). HMI board 324 then starts a timer at least two minutes in duration. When the timer expires, the door alarm beeps until the user depresses the door alarm button, which silences the door alarm. If the door is closed, main control board 326 sends a door closed message along with the door alarm state enabled across the communications port to HMI board 326 to stop the door alarm, turn the light to a solid on condition, and enable the door alarm.

Sealed System State

Figure 31:
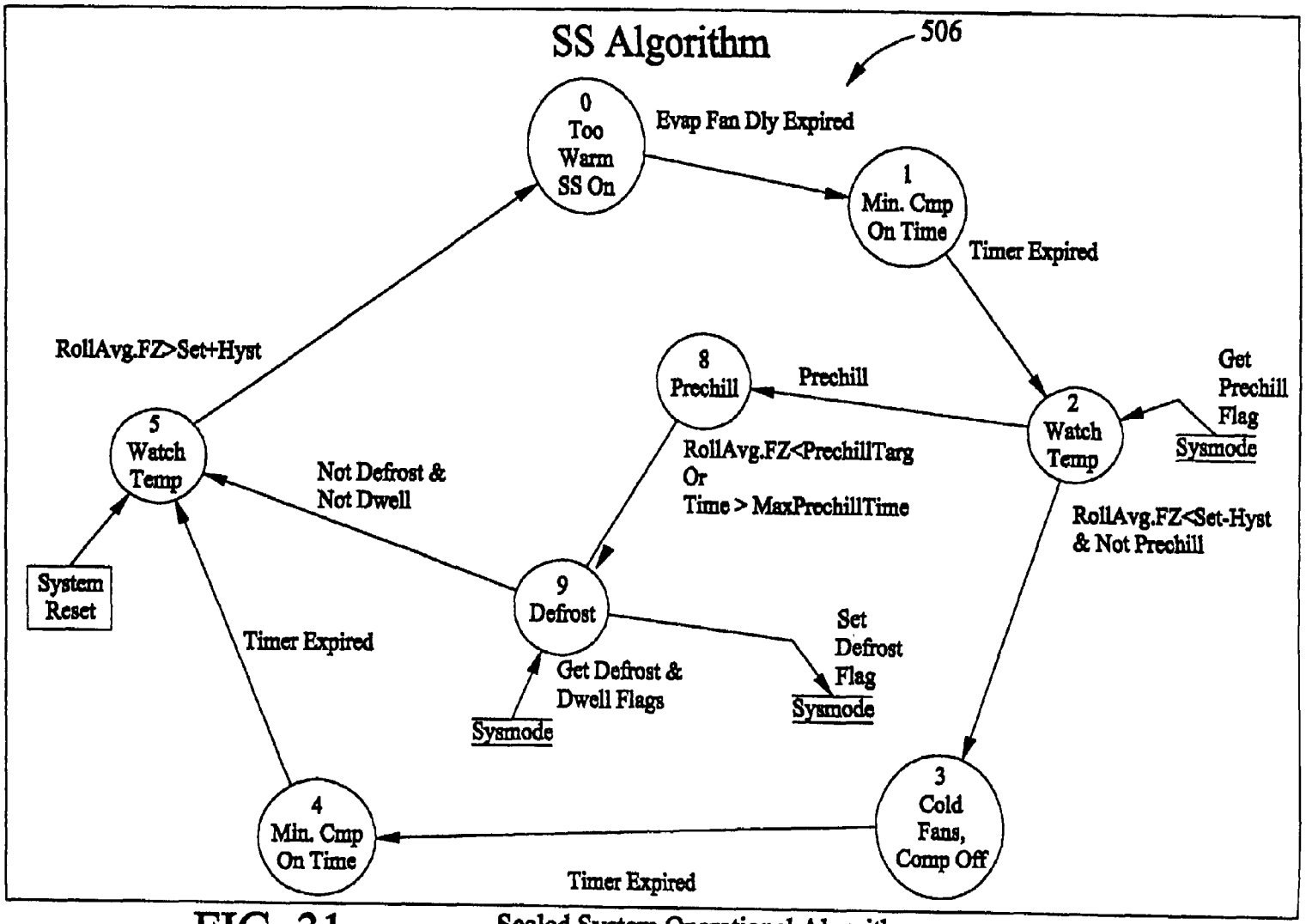
FIG. 31 is a sealed system operational state diagram.

FIG. 31 is an exemplary operational state diagram 506 of one embodiment of a sealed system. Referring to FIG. 31, the sealed system turns on (at state 0) when freezer temperature is warmer than the set temperature plus hysteresis as further described below. After an evaporator fan delay, the compressor is set to run (at state 1) for a pre-determined time, after which the freezer temperature is checked (at state 2). If the freezer temperature is colder than the set temperature minus hysteresis and prechill has not been signaled as further described below, the compressor and fans are switched off (at state 3) for a set time (state 4). The freezer temperature is checked again (at state 5) and, if it is warmer than the set temperature plus hysteresis, the sealed system once again is at state 0. However, if prechill is signaled while at state 2, prechill (state 8) is entered until the freezer temperature is greater than the prechill target temperature or until maxprechill times out, then defrost (state 9) is entered. Defrost is maintained until dwell flags and defrost flags expire.

Dispenser Control

Figure 32:
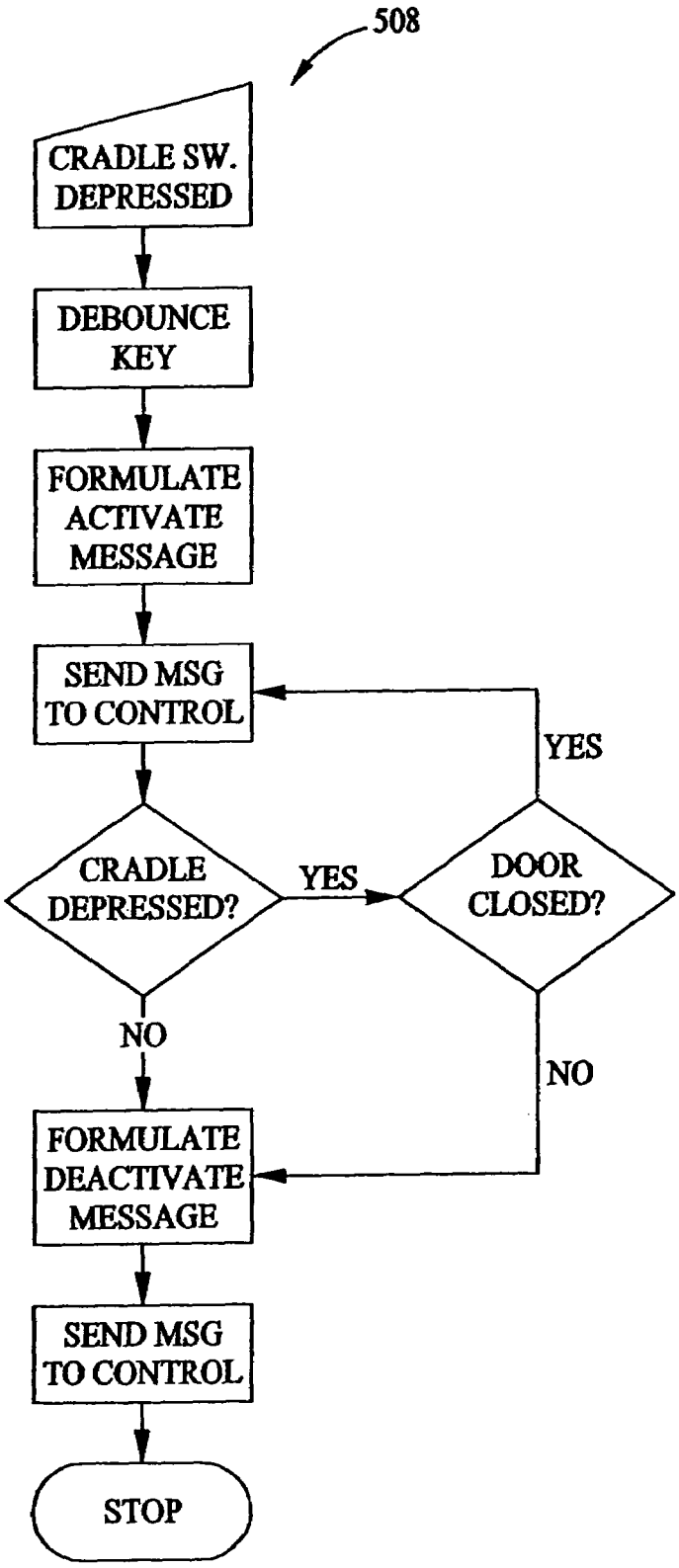
FIG. 32 is a dispenser control flow chart.

FIG. 32 is an exemplary dispenser control flow chart 508 for a dispenser control algorithm. The algorithm begins when a cradle switch is depressed. The cradle switch key is electronically debounced and an activate message is formulated for the dispenser. The message is sent to main control board 326 (shown in FIGS. 8-10), which checks if the cradle has been depressed and if the door is closed. If the cradle is depressed and the door is closed, the dispenser remains activated. When controller 320 (shown in FIG. 8) finds the cradle released or the door open, a deactivate message is formulated. The deactivate message is then sent to the dispenser to stop operation.

Defrost Control

Figure 33:
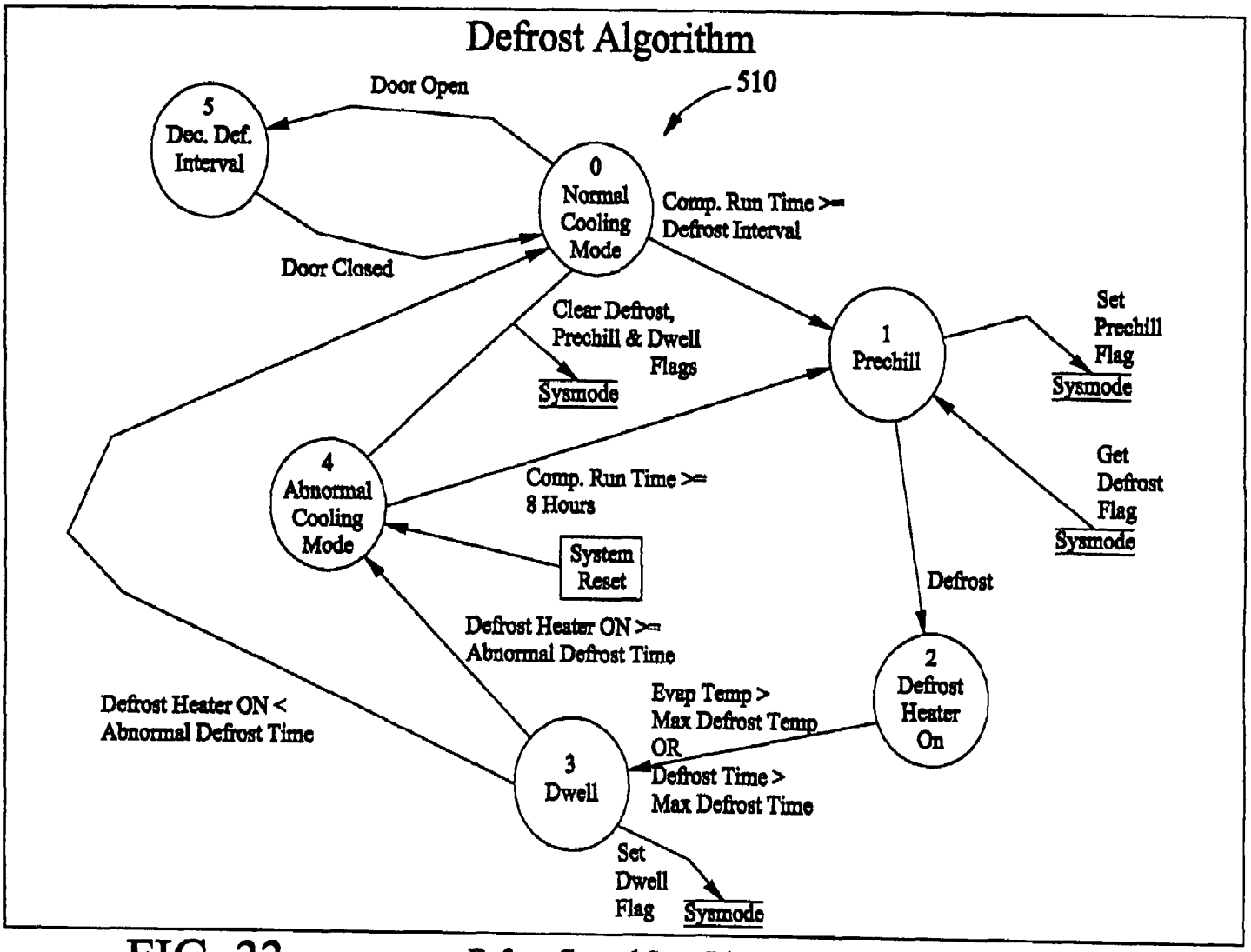
FIG. 33 is a defrost and sealed system interaction diagram.

FIG. 33 is an exemplary flow diagram 510 for a defrost control algorithm. The algorithm begins with refrigerator 100 in a normal cooling mode (state 0) and when the compressor run time is greater than or equal to a defrost interval prechill (state 1) is entered. Defrost is performed by turning the heater on (state 2) and keeping the heater on until the evaporator temperature is greater than the max defrost temperature or defrost time is greater than max defrost time. When defrost time expires dwell (state 3) is entered and a dwell flag is set. If the defrost heater was on for a period of time less than required, system returns to normal cooling mode (state 0). However, if the defrost heater was on longer than the normal defrost time, abnormal defrost interval begins (state 4). Abnormal cooling can also begin if refrigerator 100 is reset. From abnormal cooling mode, system can either enter normal cooling or enter prechill if compressor run time is greater than 8 hours. On entering normal cooling mode (state 0) defrost, prechill, and dwell flags are cleared. Also, if the door is opened the defrost interval is decremented.

Figure 34:
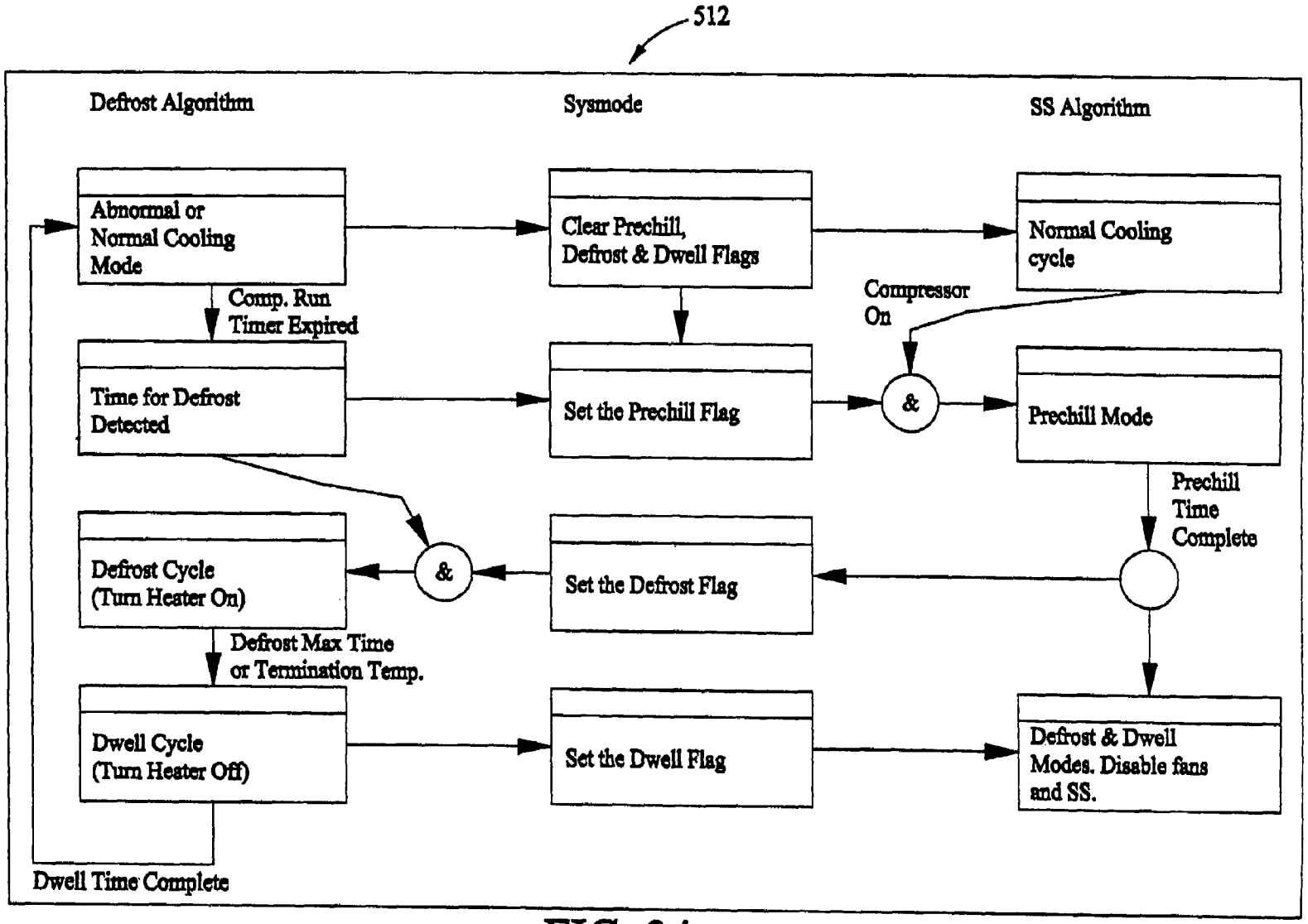
FIG. 34 is a defrost flow diagram.

FIG. 34 is an exemplary flow diagram 512 for a defrost flow diagram. The diagram describes the relationship between the defrost algorithm, the system mode, and the sealed system algorithm. Standard operation for refrigerator 100 is in the normal cooling cycle as described above. For defrost, when a compressor is turned on, the sealed system enters a prechill mode. When prechill time expires, a defrost flag is set and sealed system enters defrost and dwell modes, and the fans are disabled. If refrigerator 100 is in defrost cycle, the heater is turned on and a defrost flag has been set. When the defrost maximum time is reached, the defrost cycle is terminated with the heater turned off and the dwell cycle initiated. A dwell flag is set while in the dwell cycle and the fans are disabled. When dwell time is completed, abnormal cooling mode is entered and the compressor is turned on until a timer expires. While in abnormal cooling mode, the prechill, defrost, and dwell flags are cleared. When the timer expires, a time for defrost is detected, but the defrost state is not entered until the prechill flag has been set prechill executed and the defrost flag set. When the defrost function is terminated by reaching the termination temperature, a normal cooling cycle is executed.

Fan Speed Control

Figure 35:
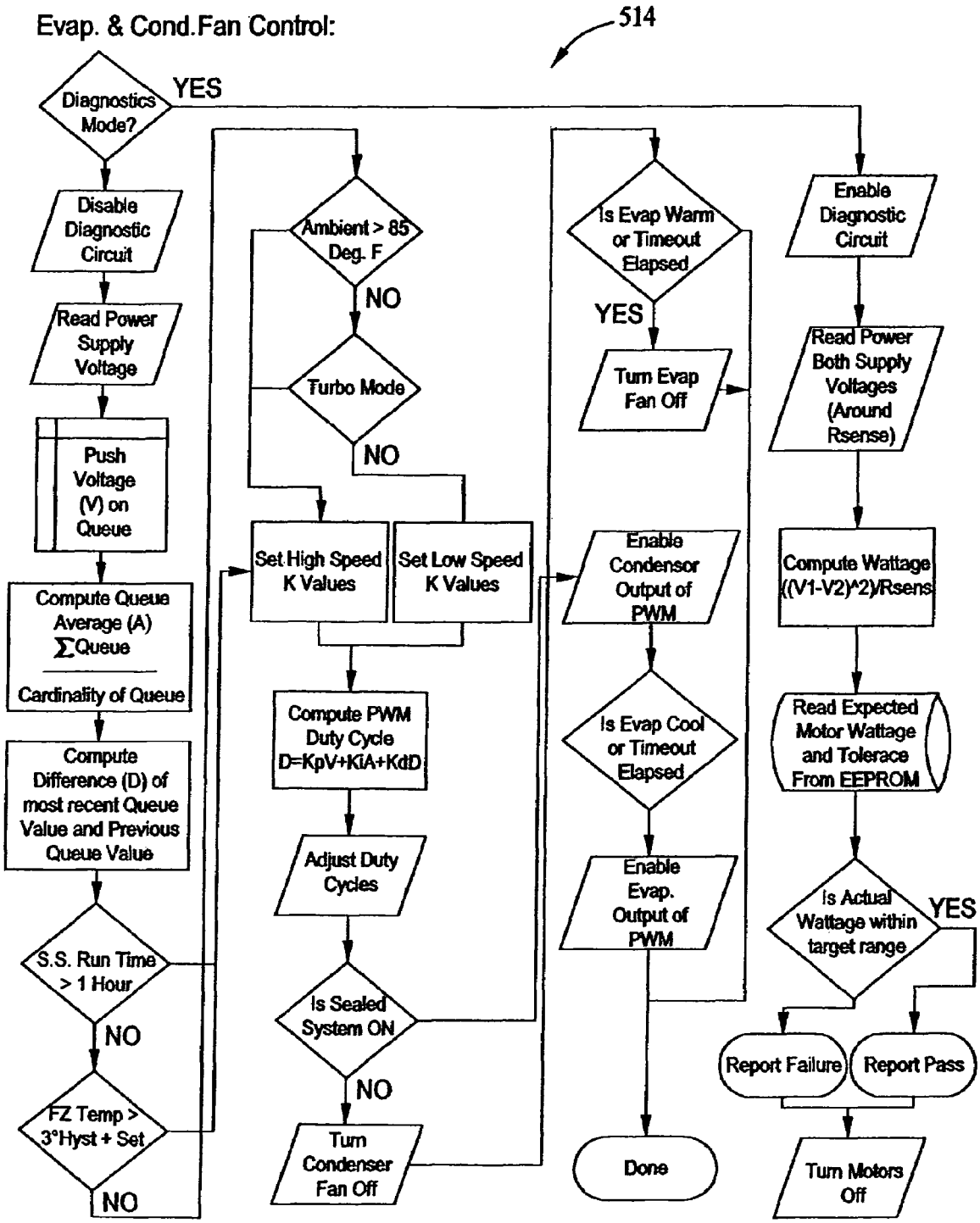
FIG. 35 is a fan speed control flow diagram.

FIG. 35 is an exemplary flow diagram 514 of one embodiment of a method for evaporator and condenser fan. When a diagnostic mode has not been specified, the speed control circuit is switched, as described above, so that its diagnostic capability is disabled. A power supply voltage value V is read and pushed into a queue of previously read voltage values. A running average A of the queue is calculated. A difference D between the most recent queue value and the previous queue value also is calculated.

K values, i.e. controls Kp, Ki, and Kd, then are set as either high or low-depending on, e.g. freezer compartment and ambient temperatures, sealed system run time, and whether the refrigerator is in turbo mode. A PWM duty cycle then is set in accordance with the relationship:

$$D=K_pV+K_iA+K_dD \tag{2}$$

If the sealed system is turned on, the condenser fan is enabled to the output of the pulse width modulator and the evaporator may be checked, depending on the mode setting, to see it is cool or the timeout has elapsed, and the evaporator fan is enabled. Otherwise, the evaporator fan is enabled. If the sealed system is turned off, the condenser fan is turned off, and the evaporator is checked, depending on the mode setting, to see if it is warm or the timeout has elapsed. The evaporator fan is turned off.

When a diagnostic mode has been specified, the circuit diagnostic capability is enabled as described above. Both voltages around resistor Rsense are read and motor power is calculated in accordance with the relationship:

$$(V_1-V_2)^2/\text{Rsens} \tag{3}$$

An expected motor wattage and tolerance are read from EEPROM 376 (shown in FIGS. 9A and 9B) and are compared to the actual motor power to provide diagnostic information. If the actual wattage is not within the target range, a failure is reported. Upon completing the diagnostic mode, the motor is turned off.

Turbo Mode Control

Figure 36:
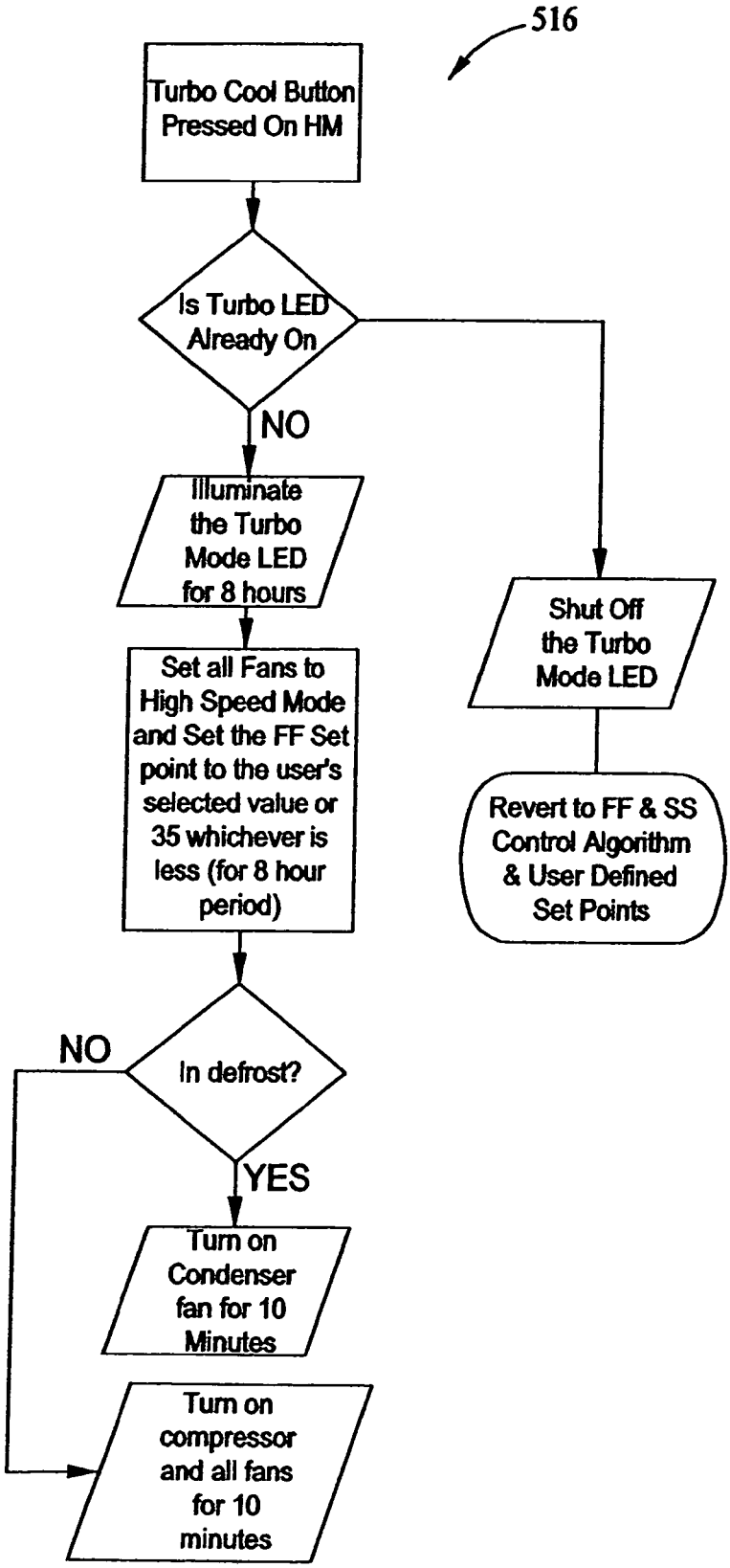
FIG. 36 is a turbo cycle flow diagram.

FIG. 36 is an exemplary turbo cycle flow diagram 516. To begin, a user depresses the turbo cool button (shown in FIGS. 16A-17) which is electrically connected to HMI board 324 (shown in FIG. 8). The condition is checked if the turbo LED is currently turned on. If the LED is turned on, the turbo mode LED is turned off, and the refrigerator is taken out of turbo mode by the control algorithm and the system reverts to the fresh food and sealed system control algorithms and user defined temperature set points.

If the turbo LED is not on when the user depressed the turbo button, the LED is illuminated for at least eight hours, and the refrigerator is placed in turbo mode. All fans are set to high speed mode and the refrigerator temperature fresh food temperature set point is set to the user's selected value, the value being less than or equal to 35° F., for at least an eight hour period. If the refrigerator is in defrost mode, the condenser fan is turned on for at least ten minutes; otherwise, the compressor and all fans are turned on for at least ten minutes.

Filter Reminder Control

Figure 37:
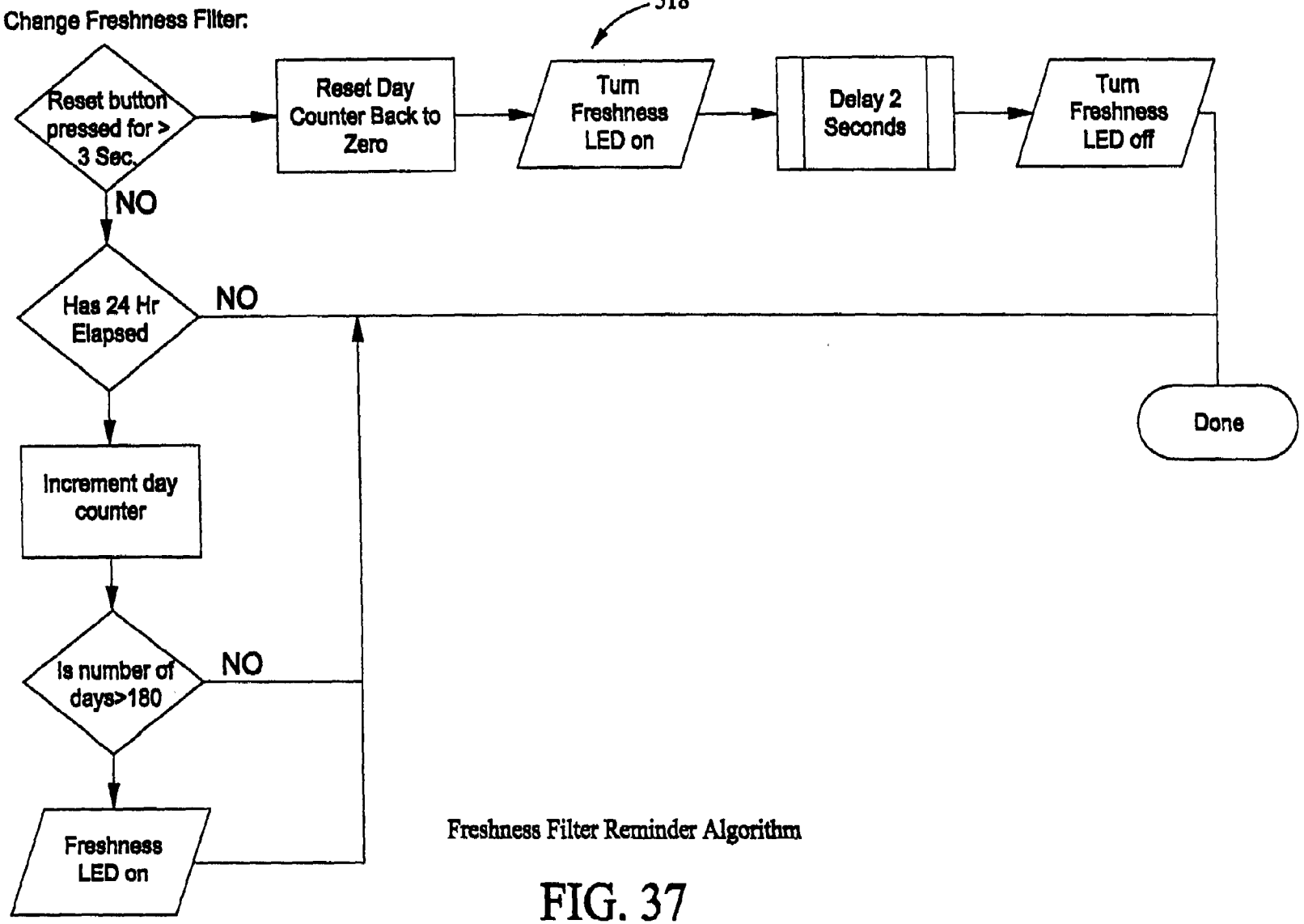
FIG. 37 is a freshness filter reminder flow diagram.

FIG. 37 is an exemplary freshness filter reminder flow diagram 518. The first condition checked is whether the reset button (shown in FIGS. 16A-17) has been depressed for greater than three seconds. If the reset button has been depressed, the day counter is reset to zero, the freshness LED is turned on for two seconds and then turned off. If the reset button has not been depressed, the amount of time elapsed is checked. If twenty-four hours has elapsed, the day counter is incremented, and the number of days since the filter was installed is checked. If the number of days exceeds 180 days, the freshness LED is turned on.

Figure 38:
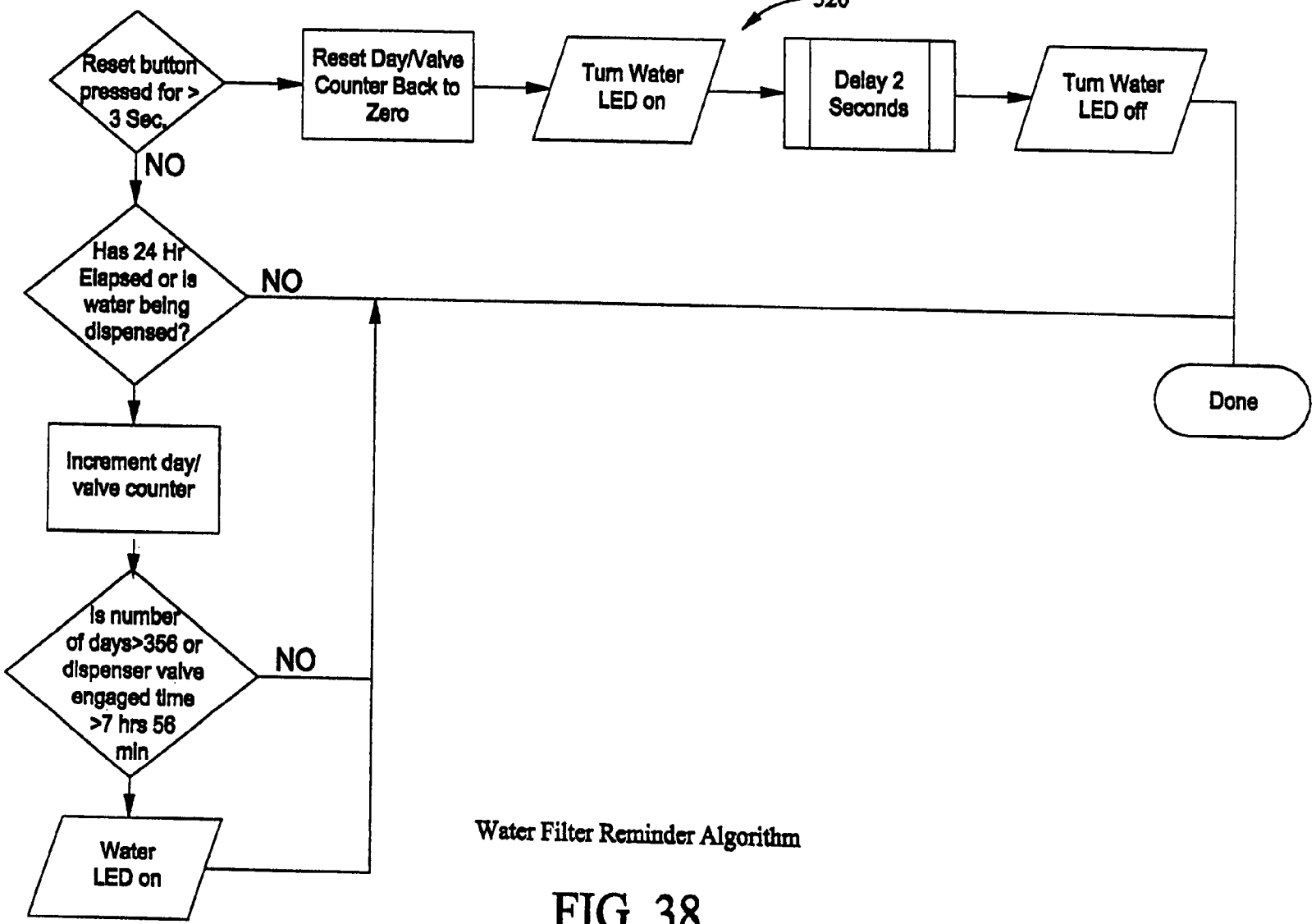
FIG. 38 is a water filter reminder flow diagram.

FIG. 38 is an exemplary water filter reminder flow diagram 520. The first condition checked is whether the reset button (shown in FIGS. 16A-17) has been depressed for greater than three seconds. If the reset button has been depressed, the day/valve counter is reset to zero, the water LED is turned on for two seconds and then turned off. If the reset button has not been depressed two conditions are checked: if twenty-four hours has elapsed or if water is being dispensed. If either condition is met, the day/valve counter is incremented and the amount of time the water filter has been active is checked. If the water filter has been installed in the refrigerator for more than 180 or 365 days, in exemplary alternative embodiments, or if the dispenser valve has been engaged for greater than a predetennined time, such as seven hours and fifty-six minutes in an exemplary embodiment, the water LED is turned on to remind the user to replace the water filter.

Sensor Calibration

Figure 39:
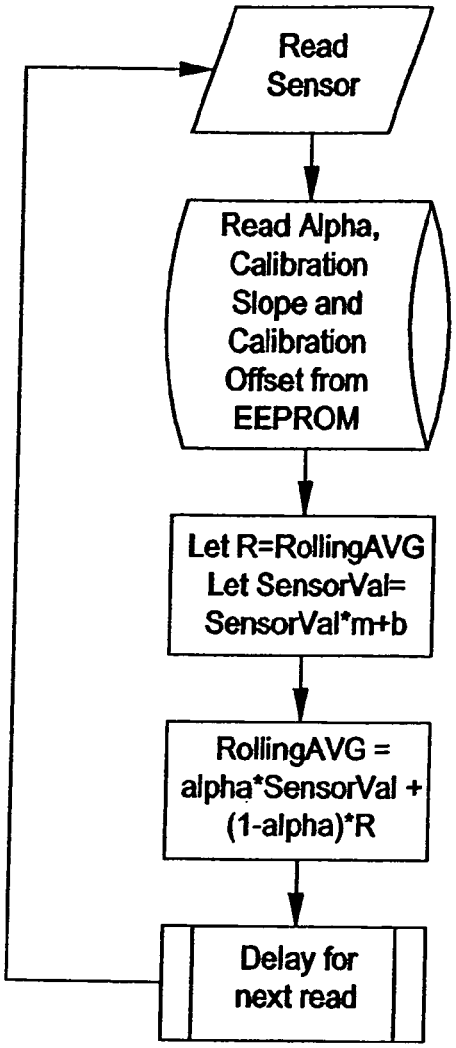
FIG. 39 is a sensor reading and rolling average algorithm.

FIG. 39 is an exemplary flow diagram of one embodiment of a sensor-read-and-rolling-average algorithm 522. For each sensor, a calibration slope m and offset b are stored in EEPROM 376 (shown in FIGS. 9A and 9B), along with an "alpha" value indicating a time period over which a rolling average of sensor input values is kept. Each time the sensor is read, the corresponding slope, offset and alpha values are retrieved from EEPROM 376. The slope m and offset b are applied to the input sensor value in accordance with the relationship:

$$\text{Sensor}Val=\text{Sensor}Val*m+b \tag{4}$$

The slope-and-offset-adjusted sensor value then is incorporated into an adjusted corresponding rolling average for each cycle in accordance with the relationship:

$$\text{Rolling}AVG_n=\text{alpha}*\text{Sensor}Val+(1-\text{alpha})*\text{Rolling}AVG_{(n-1)} \tag{5}$$

where n corresponds to the current cycle and (n−1) is the previous cycle.

Main Controller Board State

Figure 40:
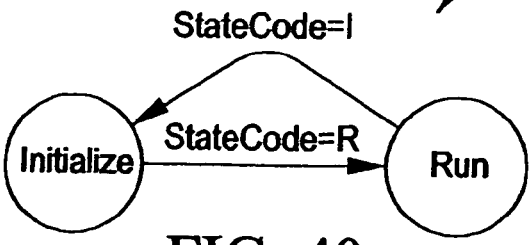
FIG. 40 illustrates control structure for the main control board.

FIG. 40 illustrates an exemplary control structure 524 for main control board 326 (shown in FIGS. 8-9B). Main control board 326 toggles between two states: an initial state (I) and a run state (R). Main control board 326 begins in the initialize state and moves to the run state when state code equals R. Main control board 326 will change from the run state back to the initialize state if state code equals I.

Figure 41A:
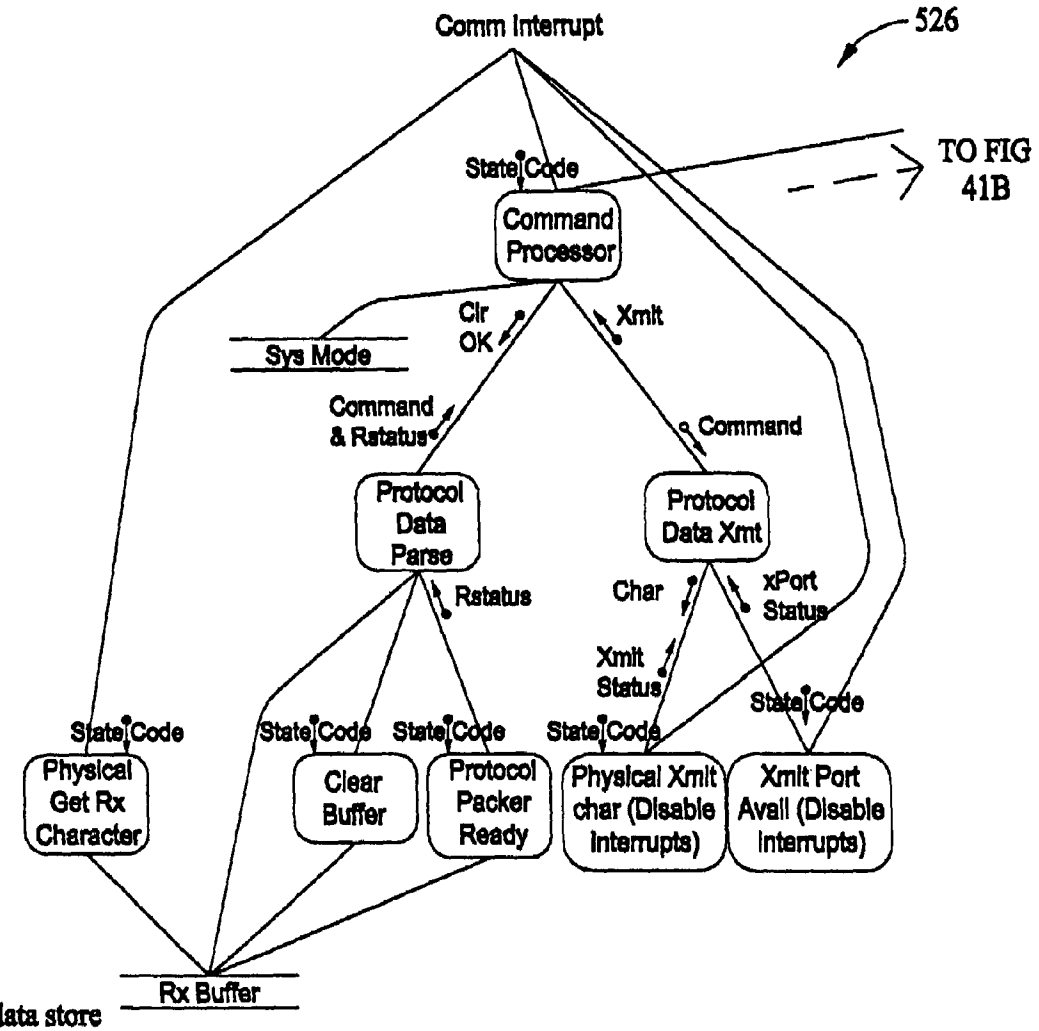
FIG. 41A is a first portion of a control structure flow diagram.
Figure 41B:
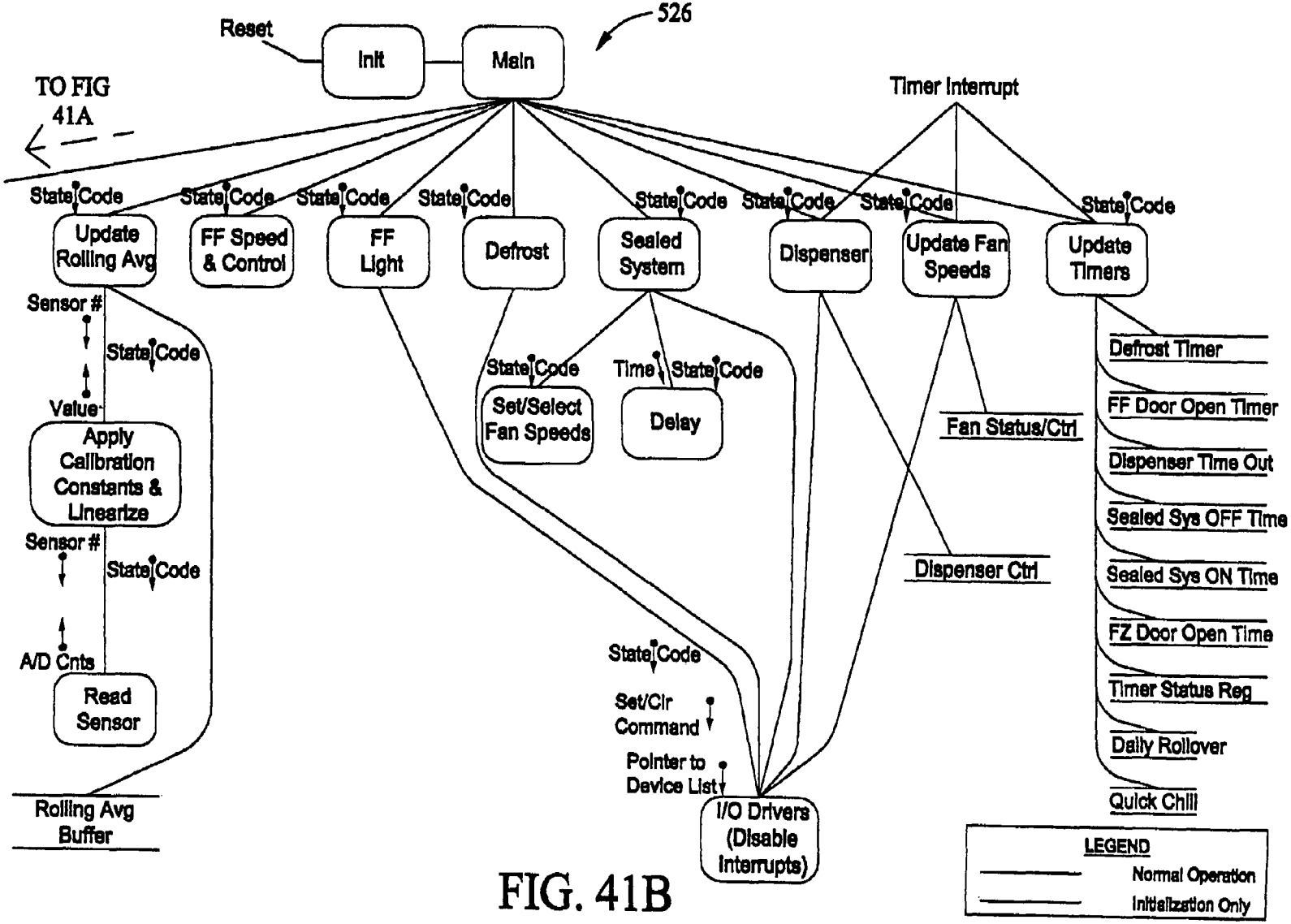
FIG. 41B is a second portion of a control structure flow diagram.

FIGS. 41A and 41B are an exemplary control structure flow diagram 526. The control structure is composed of an initialize routine and a main routine. The main routine interfaces with the command processor, update rolling average, fresh food fan speed and control, fresh food light, defrost, sealed system, dispenser, update fan speeds, and update times routines. Upon power-up, the command processor 370 (shown in FIGS. 9A and 9B), dispenser 396 (shown in FIGS. 9A and 9B), update fan speeds, and update times routines are initialized. The main routine during initialization provides state code information to the update time routine, which in turn updates the defrost timer, fresh food door open timer, dispenser time out, sealed system off timer, sealed system on timer, freezer door open timer, timer status flag, daily rollover, and quick chill data stores.

In normal operation, the command processor routine interfaces with the system mode data store. The command processor routine also transmits commands and receives status information from the protocol data transmit routine and protocol data pass routines. The protocol data pass routine exchanges status information with the clear buffer routine and the protocol packet ready routine. All three routines interface with the Rx buffer data store. The Rx buffer data store also interfaces with the physical get Rx character routine. The protocol data transmit routine exchanges status information with the physical transmit char routine and transmit port routine. A communication interrupt is provided to interrupt the command processor, physical get Rx character, Physical xmt character, and transmit port routines.

The main routine provides status information during normal operation with the update rolling average routine. The update rolling average routine interfaces with the rolling average buffer data store. This routine exchanges sensor numbers, state code and value with the apply calibration constants and linearize routine. The linearize routine exchanges sensor numbers, status code and analog-digital (A/D) information with the read sensor routine.

Also, the main routine during normal operation provides status information to the fresh food fan speed and control routine, fresh food light routine, defrost routine, and the sealed system routine.

The fresh food fan speed and control routine provides status code, set/clear command, and pointer to device list to the I/O drives routine. I/O drives routine further interfaces with the defrost, sealed system, dispenser, and update fan speeds routines.

The sealed system routine provides status code to the set/select fan speeds routine, and the sealed system routine provides time and state code information to the delay routine.

A timer interrupt interfaces with the dispenser, update fan speeds, and update times routines. The dispenser routine interfaces with the dispenser control data store. The update fan speeds routine interfaces with the fan status/control data store.

The main routine during initialization provides state code information to the update time routine, which in turn updates the defrost timer, fresh food door open timer, dispenser time out, sealed system off timer, sealed system on timer, freezer door open timer, timer status flag, daily rollover, and quick chill data stores.

Figure 42:
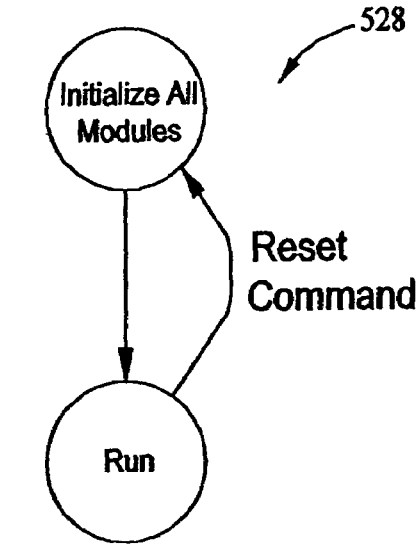
FIG. 42 is a state diagram for main control.

FIG. 42 is an exemplary state diagram 528 for main control. The HMI main state machine has two states: initialize all modules and run. After initialization, HMI board 324 (shown in FIG. 8) is in the run state unless a reset command occurs. The reset command causes the board to switch from the run state to the initialize all module state.

Interface Main State

Figure 43:
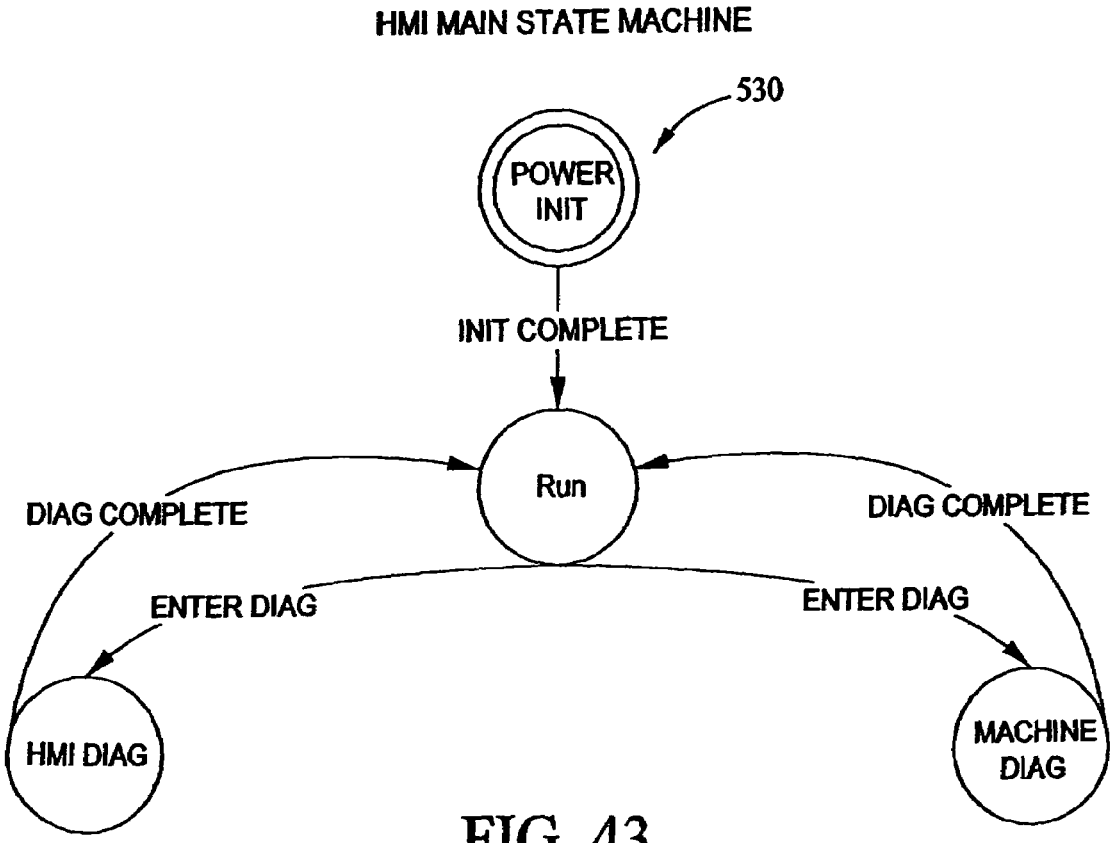
FIG. 43 is a state diagram for the HMI.

FIG. 43 is an exemplary state diagram 530 for the HMI main state machine. Once power initialization is complete, the machine is in a run state except when performing diagnosis. There are two diagnosis states: HMI diag and machine diag. Either HMI diag or machine diag are entered from the run state and when the diagnostic is completed, control is returned to the run state.

Figure 44A:
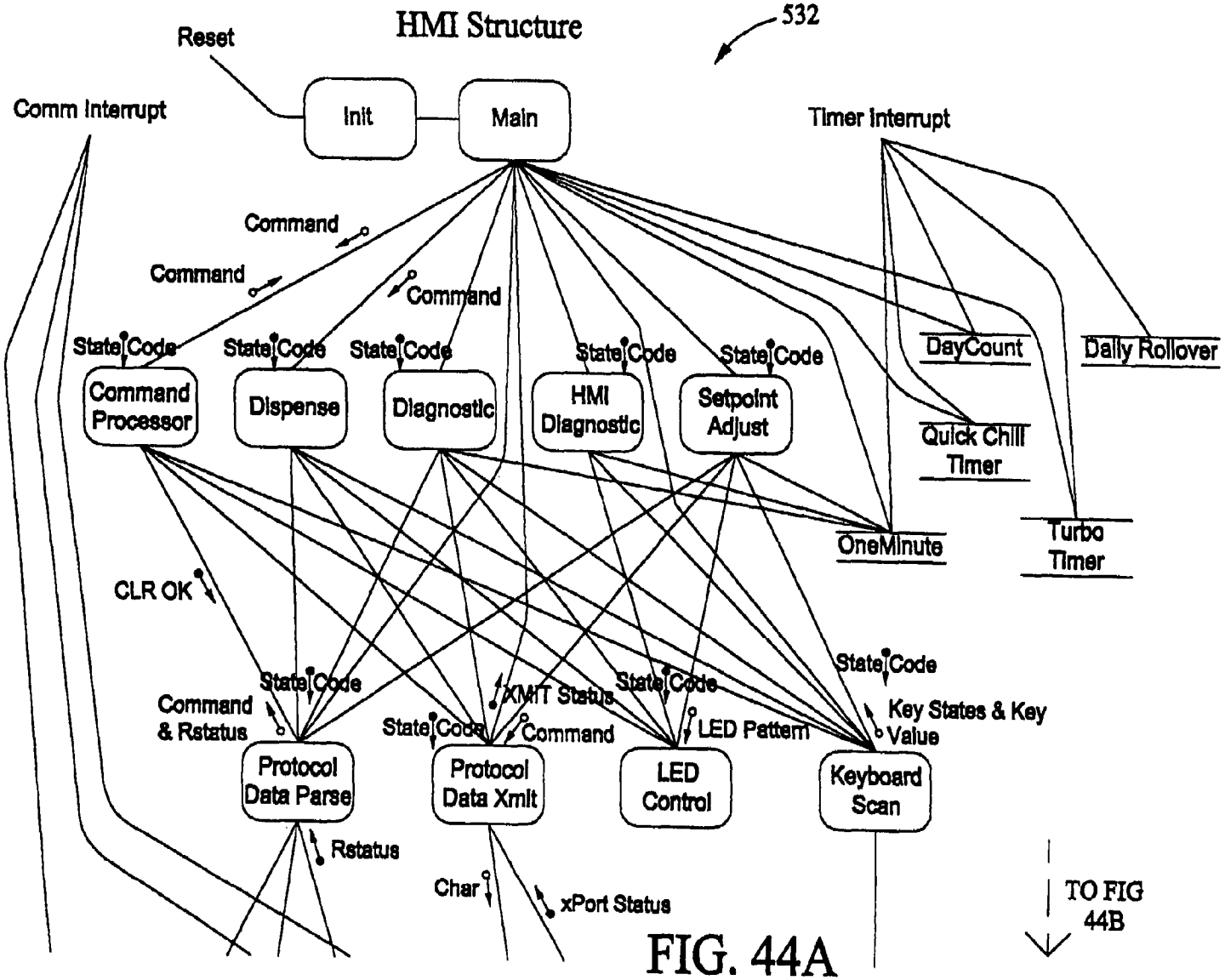
FIG. 44A is a first portion of a flow diagram for HMI structure.
Figure 44B:
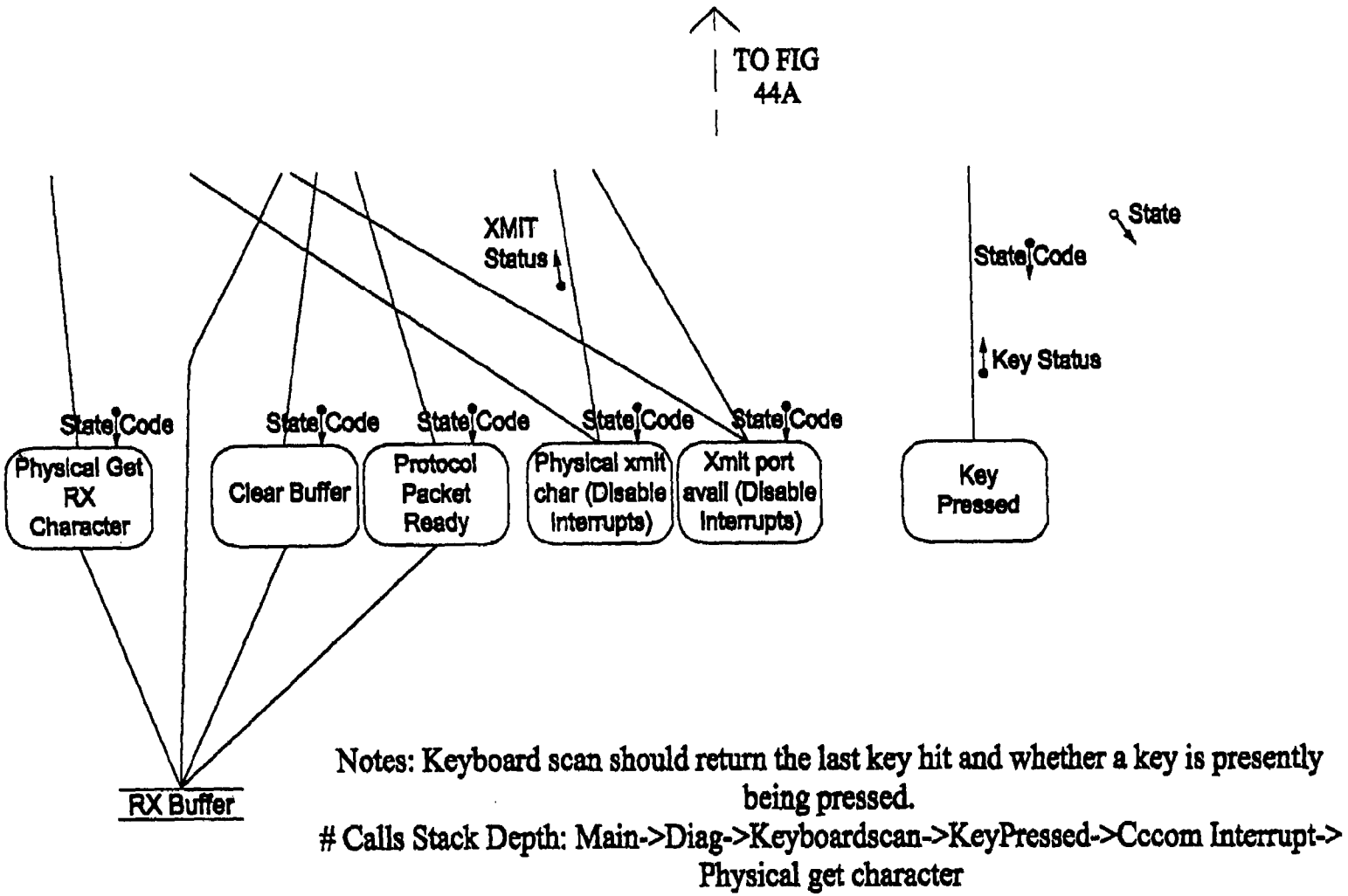
FIG. 44B is a second portion of a flow diagram for HMI structure.
Figure 45A:
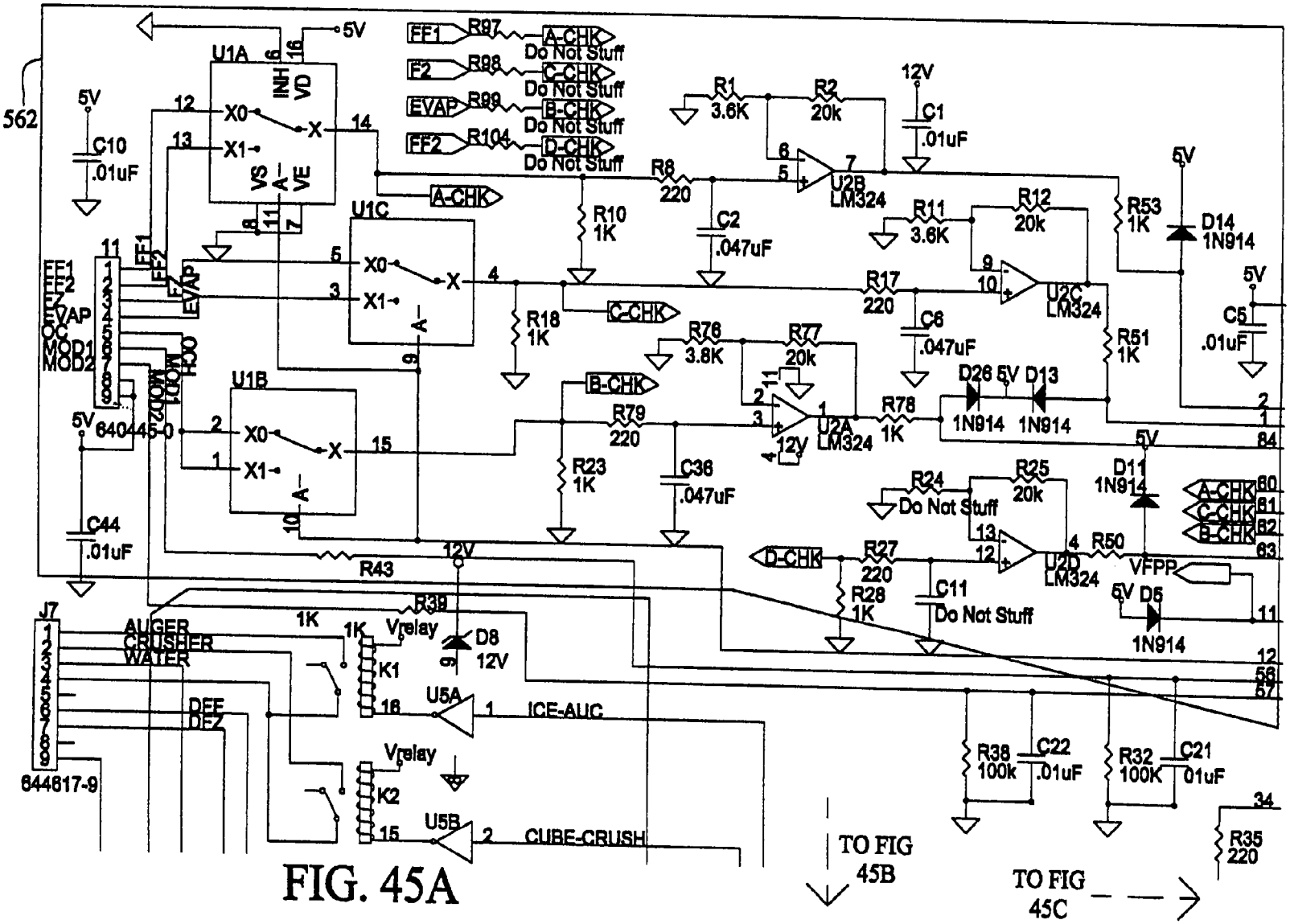
FIG. 45A is a first portion of an electronic schematic diagram for main control board.
Figure 45B:
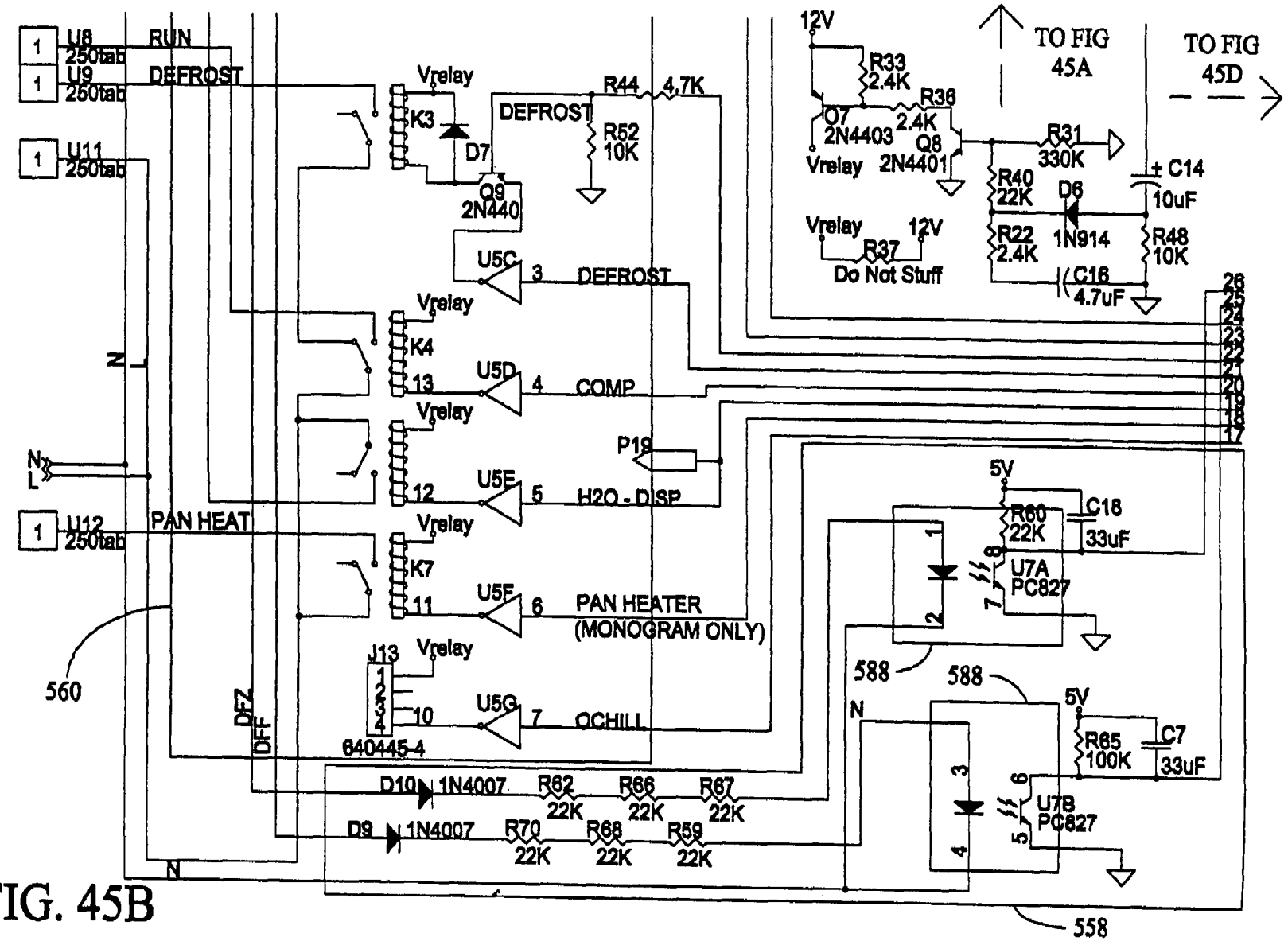
FIG. 45B is a second portion of an electronic schematic diagram for main control board.
Figure 45C:
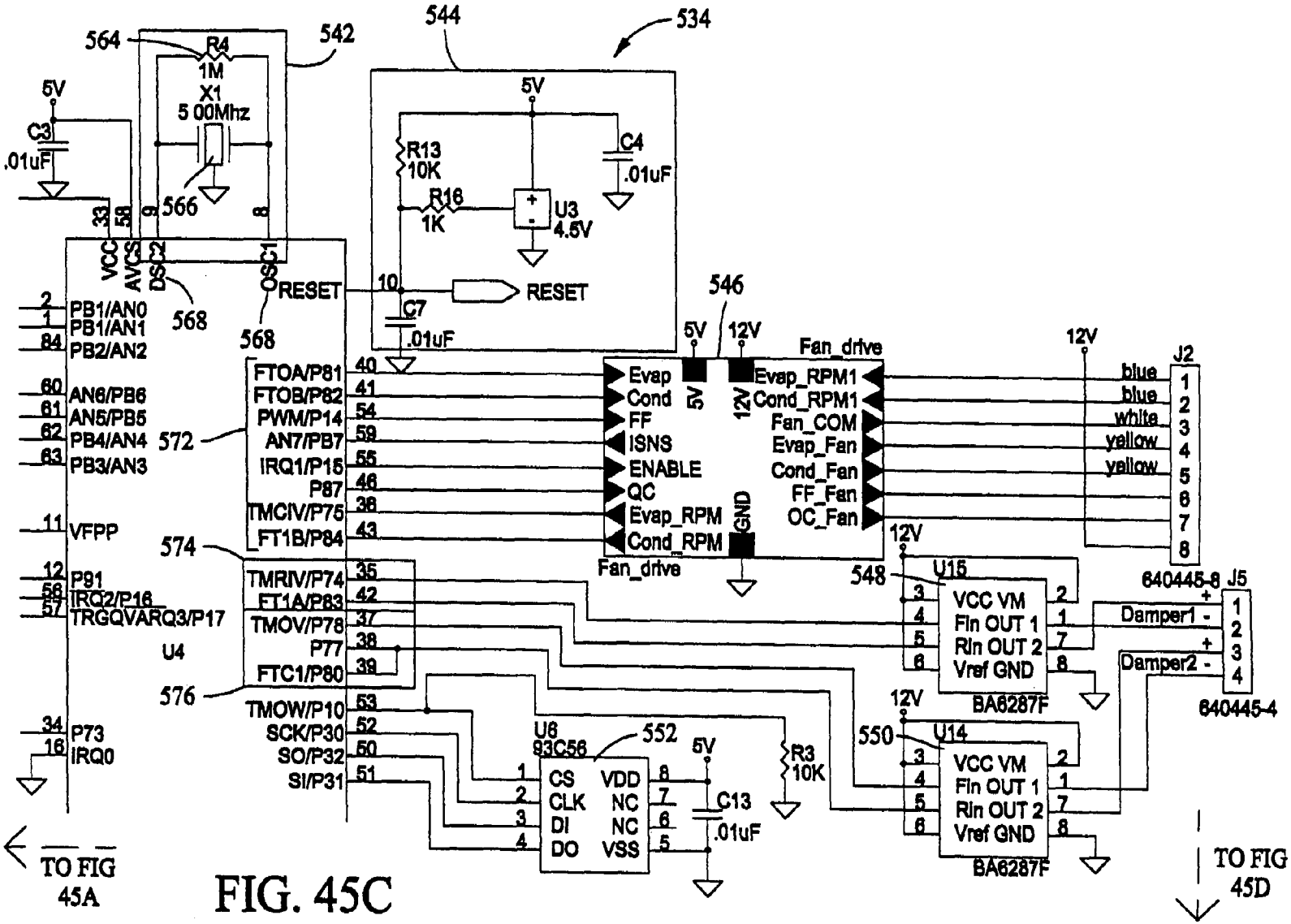
FIG. 45C is a third portion of an electronic schematic diagram for main control board.
Figure 45D:
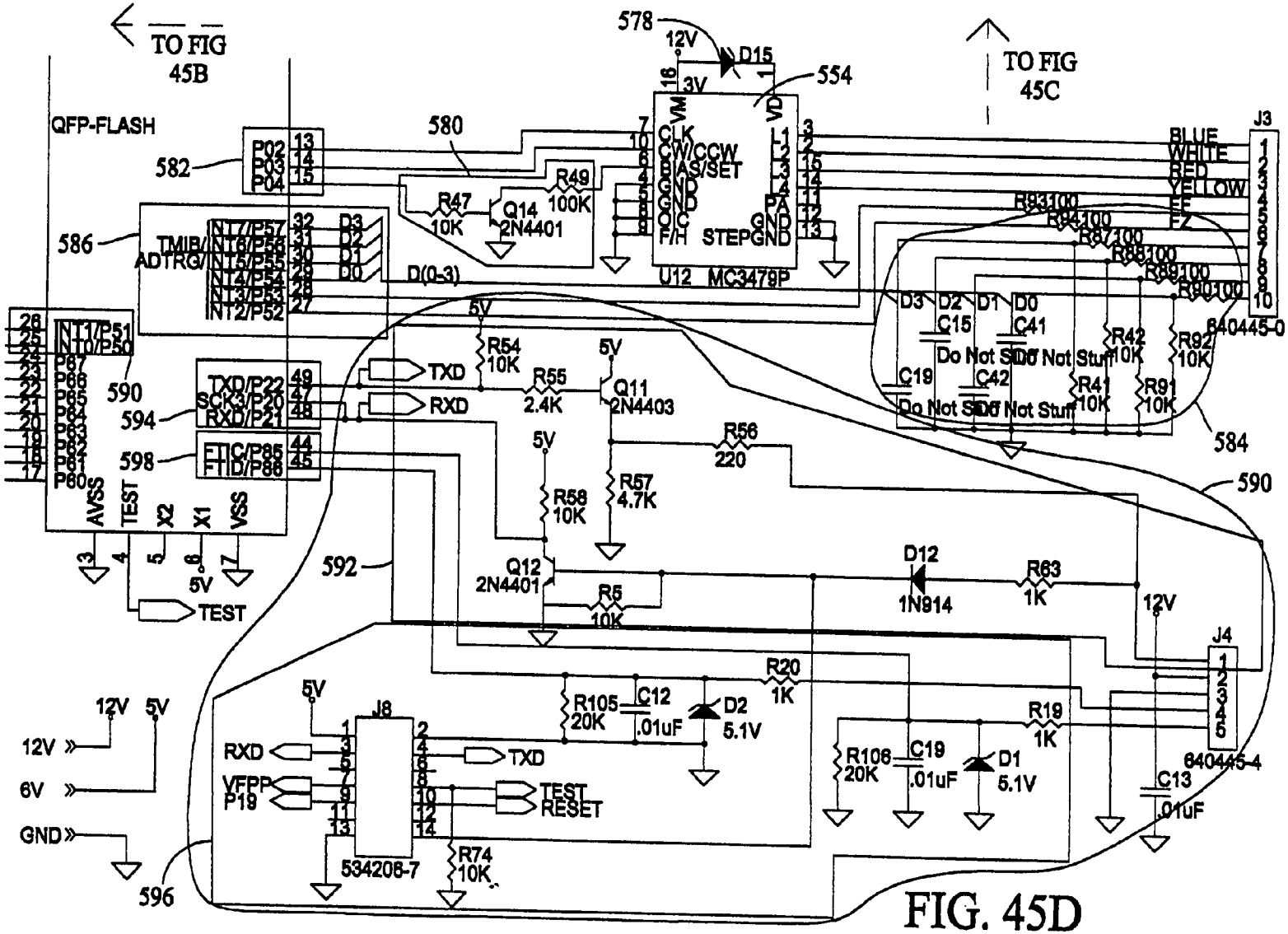
FIG. 45D is a fourth portion of an electronic schematic diagram for main control board.
Figure 45E:
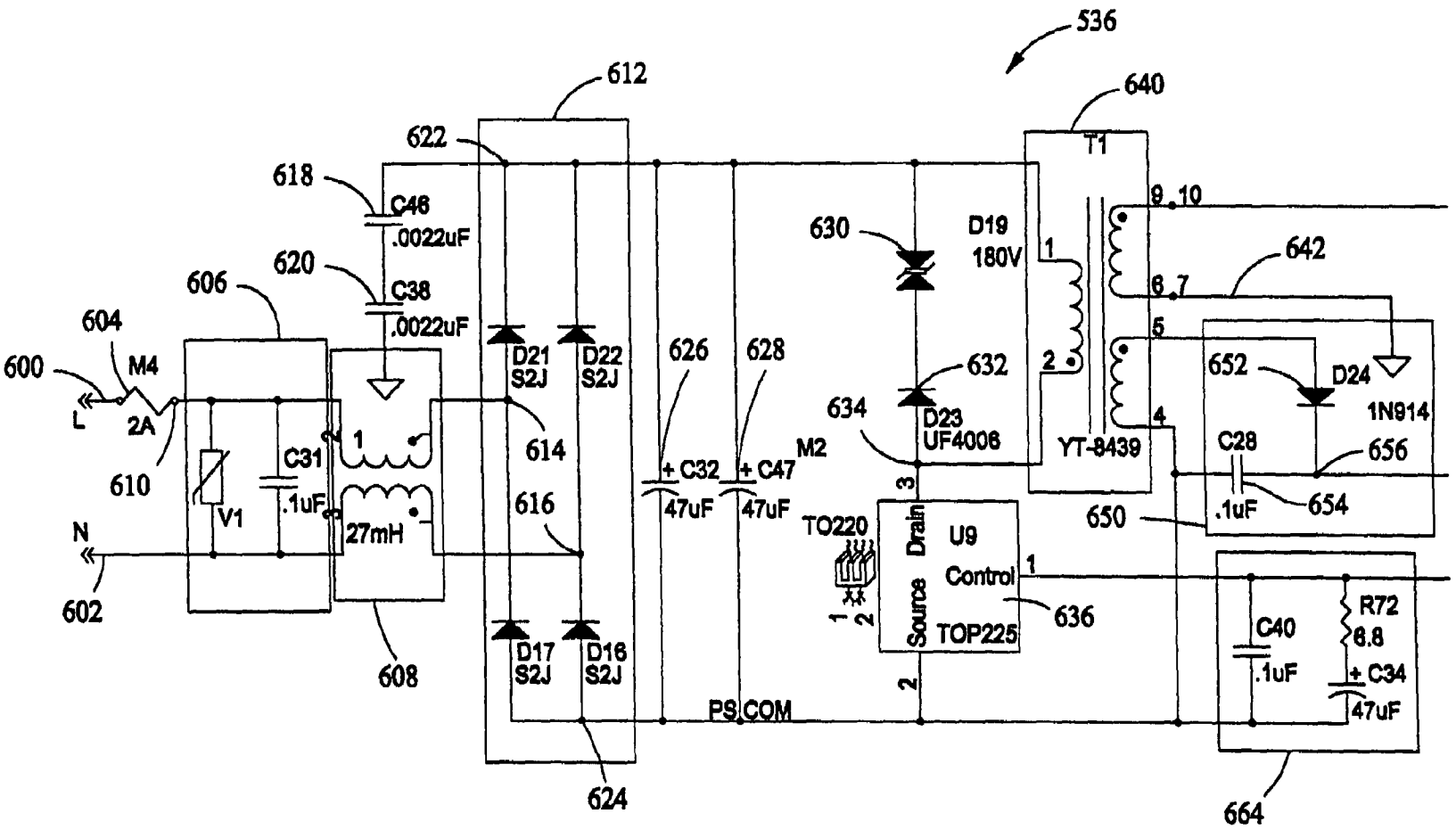
FIG. 45E is a fifth portion of an electronic schematic diagram for main control board.
Figure 45F:
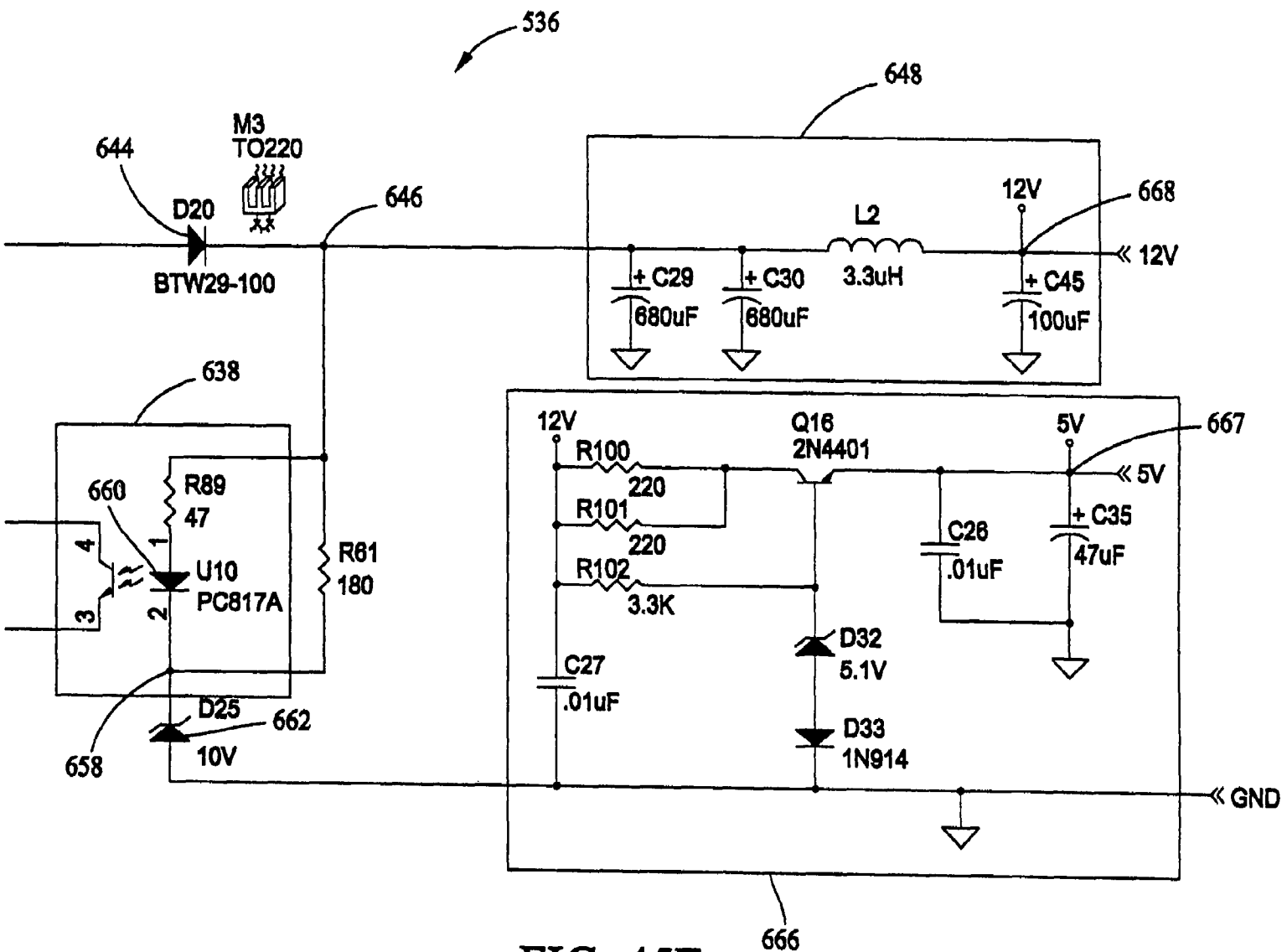
FIG. 45F is a sixth portion of an electronic schematic diagram for main control board.
Figure 45G:
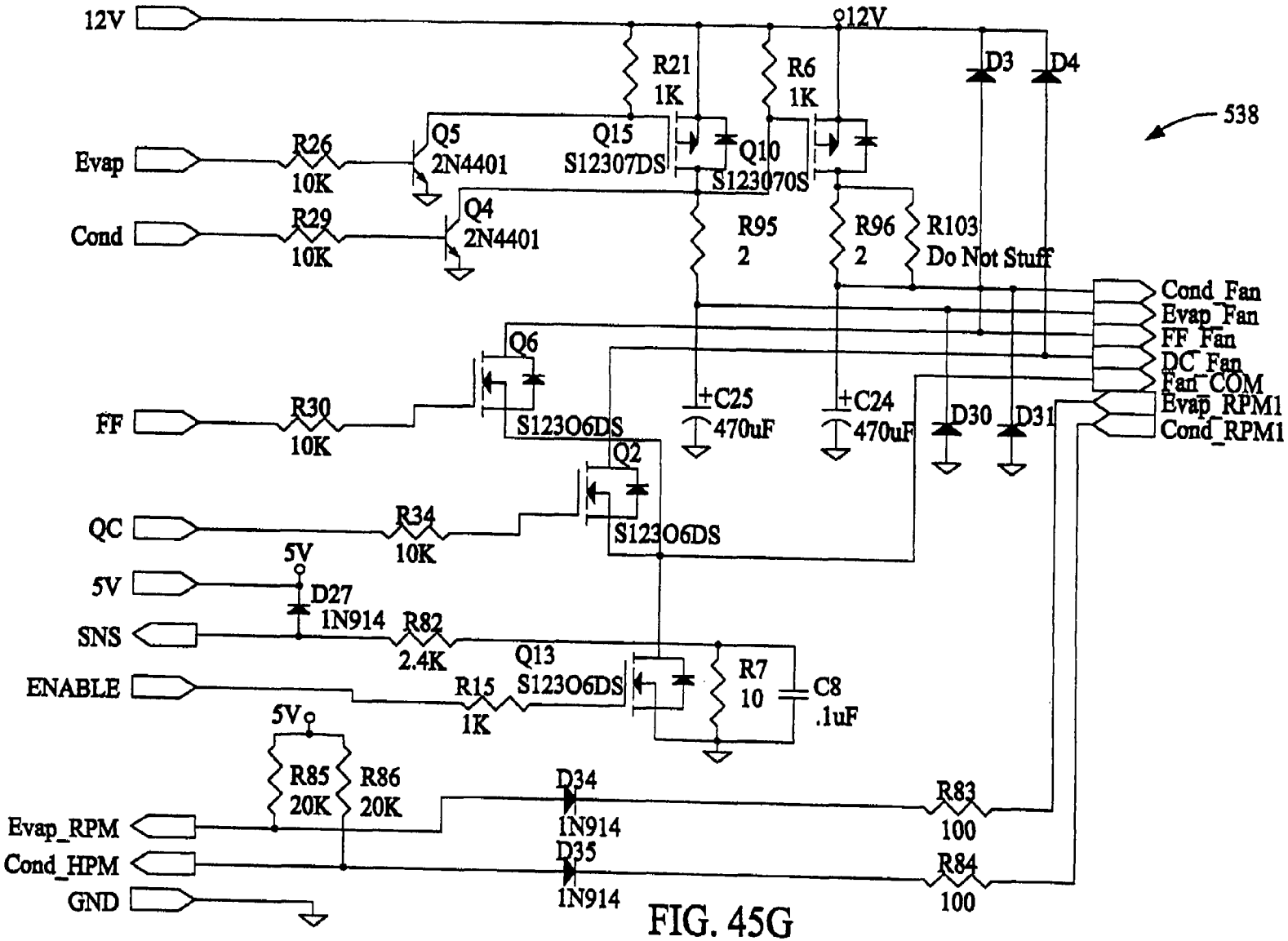
FIG. 45G is a seventh portion of an electronic schematic diagram for main control board.
Figure 46A:
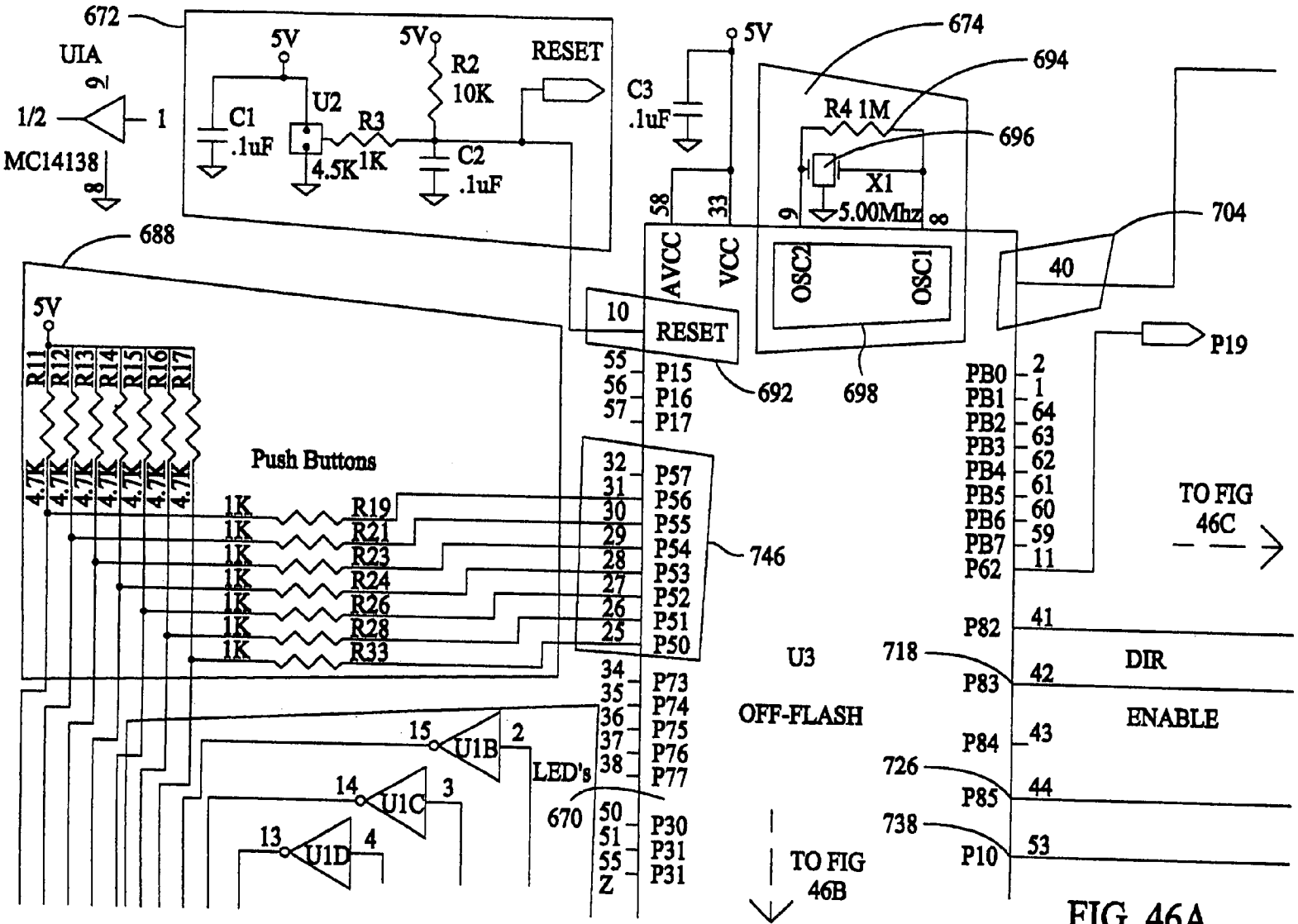
FIG. 46A is a first portion of an electrical schematic diagram of a dispenser board.
Figure 46B:
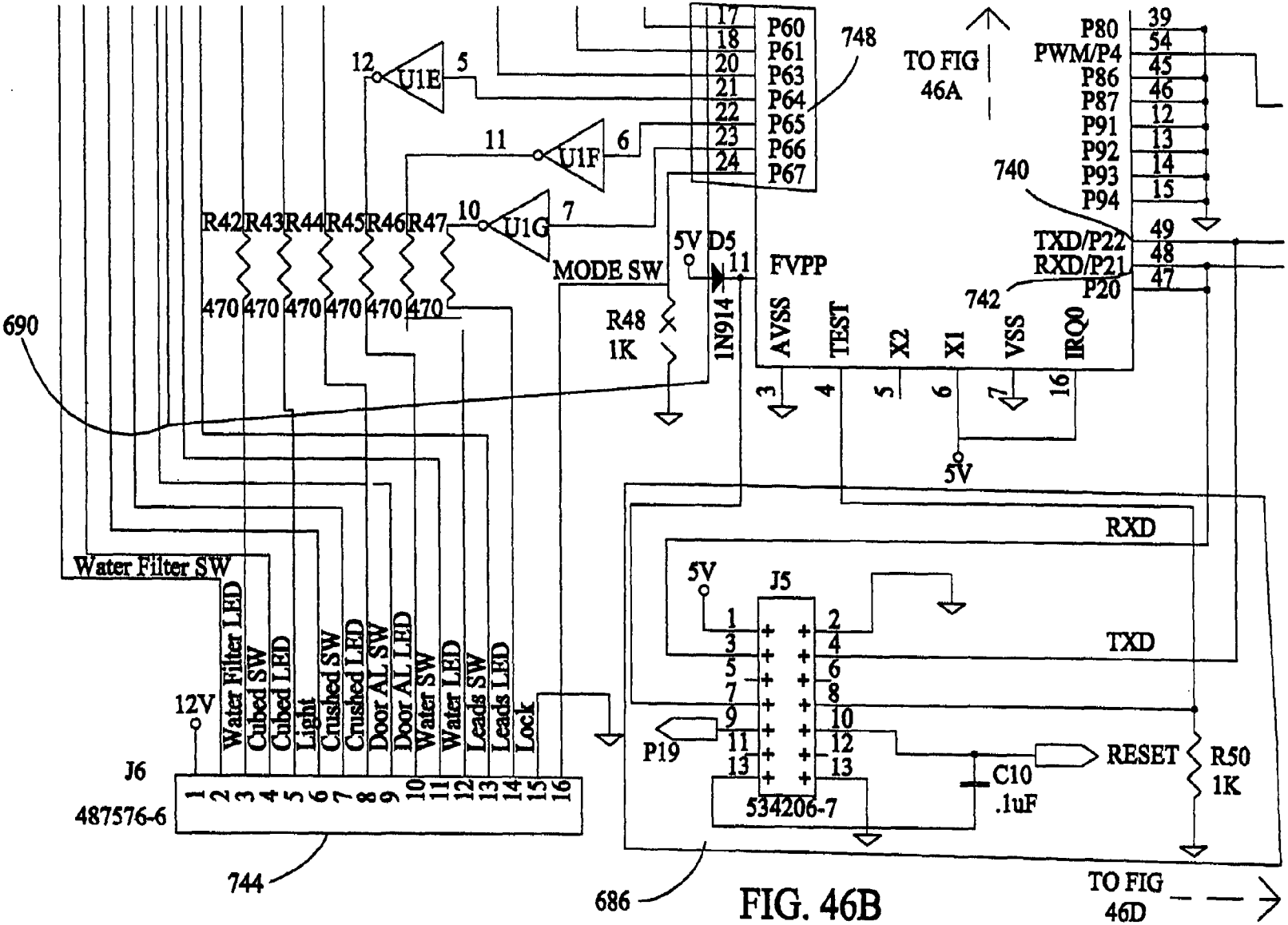
FIG. 46B is a second portion of an electrical schematic diagram of a dispenser board.
Figure 46C:
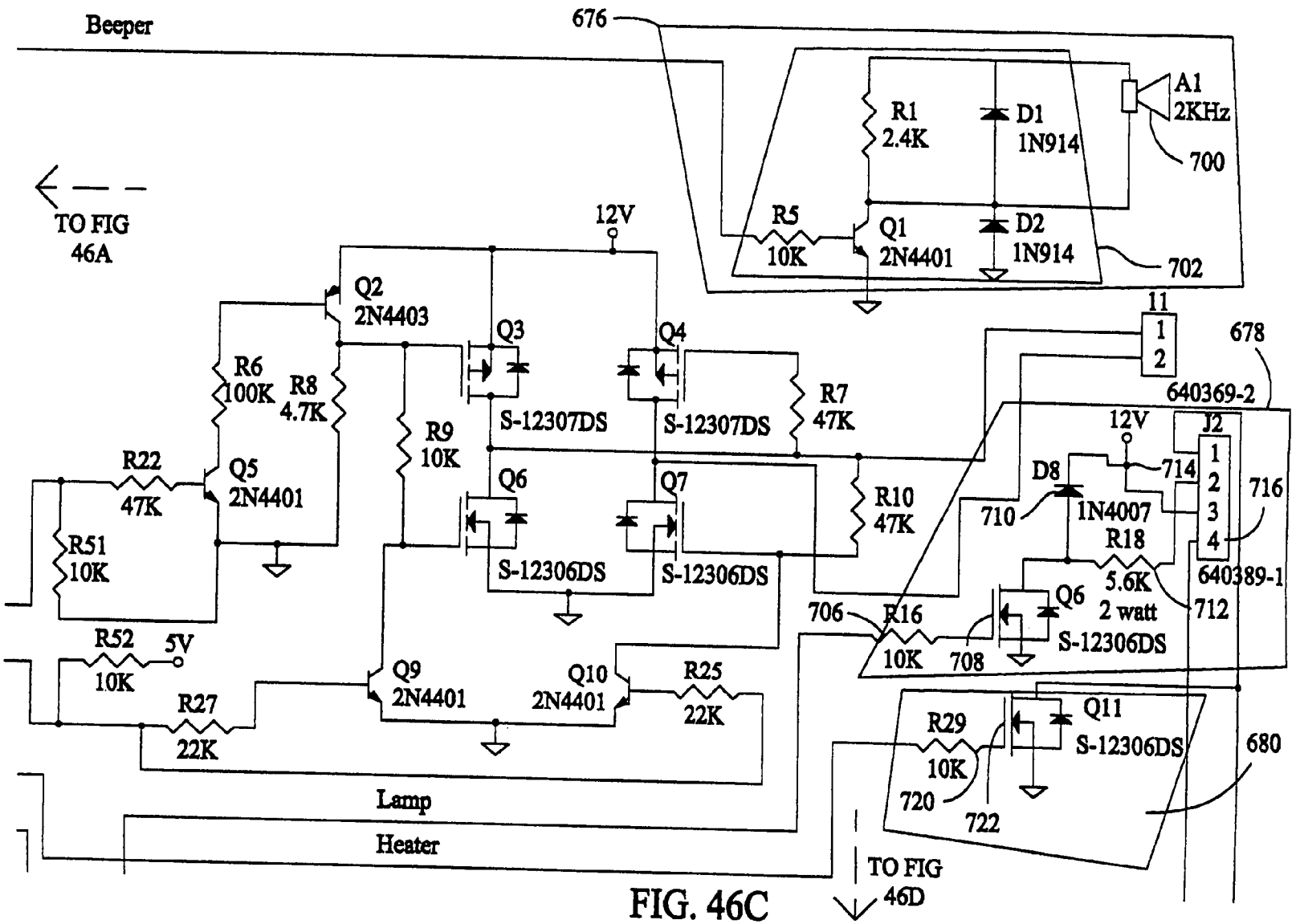
FIG. 46C is a third portion of an electrical schematic diagram of a dispenser board.
Figure 46D:
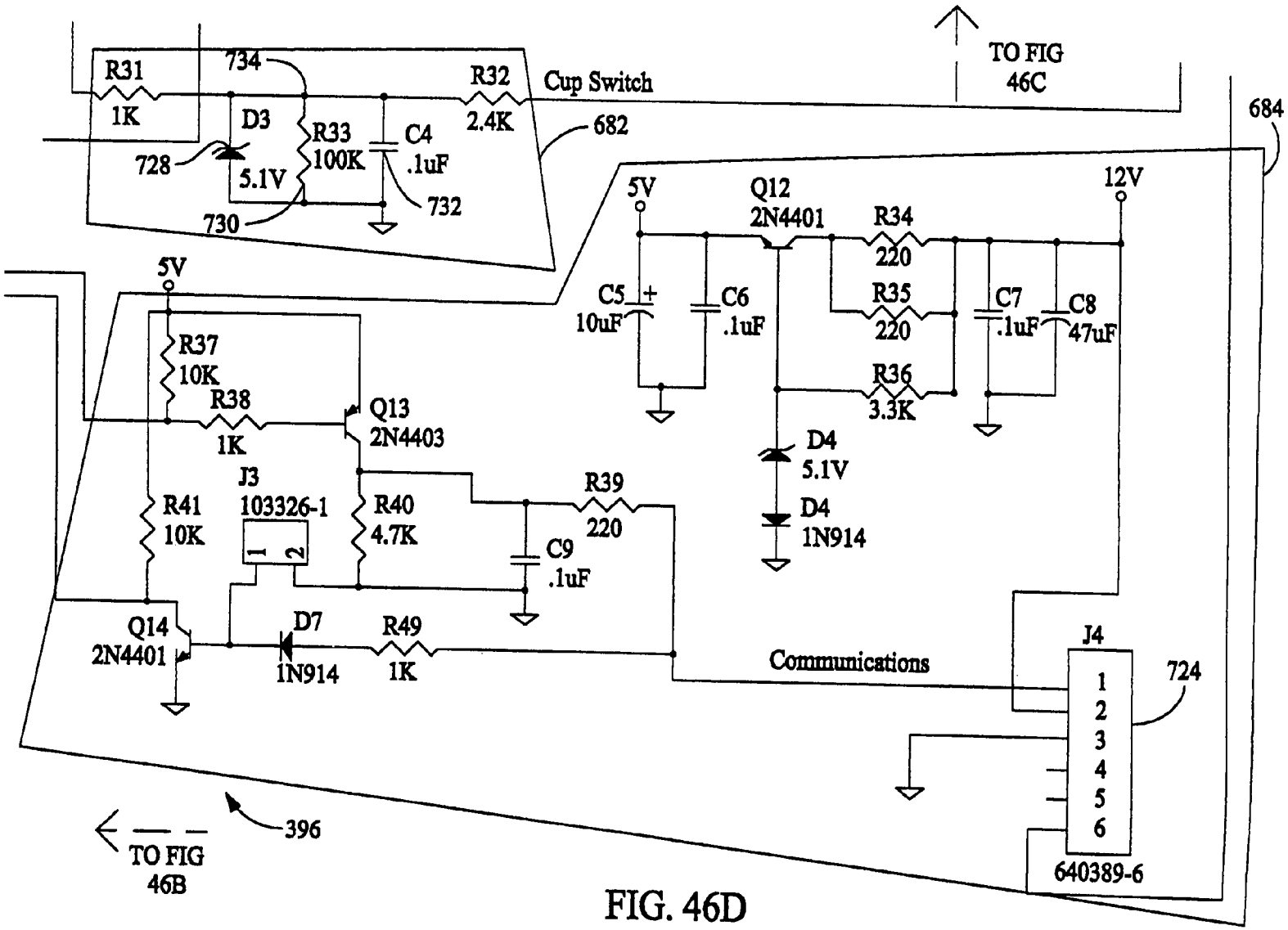
FIG. 46D is a fourth portion of an electrical schematic diagram of a dispenser board.
Figure 47A:
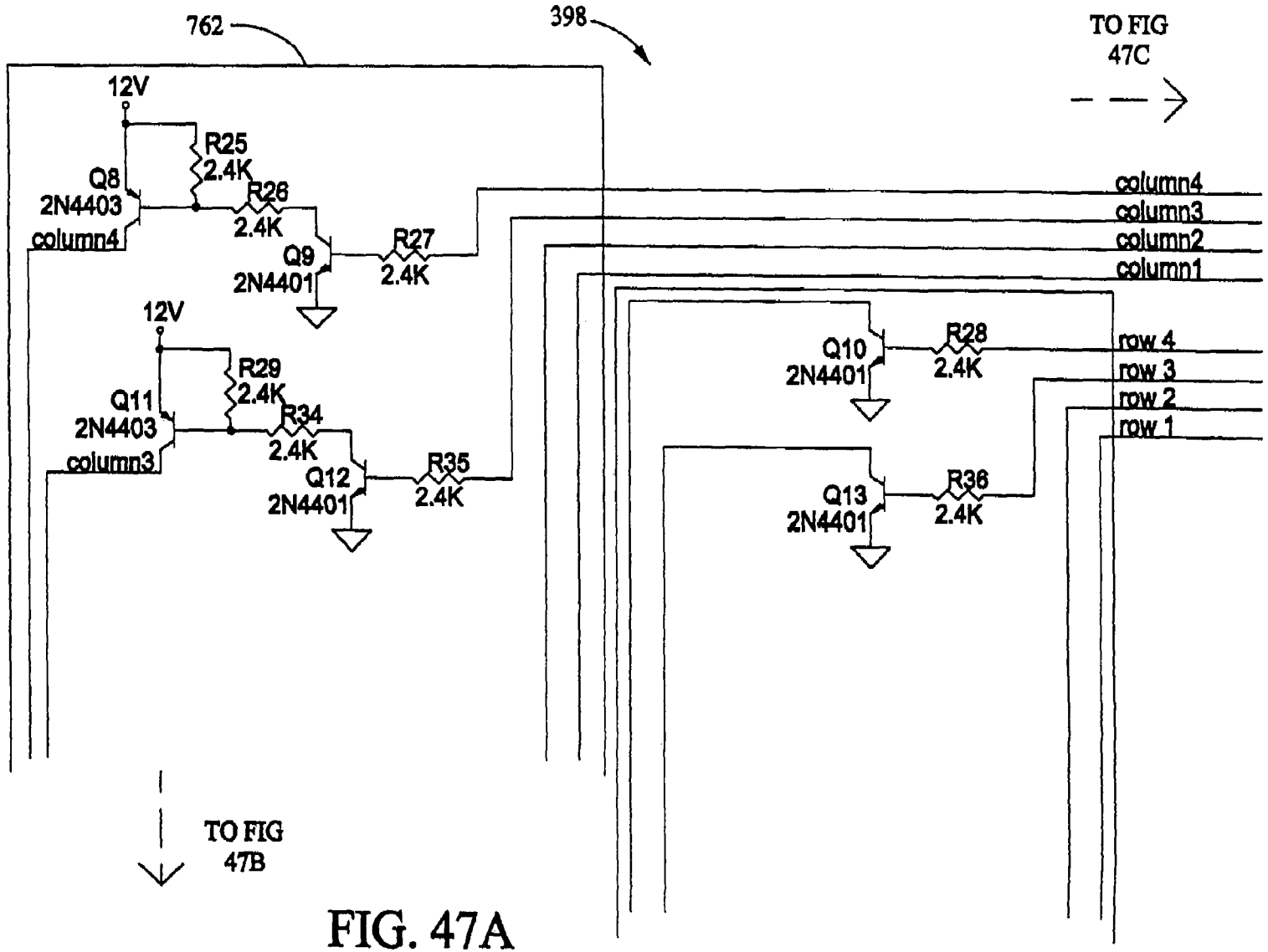
FIG. 47A is a first portion of an electrical schematic diagram of a temperature board.
Figure 47B:
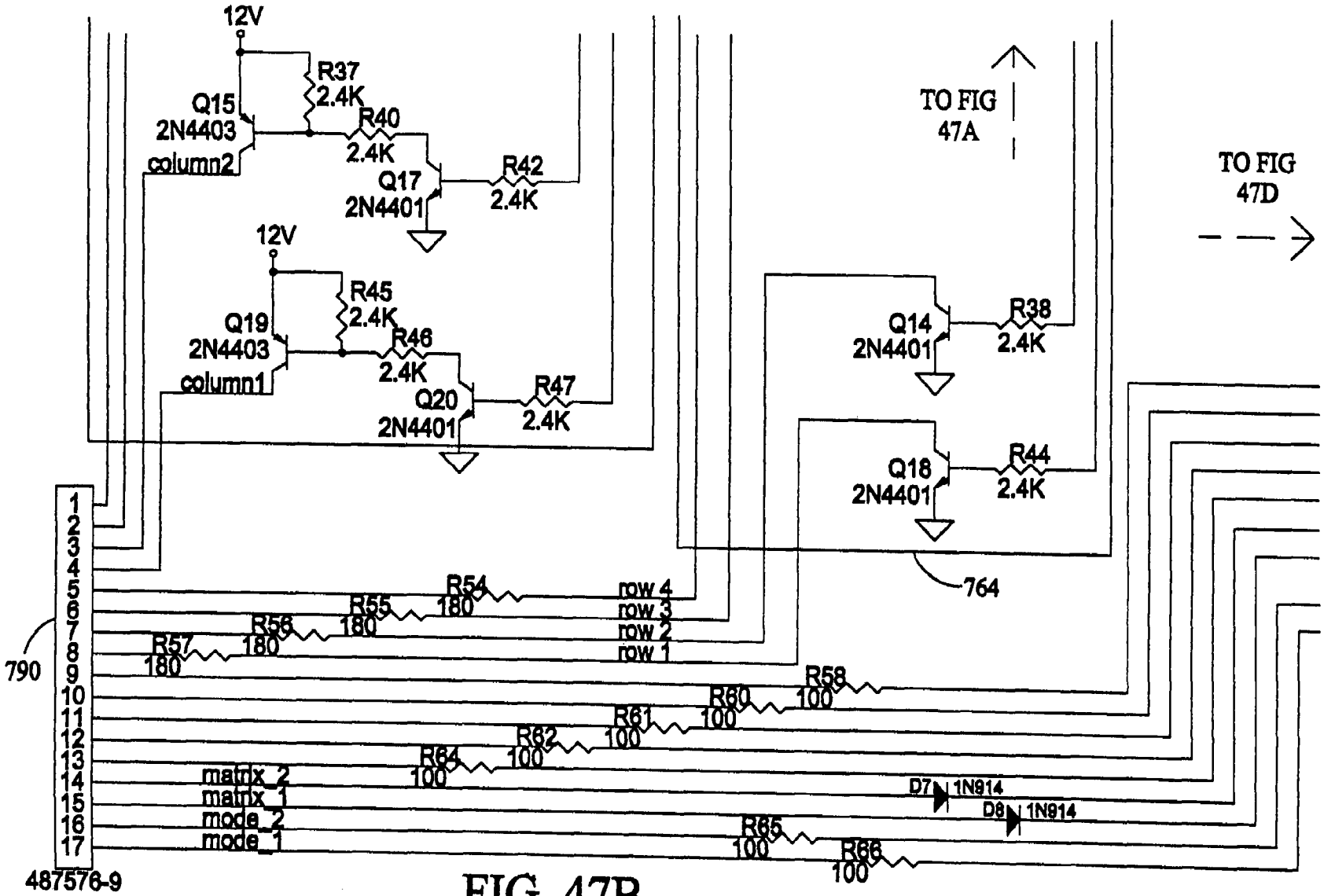
FIG. 47B is a second portion of an electrical schematic diagram of a temperature board.
Figure 47C:
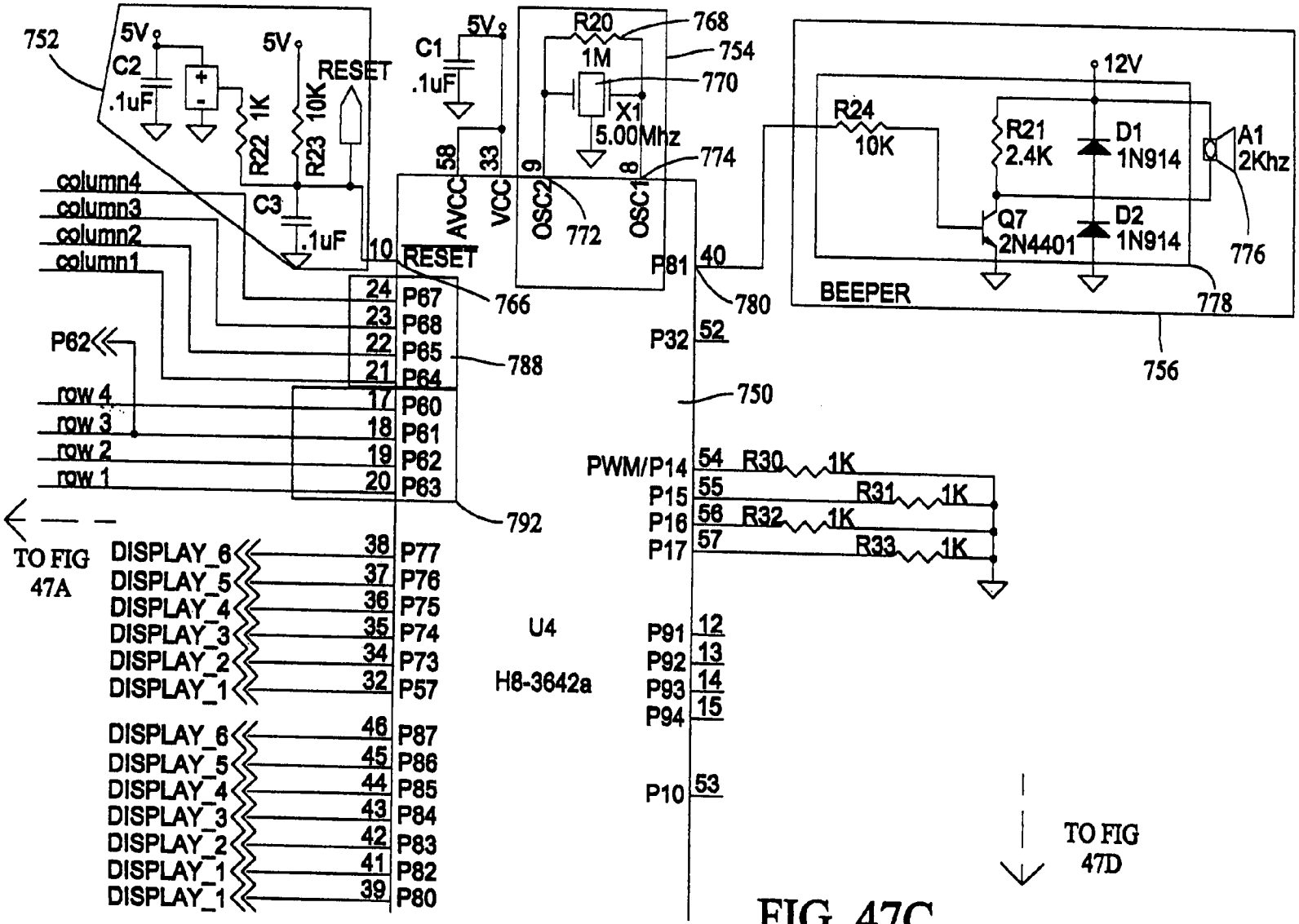
FIG. 47C is a third portion of an electrical schematic diagram of a temperature board.
Figure 47D:
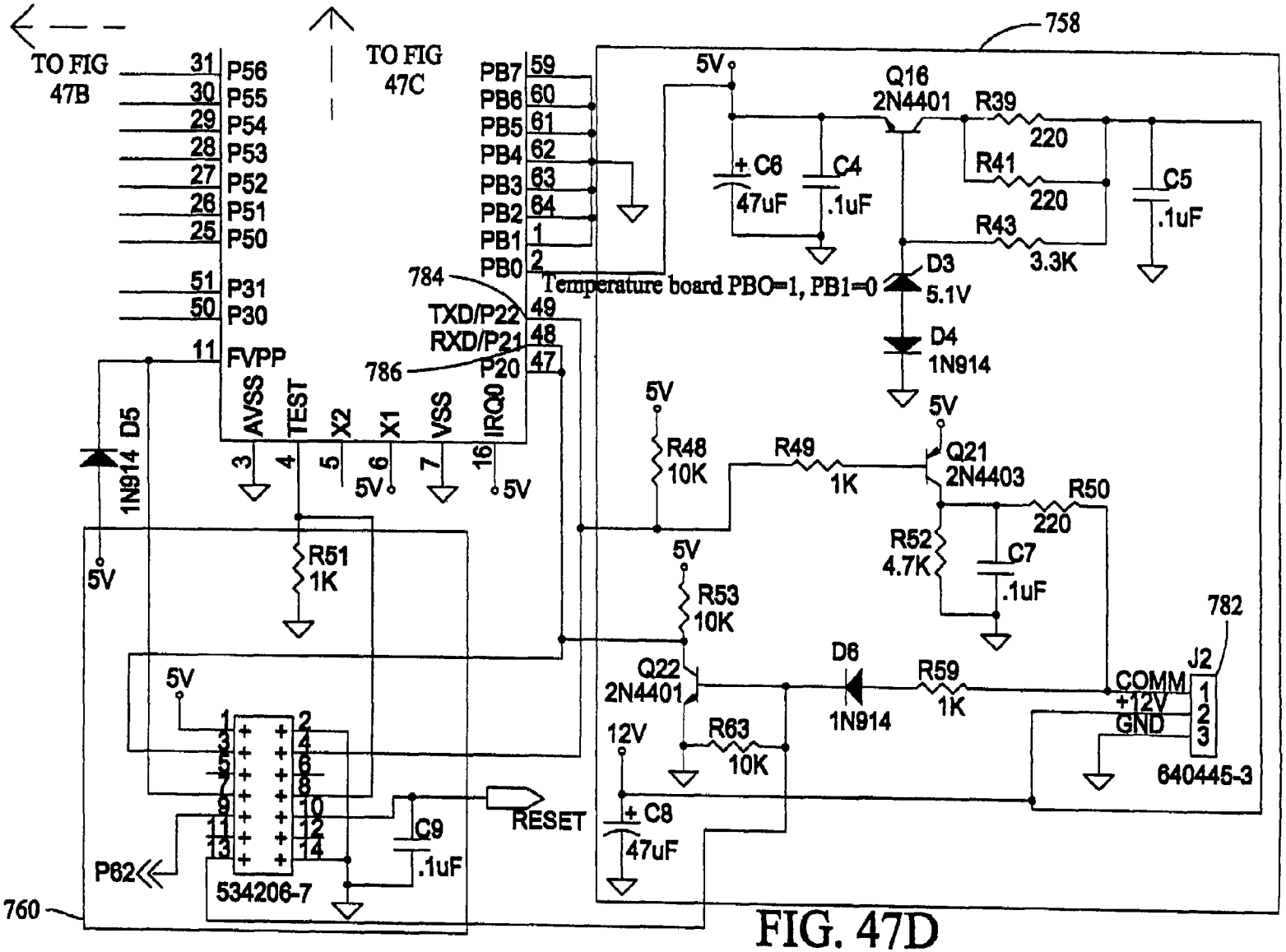
FIG. 47D is a fourth portion of an electrical schematic diagram of a temperature board.

FIGS. 44A and 44B are an exemplary flow diagram 532 for HMI structure. HMI state machines are shown in FIGS. 44A and 44B and are similar in structure to the control board state machines (shown in FIGS. 41A and 41B). The system enters the main software routine for the HMI board after a system reset and the system is initialized. HMI structure includes a main routine that interfaces with a command processor, dispense, diagnostic, HMI diagnostic, setpoint adjust, Protocol Data Parse, Protocol Data Xmit, and Keyboard scan routines. The main routine also interfaces with data stores: DayCount, Turbo Timer, OneMinute, and Quick Chill Timer.

The Command Processor routine interfaces with Protocol Data Parse, Protocol Data Xmit, and LED Control. The Dispense routine interfaces with the Protocol Data Parse, Protocol Data Xmit, LED Control, and Keyboard Scan routines. The Diagnostic routine interfaces with the Protocol Data Parse, Protocol Data Xmit, LED Control, Keyboard scan routines, as well as the OneMinute data store. The HMI Diagnostic routine interfaces with LED Control and Keyboard scan routines and the OneMinute data store. The Setpoint adjust routine interfaces with Protocol Data Parse, Protocol Data Xmit, LED Control, Keyboard scan and the OneMinute data store. The Protocol Data Parse routine interfaces with Clear Buffer and Protocol Packet Ready routines and the RX buffer data store. Protocol Data Xmit interfaces with Physical Xmit Char and Xmit Port avail routines. Both Physical Xmit Char and Xmit Port Avail routines disable interrupts.

There are two sets of interrupts: communications interrupt and timer interrupts. Timer interrupt interfaces with data stores DayCount, Daily Rollover, Quick Chill Timer, OneMinute, and Turbo Timer. On the other hand, communication interrupt interfaces with software routines Physical Get RX Character, Physical Xmit Char, and Xmit Port Avail.

To achieve control of energy management and temperature performance, main controller board 326 (shown in FIG. 8-10) interfaces with dispenser board 396 (shown in FIGS. 9A and 9B) and temperature adjustment board 398 (shown in FIGS. 9A and 9B).

Hardware Schematics

FIGS. 45A-G are an exemplary electronic schematic diagram for an exemplary main control board 534 including power supply circuitry 536, biasing circuitry 538, microcontroller 540, clock circuitry 542, reset circuitry 544, evaporator/condenser fan control 546, DC motor drivers 548 and 550, EEPROM 552, stepper motor 554, communications circuitry 556, interrupt circuitry 558, relay circuitry 560 and comparator circuitry 562.

Microcontroller 540 is electrically connected to crystal clock circuitry 542, reset circuitry 544, evaporator/condenser fan control 546, DC motor drivers 548 and 550, EEPROM 552, stepper motor 554, communications circuitry 556, interrupt circuitry 558, relay circuitry 560, and comparator circuitry 562.

Clock circuitry 542 includes resistor 564 electrically connected in parallel with a 5 MHz crystal 566. Clock circuitry 542 is connected to microcontroller 540's clock lines 568.

Reset circuitry 544 includes a 5V supply connected to a plurality of resistors and capacitors. Reset circuitry 544 is connected to microcontroller 540 reset line 570.

Evaporator/Condenser fan control 546 includes both 5V and 12 V power, and is connected to microcontroller 540 lines at 572.

DC motor drives 548 and 550 are connected to 12V power. DC motor drive 548 is connected to microcontroller 540 at lines 574, and DC motor 550 is connected to microcontroller 540 at lines 576.

Stepper motor 554 is connected to 12V power, zener diode 578, and biasing circuitry 580. Stepper motor 554 is connected to microcontroller 540 at lines 582.

Interrupt circuitry 558 is provided at two places on main controller board 326. A resistive capacitive divider network 584 is connected to microcontroller 540 INT2, INT3, INT4, INT5, INT6, and INT7 on lines 586. In addition, interrupt circuitry 558 includes a network including a pair of optocouplers 588; this network is connected to microcontroller 540 INT0 and INT1 on lines 590.

Communications circuitry 556 includes transmit/receive circuitry 592 and test circuitry 596. Transmit/receive circuitry 592 is connected to microcontroller 540 at lines 594. Test circuitry 596 is connected to microcontroller 540 at lines 598.

Comparator circuitry 562 includes a plurality of comparators to verify input signals with a reference source. Each comparison circuit is connected to microcontroller 540.

Electrical power to main controller board 326 is provided by power supply circuitry 536. Power supply circuitry 536 includes a connection to AC line voltage at terminal 600 and neutral terminal 602. AC line voltage 600 is connected to a fuse 604 and to high frequency filter 606. High frequency filter 606 is connected to fuse 604 and to filter 608 at node 610. Filter 608 is connected to a full-wave bridge rectifier 612 at nodes 614 and node 616. Capacitor 618 and capacitor 620 are connected in series and connected to node 622. Connected between nodes 622 and node 624 are capacitors 626 and 628. Also connected to node 622 is diode 630. Connected to diode 630 is diode 632. Diode 632 is connected to node 634. Also connected to node 634 is the drain of IC 636. Source of IC 636 is connected to node 642, and Control is connected to the emitter output of optocoupler 638. Connected between nodes 622 and node 634 is primary winding of transformer 640. Transformer 640 is a step-down transformer, and its secondary windings include a node 642. Connected to the top-half of transformer 640's secondary winding is diode 644. Diode 644 is connected to node 646 and inductive capacitive filter network 648. Node 646 supplies main controller board 326 12VDC. Connected to the bottom-half of transformer 640's secondary winding is a half-wave rectifier 650. Half-wave rectifier 650 includes diode 652 connected to node 656 and capacitor 654. Capacitor 654 is also connected to node 656. Connected to node 656 is optocoupler 638. At node 658, cathode of diode 660 of optocoupler 638 is connected to zener diode 662. Optocoupler 638 output is connected to nodes 656 and to IC 636 control. In addition, optocoupler 638 emitter output is connected to RC filter network 664. Connected to the anode of zener diode 662 is a 5V generation network 666. 5V generation network 666 takes 12V generated at node 668 and converts it to 5V, and then network 666 supplies 5V to main controller board 326 from node 667.

Biasing circuit 538 includes a plurality of transistors and MOSFETs connected together to 12V and 5V supply to provide power to main controller board 326 to power condenser fan 364 (shown in FIG. 10), evaporator fan 368 (shown in FIG. 10), and fresh food fan 366 (shown in FIG. 10).

Power Supply circuitry 536 functions to convert nominally 85 VAC to 265 VAC to 12VDC and 5VDC and provide power to main controller board 326. AC voltage is connected to power supply circuitry 536 at the line terminal 600 and neutral terminal at 602. Line terminal 600 is connected to fuse 604 which functions to protect the circuit if the input current exceed 2 amps. The AC voltage is first filtered by high frequency filter 606 and then converted to DC by full-wave bridge rectifier 612. The DC voltage is further filtered by capacitors 626 and 628 before being transferred to transformer 640. The series combination of diodes 630 and 632 serves to protect transformer 640. If the voltage at node 622 exceeds the 180 volts rated voltage of diode 630.

The output of the top-half of the secondary coil of transformer 640 is tested at node 646. If the voltage drops at node 646 such that a high current condition exists at node 646, optocoupler 638 will bias IC 636 on. When IC 636 is turned on, high current is drawn through IC 636 drain, which protects transformer 640 and also stabilizes the output voltage.

Main controller board 326 controls the operation of refrigerator 100. Main controller board 326 includes electrically erasable and programmable microcontroller 540 which stores and executes a firmware, communications routines, and behavior definitions described above.

The firmware functions executed by main controller board 326 are control functions, user interface functions, diagnostic functions and exception and failure detection and management functions. The user interface functions include: temperature settings, dispensing functions, door alarm, light, lock, filters, turbo cool, thaw pan and chill pan functions. The diagnostic functions include service diagnostic routines, such as, HMI self test and control and Sensor System self test. The two Exception and Failure Detection and Management routines are thermistors and fans.

The communications routine functions to physically interconnect main controller board 326 (shown in FIG. 8-10) to HMI board 324 (shown in FIG. 8) and dispenser board 396 (shown in FIGS. 9A and 9B) through the asynchronous interprocessor communications bus 328 (shown in FIG. 8).

The behavioral definitions include the sealed system 480 (shown in FIGS. 18A and 18B), fresh food fan 482 (shown in FIG. 19), dispenser 484 (shown in FIGS. 20A and 20B), and HMI 486 (shown in FIG. 21) that have been previously discussed above.

In addition to the core functions such as firmware, communications, and behavior, main controller board 326 stores in microcontroller 540 key operating algorithms such as power management, watchdog timer, timer interrupt, keyboard debounce, dispenser control 508 (shown in FIG. 32), evaporator and condenser fan control 514 (shown in FIG. 35), fresh food average temperature setpoint decision incorrect, turbo cycle cool down, defrost/chill pan, change freshness filter, and change water filter described above. Furthermore, microcontroller 540 stores sensor read and rolling average algorithm and calibration algorithm 522 (shown in FIG. 39), which are both executed by main controller board 326.

Main controller board 326 also controls interactions between a user and various functions of refrigerator 100 such as dispenser interaction, temperature setting interaction 494 (shown in FIG. 25), quick chill 496 interactions (shown in FIG. 26), turbo 498 (shown in FIG. 27), and diagnostic interactions as described above. Dispenser interactions include water dispenser 488 (shown in FIG. 22), crushed ice dispenser 490 (shown in FIG. 23), and cubed ice dispenser 492 (shown in FIG. 24). Diagnostic interactions include freshness filter reminder 500 (shown in FIG. 28), water filter reminder 502 (shown in FIG. 29), and door open 504 (shown in FIG. 30).

FIGS. 46A-D are an electrical schematic diagram of the dispenser board 396. Dispenser Board 396 includes a microcontroller 670, reset circuitry 672, clock circuitry 674, alarm circuitry 676, lamp circuitry 678, heater control circuitry 680, cup switch circuitry 682, communications circuitry 684, test circuitry 686, dispenser selection circuitry 688, LED driver circuitry 690.

Microcontroller 670 is powered by 5VDC and is connected to reset circuitry 672 at reset line 692.

Clock circuitry 674 includes a resistor 694 connected in parallel with a crystal 696 and connected to microcontroller 670 at clock input 698.

Alarm circuitry 676 includes a speaker 700 connected to a biasing network 702. Alarm circuitry 676 is connected to microcontroller 670 line 704.

Lamp circuitry 678 includes resistor 706 connected to MOSFET 708, which is connected to diode 710 and resistor 712. Diode 710 is connected to a 12V supply at node 714. Node 714 and resistor 712 are connected to junction2 716. Lamp circuitry 678 is connected to microcontroller 670 at 718.

Heater control circuitry 680 includes resistor 720 connected in series to MOSFET 722, which is connected to junction2 716 and junction4 724. Heater control circuitry 680 is connected to microcontroller 670 at 726.

Cup switch circuitry 682 includes a zener diode 728 connected in parallel to a resistor 730 and capacitor 732 at node 734. Node 734 is connected to a resistor 736 and junction2 678. Cup switch circuitry 682 is connected to microcontroller 670 at 738.

Microcontroller 670 is also connected to communications circuitry 684. Communications circuitry 684 is connected to junction4 724 and to test circuitry 686. Communications circuitry 684 transmit line is connected to microcontroller 670 at 740 and communications circuitry 684 receive line is connected at 742. Test circuitry 686 transmit and receive lines are also connected to microcontroller 670 at lines 740 and 742, respectively.

Microcontroller 670 also is connected to dispenser selection circuitry 688. Dispenser selection circuitry 688 includes a push button connected to 5V and connected to a resistor, which is connected to microcontroller 670 and a switch through junction6 744. A plurality of push buttons is connected to a plurality of resistors and switches for each dispenser function: water filter, cubed ice, light, crushed ice, door alarm, water, and lock. Dispenser selection circuitry is connected to microcontroller 670 at lines 746.

LED driver circuitry 690 includes an inverter connected in series to a resistor which is connected to a LED through junction 744. LED driver circuitry 690 includes a plurality of inverters connected to a resistors and LEDs for the following functions: a water filter LED, a cubed ice LED, a crushed ice LED, a door alarm LED, a water LED, and a lock LED. LED driver circuitry 690 is connected to microcontroller 670 at 748.

Furthermore, microcontroller 670 functions to store and execute firmware routines for a user to select, such as, resetting a water filter, dispensing cubed ice, dispensing crushed ice, setting a door alarm, dispensing water, and locking as described above. Microcontroller 670 also includes firmware to control turning on and off an alarm, a light, a heater. In addition, dispenser 396 cup switch circuitry 682 determines if a cup depresses a cradle switch for when a user wants to dispense ice or water. Lastly, Dispenser 396 includes communication circuitry 684 to communicate with main controller board 326.

FIGS. 47A-D are an electrical schematic diagram of a temperature board 398. Temperature board 398 includes a microcontroller 750, reset circuit 752, a clock circuit 754, an alarm circuit 756, a communications circuit 758, a test circuit 760, a level shifting circuitry 762, and a driver circuit 764.

Microcontroller 750 is powered by 5VDC and is connected to reset circuitry 752 at reset line 766.

Clock circuitry 754 includes a resistor 768 connected in parallel with a crystal 770 and connected to microcontroller 750 at clock inputs 772 and 774.

Alarm circuitry 756 includes a speaker 776 connected to a biasing network 778. Alarm circuitry 756 is connected to microcontroller 750 line 780.

Microcontroller 750 is also connected to communications circuitry 758. Communications circuitry 758 is connected to junction2 782 and to test circuitry 760. Communications circuitry 758 transmit line is connected to microcontroller 750 at 784 and communications circuitry 758 receive line is connected at 786. Test circuitry 760 transmit and receive are also connected to microcontroller 750 at lines 784 and 786, respectively.

Level shifting circuitry 762 includes a plurality of level shifting circuits, where each circuit includes a plurality of transistors configured to shift the voltage from 5V to 12V to drive thermistors. Each level shifting circuit is connected to microcontroller 750 at 766 at one end and junction1 790 at the other.

Driver circuitry 764 includes a plurality of driver circuits, where each circuit includes a plurality of transistors configured as emitter-followers. Each driver circuit is connected to microcontroller 750 at 792 and junction1 790.

While the invention has been described in terms of various specific embodiments, those skilled in the art will recognize that the invention can be practiced with modification within the spirit and scope of the claims.

What is claimed is:

1. A control system for a refrigeration system, the refrigeration system including at least one refrigeration compartment, a quick chill/thaw pan located in the refrigeration compartment, an air handler including a heater element, a damper, a fan for supplying air to the quick chill/thaw pan, and a temperature sensor for detecting a temperature of the air handler, said control system comprising:

an electronic controller comprising a main board, a temperature adjustment board, a dispenser board, and a serial communications bus, said main board electrically connected to said temperature adjustment board and said dispenser board through said serial communications bus for controlling the temperature of the refrigeration compartment and the quick chill/thaw pan; and a human machine interface (HMI) board comprising a plurality of input selection keys, said controller electrically connected to said HMI board and configured for user selection of a quick chill mode, a quick thaw mode, and a temperature zone mode, wherein user selection of said temperature zone mode includes user selection of one of a temperature and a temperature range to be maintained within the quick chill/thaw pan, said controller configured to control an operating speed of the fan based on a detected temperature of the air handler, said controller further configured to energize the heater element in order to maintain a temperature in the quick chill/thaw pan and open the damper to circulate air between the air handler and the quick chill/thaw pan when the heater element is energized.

2. A control system in accordance with claim 1 wherein said input selector keys comprising at least one of a quick chill key and a quick thaw key.

3. A control system in accordance with claim 1, said electronic controller configured to:

accept a plurality of inputs including at least a refrigeration compartment temperature and an input indicating operation of one of said quick chill mode, said quick thaw mode, and said temperature zone mode;

determine a state of the refrigeration system;

transmit a command over said serial communications bus; and execute a plurality of algorithms to control the refrigeration compartment and the quick chill/thaw pan based on the command transmitted over said serial communications bus.

4. A control system in accordance with claim 1 wherein said controller is configured for user selection of a plurality of said quick thaw mode using said HMI board.

5. A control system in accordance with claim 1 wherein said controller is configured for user selection of a plurality of said quick chill mode using said HMI board.

6. A control system in accordance with claim 1 wherein said HMI board comprises at least one light emitting diode (LED) for indicating operation of at least one of said quick thaw mode and said temperature zone mode.

7. A control system in accordance with claim 1 wherein said HMI board comprises at least one light emitting diode (LED) for indicating operation of said quick chill mode.

8. A control system for a refrigeration system, the refrigeration system including at least one refrigeration compartment, a quick chill/thaw pan located in the refrigeration compartment, an air handler including a heater element, a damper, a fan for supplying air to the quick chill/thaw pan, and a temperature sensor for detecting a temperature of the air handler, said control system comprising:

an electronic controller comprising a main board, a temperature adjustment board, a dispenser board, and a serial communications bus, said main board electrically connected to said temperature adjustment board and said dispenser board through said serial communications bus for controlling the temperature of the refrigeration compartment and the quick chill/thaw pan; and a human machine interface (HMI) board comprising a plurality of input selection keys, said controller electrically connected to said HMI board and configured for user selection of a quick chill mode, a quick thaw mode, and a turbo cool mode, wherein said turbo cool mode reduces a temperature of air inside the refrigeration compartment, wherein said controller is configured to control an operating speed of the fan based on a detected temperature of the air handler, said controller further configured to energize the heater element in order to maintain a temperature in the quick chill/thaw pan and open the damper to circulate air between the air handler and the quick chill/thaw pan when the heater element is energized.

9. A control system in accordance with claim 8 wherein said input selector keys comprising at least one of a quick chill key, a quick thaw key, and a turbo cool key.

10. A control system in accordance with claim 8, said electronic controller configured to:

accept a plurality of inputs including at least a refrigeration compartment temperature and an input indicating operation of one of said quick chill mode, said quick thaw mode, and said turbo cool mode;

determine a state of the refrigeration system;

transmit a command over said serial communications bus; and execute a plurality of algorithms to control the refrigeration compartment and the quick chill/thaw pan based on the command transmitted over said serial communications bus.

11. A control system in accordance with claim 8 wherein said controller is configured for user selection of a plurality of quick thaw modes using said HMI board.

12. A control system in accordance with claim 8 wherein said controller is configured for user selection of a plurality of quick chill modes using said HMI board.

13. A control system in accordance with claim 8 wherein said HMI board comprises at least one light emitting diode (LED) for indicating operation of at least one of said quick thaw mode and said turbo cool mode.

14. A control system in accordance with claim 8 wherein said HMI board comprises at least one light emitting diode (LED) for indicating operation of said quick chill mode.

* * * * *